US009197965B2

(12) United States Patent
Croft, III

(10) Patent No.: US 9,197,965 B2
(45) Date of Patent: Nov. 24, 2015

(54) PLANAR-MAGNETIC TRANSDUCER WITH IMPROVED ELECTRO-MAGNETIC CIRCUIT

(71) Applicant: James J. Croft, III, Bellevue, WA (US)

(72) Inventor: James J. Croft, III, Bellevue, WA (US)

( * ) Notice: Subject to any disclaimer, the term of this patent is extended or adjusted under 35 U.S.C. 154(b) by 0 days.

(21) Appl. No.: 14/207,213

(22) Filed: Mar. 12, 2014

(65) Prior Publication Data

US 2014/0270326 A1 Sep. 18, 2014

Related U.S. Application Data

(60) Provisional application No. 61/792,561, filed on Mar. 15, 2013.

(51) Int. Cl.

| | |
|---|---|
| ***H04R 1/02*** | (2006.01) |
| ***H04R 9/02*** | (2006.01) |
| *H04R 7/04* | (2006.01) |

(52) U.S. Cl.

CPC *H04R 9/025* (2013.01); *H04R 7/04* (2013.01); *H04R 2307/021* (2013.01)

(58) Field of Classification Search

CPC ..... H04R 1/02; H04R 11/02; H04R 9/06; H04R 1/00

USPC ..... 381/398, 390, 152, 186, 182, 412, 421

See application file for complete search history.

(56) References Cited

U.S. PATENT DOCUMENTS

| | | | |
|---|---|---|---|
| 1,557,356 | A | 10/1925 | Gerlach |
| 1,987,412 | A | 1/1935 | Neumann |
| 2,233,886 | A | 3/1941 | Cowley et al. |
| 3,013,905 | A | 12/1961 | Gamzon et al. |
| 3,066,200 | A | 11/1962 | Pavlak |
| 3,164,686 | A | 1/1965 | Tibbetts |
| 3,198,890 | A | 8/1965 | Rich |
| 3,209,084 | A | 9/1965 | Gamzon et al. |
| 3,283,086 | A | 11/1966 | Evans |
| 3,674,946 | A | 7/1972 | Winey |
| 3,873,784 | A | 3/1975 | Doschek |
| 3,898,598 | A | 8/1975 | Asahi |
| 3,919,499 | A | 11/1975 | Winey |
| 3,922,502 | A | 11/1975 | Tabuchi |

(Continued)

FOREIGN PATENT DOCUMENTS

WO WO 0078095 A1 * 12/2000

*Primary Examiner* — Brian Ensey
*Assistant Examiner* — Julie X Dang
(74) *Attorney, Agent, or Firm* — Michael R. Schacht; Schacht Law Office, Inc.

(57) ABSTRACT

The invention provides a planar-magnetic transducer with a frame and a primary magnet row structure of elongated magnets adjacent and air gapped from a first surface side of a mobile portion of a thin film or thin structure diaphragm with conductive traces incorporated with the diaphragm. An additional pair of magnetic sources attached to the frame outside of the vibratable region of the diaphragm and mounted above the plane of the opposite, second surface side of the diaphragm to enhance magnetic energy near the second surface side of the film diaphragm, without any magnet rows attached directly in front of the second surface side of the vibratable region of the diaphragm between the additional pair of magnetic sources. The additional magnetic sources can increase the drive force to the outer portions of the vibratable diaphragm, or across the diaphragm, to provide more control near the termination edge of the diaphragm and to create a more planar displacement of the diaphragm and increase transducer efficiency.

37 Claims, 27 Drawing Sheets

(56) References Cited

U.S. PATENT DOCUMENTS

| | | | | | |
|---|---|---|---|---|---|
| 3,922,503 | A | | 11/1975 | Tabuchi | |
| 3,922,504 | A | | 11/1975 | Kishikawa et al. | |
| 3,939,312 | A | | 2/1976 | McKay | |
| 4,037,061 | A | | 7/1977 | von Recklinghausen | |
| 4,156,801 | A | | 5/1979 | Whelan et al. | |
| 4,210,786 | A | | 7/1980 | Winey | |
| 4,264,789 | A | | 4/1981 | Kaizu et al. | |
| 4,273,968 | A | | 6/1981 | Suyama | |
| 4,276,452 | A | | 6/1981 | Suyama et al. | |
| 4,281,223 | A | | 7/1981 | Ugaji et al. | |
| 4,315,112 | A | | 2/1982 | Hofer | |
| 4,317,966 | A | | 3/1982 | Lister | |
| 4,319,096 | A | | 3/1982 | Winey | |
| 4,337,379 | A | | 6/1982 | Nakaya | |
| 4,384,173 | A | | 5/1983 | Briefer et al. | |
| 4,413,160 | A | | 11/1983 | Ohyaba et al. | |
| 4,471,172 | A | | 9/1984 | Winey | |
| 4,480,155 | A | | 10/1984 | Winey | |
| 4,484,037 | A | | 11/1984 | Nieuwendijk et al. | |
| 4,527,017 | A | * | 7/1985 | Kopinga et al. | 381/421 |
| 4,544,806 | A | | 10/1985 | Nieuwendijk et al. | |
| 4,723,296 | A | | 2/1988 | Nieuwendijk et al. | |
| 4,803,733 | A | | 2/1989 | Carver et al. | |
| 4,837,838 | A | | 6/1989 | Thigpen et al. | |
| 4,939,784 | A | | 7/1990 | Bruney | |
| 5,021,613 | A | | 6/1991 | Garcia | |
| 5,148,493 | A | | 9/1992 | Bruney | |
| 5,297,214 | A | | 3/1994 | Bruney | |
| 5,430,805 | A | | 7/1995 | Stevenson et al. | |
| 5,901,235 | A | | 5/1999 | Thigpen et al. | |
| 5,953,438 | A | | 9/1999 | Stevenson et al. | |
| 6,035,052 | A | | 3/2000 | Fujihira et al. | |
| 6,095,416 | A | * | 8/2000 | Grant et al. | 235/449 |
| 6,154,557 | A | | 11/2000 | Montour et al. | |
| 6,185,310 | B1 | | 2/2001 | Kermani et al. | |
| 6,480,614 | B1 | | 11/2002 | Denda et al. | |
| 6,760,462 | B1 | | 7/2004 | Thigpen | |
| 6,810,126 | B2 | | 10/2004 | Levitsky | |
| 6,845,166 | B2 | | 1/2005 | Hara et al. | |
| 6,920,230 | B2 | | 7/2005 | Usuki et al. | |
| 6,920,957 | B2 | | 7/2005 | Usuki et al. | |
| 6,934,402 | B2 | | 8/2005 | Croft, III et al. | |
| 6,956,953 | B2 | | 10/2005 | Mazarakis | |
| 6,963,654 | B2 | | 11/2005 | Sotme et al. | |
| 7,020,301 | B2 | | 3/2006 | Koura et al. | |
| 7,088,837 | B2 | | 8/2006 | Von Hellermann et al. | |
| 7,136,501 | B2 | | 11/2006 | Steere et al. | |
| 7,142,687 | B2 | | 11/2006 | Hanada | |
| 7,142,688 | B2 | | 11/2006 | Croft, III et al. | |
| 7,146,019 | B2 | | 12/2006 | Levitsky | |
| 7,174,024 | B1 | | 2/2007 | Suzuki et al. | |
| 7,251,342 | B2 | | 7/2007 | Graebener | |
| 7,254,248 | B2 | | 8/2007 | Johannsen et al. | |
| 7,558,395 | B2 | | 7/2009 | De Haan | |
| 7,627,134 | B2 | | 12/2009 | Garner et al. | |
| 7,747,035 | B1 | | 6/2010 | Heavner | |
| 7,773,765 | B1 | | 8/2010 | Graber | |
| 7,835,537 | B2 | | 11/2010 | Cheney | |
| 7,885,425 | B2 | | 2/2011 | Matsumura et al. | |
| 7,912,241 | B1 | | 3/2011 | Graber | |
| 7,940,952 | B2 | | 5/2011 | Regl | |
| 7,940,953 | B2 | | 5/2011 | Regl et al. | |
| 8,031,901 | B2 | | 10/2011 | Levitsky | |
| 8,064,631 | B2 | | 11/2011 | Hanada | |
| 8,180,096 | B2 | | 5/2012 | Sano et al. | |
| 8,553,926 | B2 | | 10/2013 | Takewa | |
| 2002/0191808 | A1 | * | 12/2002 | Croft et al. | 381/431 |
| 2004/0213431 | A1 | * | 10/2004 | Mello | 381/430 |
| 2005/0163338 | A1 | * | 7/2005 | Ohashi | 381/421 |
| 2005/0173025 | A1 | * | 8/2005 | Iwasaki et al. | 148/103 |
| 2009/0097693 | A1 | * | 4/2009 | Croft et al. | 381/399 |

* cited by examiner

PLANAR-MAGNETIC TRANSDUCER WITH IMPROVED ELECTRO-MAGNETIC CIRCUIT

RELATED APPLICATIONS

This application, U.S. patent application Ser. No. 14/207,213 filed Mar. 12, 2014, claims benefit of U.S. Provisional Application Ser. No. 61/792,561 filed Mar. 15, 2013, the contents of which are incorporated herein by reference.

TECHNICAL FIELD

The present invention relates to planar magnetic loudspeaker transducers and systems, and more particularly, planar-magnetic transducers with flexible thin film diaphragms and conductive voice coil traces distributed across the thin film diaphragm.

BACKGROUND AND RELATED ART

In the field of planar-magnetic loudspeakers, the prior art has been primarily made up of what are referred to as double-ended (or double-side driven), and single-ended (or single-side driven) devices, referring to either groups of magnet rows adjacent both surface sides of a thin film diaphragm, in the double-ended case, or magnet rows adjacent just one surface side of the diaphragm, representing a single-ended layout. Examples of both of these approaches are illustrated in, U.S. Pat. No. 3,674,946 "Electromagnetic Transducer" and U.S. Pat. No. 3,919,499 "Planar Speaker" both by James M. Winey, and U.S. Pat. No. 4,037,061 "Planar Pattern Voice Coil Audio Transducer" by Daniel R. von Recklinghausen. Applicant hereby incorporates herein by reference any U.S. patents and U.S. patent applications cited or referred to in this application.

Due to having magnets on both surface sides of the diaphragm, prior art double-ended devices can result in an increased and more confined magnetic field, but in exchange for the greater magnetic force they have had a number of limitations. Those shortcomings include a reduced ability to reproduce high frequencies accurately without linear distortions due to acoustic blockage and cavity effects from magnet structures both behind and in front of the vibratable diaphragm reducing acoustic transparency and causing cavity resonances, which can cause aberrations in the high frequency amplitude response and a low pass filter characteristic that can reduce high frequency bandwidth. Additional structural problems are caused by magnetic repulsion forces between the opposing front and back magnet structures centered over the active region of the diaphragm, particularly when high energy magnets are used, which require extensive bracing and/or heavy frame materials to attempt to offset frame flexing and minimize instabilities of diaphragm tension.

Both single-sided and double-sided prior art devices have a common limitation in that they tend to drive the active portion of the diaphragm with weaker force and/or reduced displacement at the outer most edge of the diaphragm and therefore, diaphragm excursions the center of the diaphragm can be much greater than at the outer portions of the diaphragm, causing both less effective use of diaphragm area, and a dynamic non-linear distortion due to changes in effective diaphragm area relative to diaphragm excursion.

Both single-ended and double-ended, devices also tend to have losses due to end conductor traces needing to be routed outside of the magnetic fields and causing resistive losses and un-driven portions of the diaphragm.

Additional limitations of prior art planar-magnetic transducers relate to reflections and standing waves that are due to film edge termination problems due to under-damped, uncontrolled diaphragm energy near the diaphragm edge termination points.

Also, the strongest flux lines at the outer most portion of the film diaphragm most often have the greatest intensity above or below, rather than in the plane of the film diaphragm such that they don't effectively engage the conductive traces on the diaphragm, and therefore contribute very little to the driving force of the outer portion of the diaphragm. This can result in reduced acoustic output and also in less control of the outer portions of the diaphragm, potentially causing frequency response errors.

Additionally, single-end driven planar magnetic transducers, generally do not have the magnetic force and output capability of a double-ended device. Solutions to the lack of diaphragm control have included mechanical damping of the film surface area and tend to be very lossy and raise the effective moving mass, which may cause further inefficiencies and limited control and utilization of the total diaphragm surface area. Also, as planar magnetic devices are made larger or wider to increase output, they tend to lose dispersion in the upper frequency ranges and in some cases beam the sound forward with overly restrictive directivity.

In an attempt to minimize resonances and interference in acoustic output in double-ended transducers caused by the acoustic opacity of magnets blocking acoustic output and resonances caused by the acoustic cavities, prior art solutions have been attempted, such as using thinner profile magnets adjacent one primary output surface side of the diaphragm in a double ended device, such as illustrated in U.S. Pat. No. 3,922,504 "Electroacoustic Transducer", by Kenichiro Kishikawa, or reducing magnet count adjacent one surface side of a double-ended device, as illustrated in U.S. Pat. No. 6,934,402 "Planar-Magnetic Speakers with Secondary Magnetic Structure", by James J. Croft III, et al. These approaches can offset part of the amplitude response problems of double-ended devices but still do not equal a one side, fully open, single-ended device in this regard.

It would be valuable to have a new planar magnetic transducer architecture that can improve planar-magnetic transducers by increasing magnetic field strength derived from both sides of the diaphragm, increasing magnetic force and acoustic output, and linearizing diaphragm mobilization while increasing control of the outer edges of the vibratable diaphragm as an improvement over a single-ended planar magnetic transducer without invoking the acoustical response errors and magnetic repulsion derived frame and diaphragm stability problems of a double-sided drive device.

SUMMARY

The present invention provides a double-sided drive planar magnetic transducer with an acoustically transparent primary output side. The structure of the present invention provides a planar-magnetic transducer with a frame and a primary magnet structure including magnets adjacent to, and air-gapped from, a first surface side of the mobile portion of a thin film or substantially planar diaphragm with conductive traces integrated with, and distributed across a portion of the diaphragm. The diaphragm is attached around a periphery of the mobile portion of the diaphragm and held in a state of predetermined tension. At least one secondary magnetic structure is mounted on a plane relative to a second surface side of the diaphragm and outside of the edge of the vibratable portion of the diaphragm to realize a second side drive to increase in force applied at least near the outer edge of the mobile portion of the diaphragm to improve diaphragm control and/or to increase the excursion capability of the complete diaphragm by creating a more planar diaphragm formation under high drive levels. The magnetic circuit at the outermost portion of the transducer can more effectively elevate the strongest flux lines up into the plane of the diaphragm, increasing efficiency and available drive force to the diaphragm.

In one preferred embodiment this increase in force can be at least partially derived from an increase in the flux density or "B" of the "BL" electromagnetic force at the outermost region of the mobile portion of the diaphragm, increasing excursion to create a more even, planar movement of the diaphragm by way of an additional magnetic source connected to the frame outside of the periphery of attachment of the film diaphragm and above the plane of an opposite, second surface side of the diaphragm to enhance double side magnetic energy drive force near the termination edge of the film diaphragm without any magnets in front of, the second side of the vibratable portion of the diaphragm which would interfere with the frontally projected acoustic waves of the device. The additional magnetic sources may be realized by, one or more of; a magnetically conductive pole and a magnet above the plane of the second surface side of the diaphragm or an acoustically transparent, magnetically conductive pole suspended over a second surface side of the diaphragm to increase drive to the diaphragm without any magnets suspended over the mobile portion of the second surface side of the diaphragm.

The invention provides for a wave-launch unimpeded by magnets on a second side of the vibratable portion of the diaphragm while having the advantage of an outboard magnetic circuit forward of the plane of the second surface side of the diaphragm providing a push-pull, double side drive along the outside portion of the diaphragm, or across the majority of both sides of the diaphragm, creating one or more of greater diaphragm control, more planar output and increased total output, without the drawbacks of acoustic interference of a double side drive system of the prior art. These and other forms and advantages will become apparent with the ongoing specification and claims disclosed below.

DETAILED DESCRIPTION

Figure 1A:
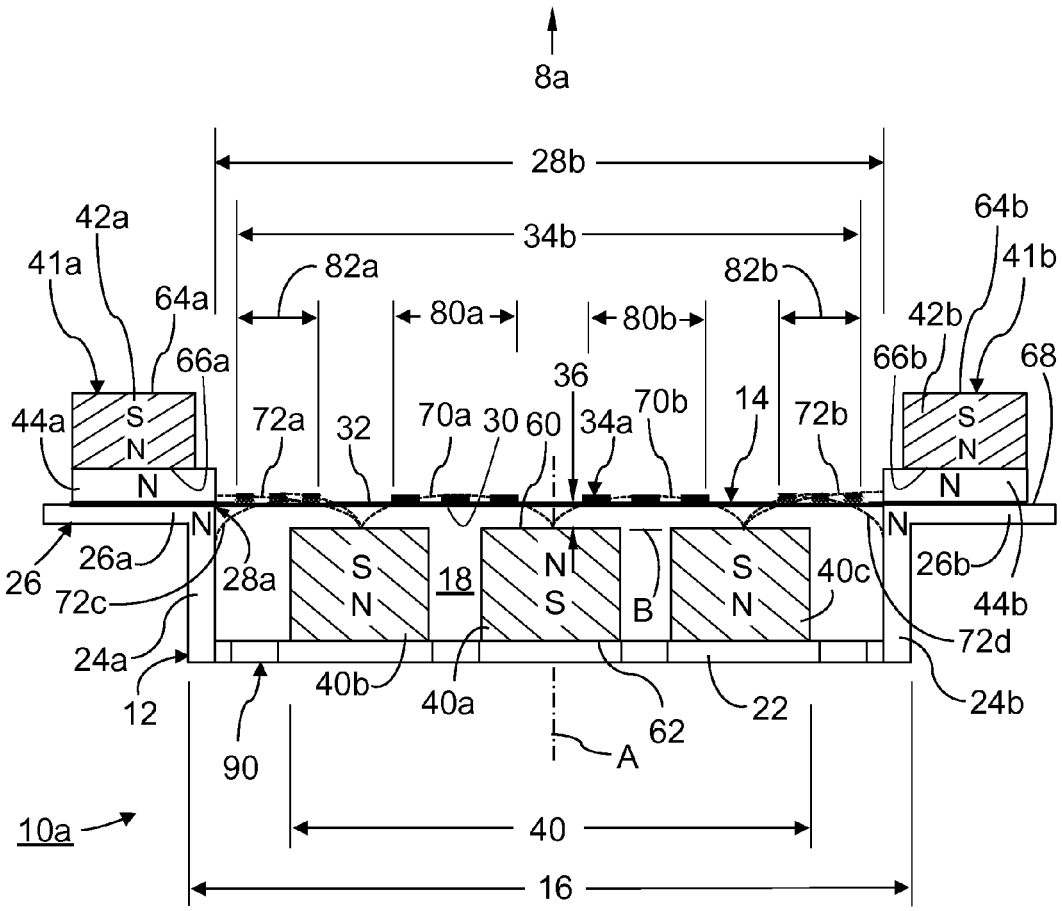
FIG. 1A is a cross-sectional view of a first example of the invention.
Figure 1B:
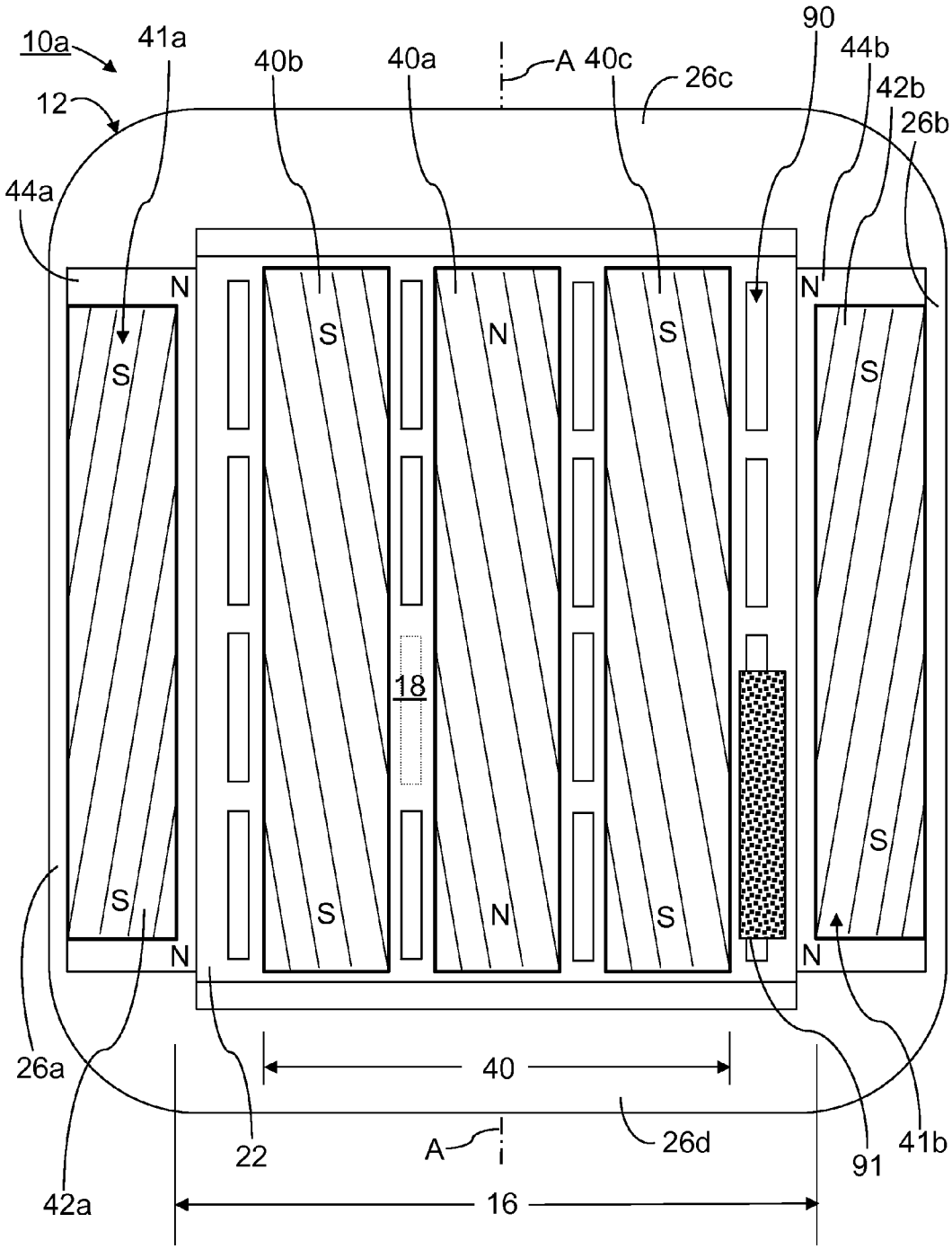
FIG. 1B shows a top plan view of the first example invention of FIG. 1A with a diaphragm thereof removed.

Referring initially to FIGS. 1A and 1B of the drawings, depicted therein is a first example of a quasi-double-sided drive, planar magnetic transducer 10*a* of the present invention. The first example transducer 10*a* comprises a frame 12, a diaphragm 14, and a primary magnetic structure 16. As depicted in FIG. 1A, a center-plane 'A' is defined with reference to the first example transducer 10*a*. A dimension of the example transducer 10*a* perpendicular to the center plane 'A' and substantially parallel to the diaphragm 14 will be referred to as a first, lateral, or width, X-axis reference direction. A direction along the center plane 'A' substantially perpendicular to the diaphragm will be referred to as a second, depth, or height, Y-axis reference dimension of the example transducer 10*a*. A dimension of the example transducer 10*a* parallel to the center plane 'A' and substantially parallel to the diaphragm 14 will be referred to as a third, longitudinal, or length, Z-axis reference direction. The magnet drawings will be represented by rectangles or squares with slanted lines, and with the primary magnets 40 being represented by lines slanting upward to the left, and secondary magnets 42, being represented by lines slanting upward to the right.

The frame 12 supports the diaphragm 14 to define a frame chamber 18. The primary magnet array 40, including three primary magnet rows 40*a*, 40*b*, and 40*c*, of primary magnetic structure 16, are supported within frame chamber 18 by the frame 12. In particular, the example frame 12 defines a back plate portion 22, side portions 24*a* and 24*b* extending in the depth dimension from the back plate portion 22, and flange portions 26*a* and 26*b* extending in the lateral dimension respectively from the side portions 24*a* and 24*b*. The side portions 24 and flange portions 26 thus extend around at least a portion of the frame chamber 18 as generally indicated by FIG. 1B, wherein flange portions are illustrated as 26*a*, 26*b*, 26*c*, and 26*d*.

Components of support frame 12, such as back plate 22, sidewall portions 24*a*, 24*b*, flange portions 26*a*, 26*b* may be of magnetically conductive or ferrous construction. The terms "ferrous" and "magnetically conductive" are used interchangeably in the ongoing discussions, referring to any magnetically conductive material.

As shown in FIG. 1A, a perimeter of attachment 28*a* defines a boundary of the vibratable portion 28*b* of the diaphragm 14 as it is attached to the flange portions 26*a* and 26*b* to secure the diaphragm 14 to the frame 12. In the first example transducer 10*a*, the entire peripheral vibratable portion 28*b* of the diaphragm 14 of FIG. 1A is secured to the flange portions 26*a*, 26*b*, (also flange portions 26*c*, and 26*d* shown in FIG. 1B). The vibratable portion 28*b* of diaphragm 14 is held in a preferred state of tension. In other words, a perimeter portion of diaphragm 14 is supported by support frame 12 such that a vibratable portion 28*b* of the diaphragm is held in a predetermined state of tension.

The diaphragm 14 defines a first surface 30 and a second surface 32. When supported by the frame 12 as depicted in FIG. 1A, the first surface 30 is arranged on a side of the diaphragm 14 facing the frame chamber 18 and the second surface 32 is arranged on a side of the diaphragm 14 facing away from the frame chamber 18. In the example transducer 10*a*, a trace 34*a* is formed on the second surface side 32 of the diaphragm 14 and thus is located outside of the frame chamber 18. However, the trace 34*a* may be formed instead or in addition on the first surface 30 of the diaphragm 14, in which case the trace 34*a* would be located at least partly within the frame chamber 18. As will be described in further detail below, the center primary magnet row 40*a*, of primary magnetic structure 16, defines a magnet surface reference plane 'B', and a gap 36 distance is formed between the diaphragm 14 and the reference plane 'B', shown as center magnet row 40*a* top polarity surface 60, which in magnet row 40*a* has the "N" (North) polarity. Outer primary magnet rows 40*b* and 40*c* may have a gap distance equal to gap 36 of center magnet row 40*a* gap or may in some preferred embodiments have a somewhat greater or lesser gap distance, wherein a lessor distance may offer increased efficiency and control of diaphragm 14.

The example primary magnetic structure 16 of the first example transducer device 10*a* comprises primary magnet row array 40. Transducer 10*a* of FIGS. 1A and 1B further includes two secondary magnetic structures 41*a* and 41*b* with respective secondary magnets 42*a* and 42*b* and magnetically conductive focusing pole pieces 44*a* and 44*b*. In the context of the present invention, the term "magnetically coupled" refers a dominant magnetic path or low magnetic impedance connection formed between magnets and magnetically conductive structures coupled with each other in a manner transferring magnetic energy into the magnetically conductive materials. In example 10*a* the primary magnets group 40, including primary magnet rows 40*a*, 40*b*, and 40*c* are preferably attached to, and magnetically coupled through, the back plate portion 22 by way of the back plate 22 being constructed of magnetically conductive material. As with back plate 22, sidewall portions 24 and flange portions 26 may or may not be formed of magnetically conductive material, depending on design considerations but in this example 10*a* of FIG. 1A, back-plate 22, sidewalls 24*a* and 24*b* and flange 26*a* and 26*b* are of magnetically conductive composition. In the example transducer 10*a*, the frame 12 is formed of magnetically conductive materials such that the portions 26*a* and 26*b* form passive magnetic return pole continuity from primary magnet rows 40 to secondary focusing plates 44*a* and 44*b*. The passive return pole magnetic focusing plates 44*a* and 44*b* are formed of magnetically conductive material, and are magnetically coupled to the secondary magnets 42*a* and 42*b* as indicated in FIG. 1A. Magnetic coupling may still be effective if diaphragm 14 extends beyond attachment boundary 28 and is positioned between flange 26*a* and focus plate 44*a* and also between flange 26*b* and focus plate 44*b*, as shown in FIG. 1.

In the present application, the term "return structure" will be used to refer to any structure that functions to form an enhanced magnetically conductive return path from an adjacent magnet. As examples, the back plate 22, sidewall 24, and flange 26 structures, when constructed of a magnetically conductive, or ferrous, material, may form an enhanced bi-directional return path from the primary magnet group 40 to the secondary magnetic structures 41*a* and 41*b* and thus may be referred to as a magnetic "return structure". The passive return pole, or magnetic focusing, structures 44*a*, 44*b* may be arranged to form an enhanced return path magnetic coupling for the primary magnets 40 and the secondary magnets 42*a* and 42*b*, and thus being magnetically energized by both the primary magnet array 40 and the secondary magnet rows 42*a* and 42*b* and may also be referred to as return structures. This magnetic charging of the secondary focusing poles 44*a* and 44*b* by both the primary and secondary magnet energy provides a very strong, focused magnetic source in secondary magnetically conductive focusing plates 44*a* and 44*b*.

The term "row" refers to one or more magnets, elongated magnets, or magnetic pole structures such as the primary magnet rows 40*a*, 40*b*, and 40*c* in the group of primary magnets 40, and secondary magnet rows 42*a* and 42*b* of the secondary magnetic structure rows 41*a* and 41*b*, and passive return pole rows 44*a* and 44*b*, arranged on the frame structure 12 such that each magnetic structure defines at least one effective north or south magnetic pole. Each row may comprise a single magnet, elongated magnet or other structure or a plurality (two or more) of magnets, elongated magnets, or other structures, but the structures within a given row act as a unified magnetic structure.

In the first example transducer 10*a*, FIG. 1A defines, the magnet groups 40 and 42*a*, 42*b* are each formed by elongate, rectangular bar magnets, and the rows 40*a*, 40*b* and 40*c* formed by these magnets are thus straight. Similarly, the secondary magnetic structures 41*a* and 41*b* are formed to be straight and substantially parallel to primary magnet rows 40. However, bar magnets and/or flanges of other shapes may be provided, or a plurality of bar magnets may be arranged in a line or rows having shapes (e.g., curved, circular, serpentine, zigzag) other than straight.

In the first example transducer 10*a*, the primary magnets 40 are arranged in primary magnetic rows 40*a*, 40*b*, and 40*c*. The secondary magnets 42*a* and 42*b* are arranged in first and second secondary magnetic structure rows 41*a* and 41*b*. With the example frame 12, the passive return poles 44*a* and 44*b* form first and second passive return focusing pole rows directly adjacent and above the flange portions 26*a* and 26*b* and the second surface side 32 of the diaphragm 14. The first, second, and third primary rows 40*a*, 40*b* and 40*c*, the first and second secondary magnetic rows 42*a* and 42*b*, and the passive return focusing pole rows 44*a* and 44*b* of secondary magnetic structures 41*a* and 41*b*, are symmetrically arranged about center plane 'A' and generally extend along the third length or longitudinal, Z-axis dimension of the first example transducer 10*a*.

As illustrated in FIG. 1A, the primary magnet row 40*a* defines a magnetic polarity surface 60 and a magnetic polarity surface 62, and the first secondary magnet row 42*a* defines magnetic polarity surfaces 64*a* and 66*a* and the second secondary magnet row 42*b* defines magnetic polarity surfaces 64*b* and 66*b*. The magnet surface faces 60 and 62 refer to the surfaces at the "north" and "south" pole surfaces, respectively, of the primary magnet row 40*a*. Similarly, in FIG. 1A the magnetic polarity surfaces 64*a* and 66*a* refer to the surfaces at the "south" and "north" pole magnet surfaces, respectively, of the secondary magnet row 42*a*, and the magnetic polarity surfaces 64*b* and 66*b* refer to the surfaces at the "south" and "north" pole magnet surfaces, respectively, of the secondary magnet row 42*b*. These face numbers will be used to refer to the polarity of the surface in the ongoing discussion.

The flange portion 26*b* further defines a flange surface 68 that is substantially coplanar with the first surface 30 of the diaphragm 14. In the first example transducer 10*a*, the magnet surface faces 60 or 62 of the primary magnet row 40*a* in the primary magnetic row array 40 and the magnetic polarity surfaces 64 or 66 of the secondary magnets 42 in the secondary magnetic rows 42*a* and 42*b* adjacent to the diaphragm 14 are all substantially aligned with the reference plane B. Any of the magnet surfaces 60, 62, 64, or 66 adjacent to the diaphragm 14 will be referred to as an adjacent face. The first surface 30 of the diaphragm 14 is thus spaced from the adjacent face 60 defined by the primary magnet row 40*a* by a distance equal to that of the gap spacing 36. In some embodiments it may be preferred to have similar or somewhat lesser gap spacings between primary magnet rows 40*b* or 40*c* and the first diaphragm surface 30.

The primary magnet row 40*a* and secondary magnet rows 42*a* and 42*b* are formed by bar magnets polarized such that opposite poles are formed at the first (north) polarity magnetic polarity surfaces 60, 66*a*, 66*b*, and the second (south) polarity magnetic polarity surfaces 62, 64*a*, 64*b*. Further, the polarities of the primary magnets 40 in the example transducer 10*a* are oriented to alternate in the lateral dimension such that the north pole of the central primary magnet row 40*a* is adjacent diaphragm 14 and is flanked by primary magnet rows 40*b* and 40*c* with the opposite south polarity pole surface adjacent diaphragm 14. Further, the north pole of the secondary magnet rows 42*a* and 42*b* of the secondary magnetic structures 41*a* and 42*b* energize passive pole plates 26*a* and 26*b* respectively, to form effective north poles oriented and focused to the outer conductive trace portions 82*a* and 82*b* of the second surface side 32 of diaphragm 14.

The term "effective polarity" will be used in this application to refer to the energized polarity of any passive pole piece or any magnetic structure (e.g., primary magnet, secondary magnet, passive return pole portion, and/or pole structures (as discussed below)) adjacent to the diaphragm 14. The term "alternate in the lateral direction", when used in reference to effective polarity, will be used in this application to refer to the fact that the effective polarities of a given magnet row of magnetic array 16 alternate between north and south moving in the lateral direction across the frame 12. In the first example transducer 10*a*, the effective polarities of the primary magnet group 40 alternate in the lateral direction from south to north to south.

The primary magnets 40 establish central unfocused magnetic fringe fields 70*a* and 70*b*. In the following discussion, the term "primary magnetic field" will refer to the magnetic fringe fields established adjacent the first surface side 30 of diaphragm 14 from primary magnet rows 40. The term "secondary magnetic field" refers to the magnetic field established above the plane of the second surface side 32 of diaphragm 14. The term "pole magnetic field" refers to a magnetic field established in a magnetically conductive magnetic pole piece from an active magnet with the passive magnetic pole piece coupled adjacent thereto, such as magnet row 42*a* and passive magnetically conductive magnetic pole 44*a*. A passive pole magnetic field may be referred to as a return magnetic field or a focused magnetic field or focused magnetic field source.

Accordingly, the physical arrangement of the primary magnets 40, the secondary magnets 42*a* and 42*b*, and the passive magnetically conductive poles 44*a* and 44*b* and the magnetic orientation of the alternating poles formed, by those structures of the first example transducer 10*a* described above, results in a primary magnetic fields 70*a* and 70*b*, and first and second secondary magnetic fields 72*a* and 72*b*, as shown in FIG. 1A.

Throughout the drawings the field line patterns by various alphanumerics of 70, 72 are generally illustrating the significant or stronger field lines. Magnetic fields have many lines of force, stronger and weaker, and at different angles. The most effective lines of force are those that are substantially in parallel with the plane of the diaphragm when intersecting the conductive trace patterns 34*a*. While stronger lines of force are shown with field lines 70 and 72, throughout the representative drawings other weaker lines of force (not shown) may also be in parallel with the diaphragm and intersecting with conductive trace patterns 34.

The field lines 72*a* and 72*c* tend to be a combination of a fringe field of the outer row primary magnet row 40*b* and the focused field of the nearest secondary magnetically conductive focusing plate 44*a*. Also, the field lines 72*b* and 72*d* tend to be a combination of a fringe field of the outer row primary magnet row 40*c* and the focused field of the nearest secondary magnetically conductive focusing plate 44*b*. The secondary focusing poles 44*a* and 44*b* tend to pull the strongest field lines upward, more in line with, and parallel to, the outer trace groups 82*a* and 82*b* respectively. This approach increases the field strengths interacting with outer trace sections 82*a* and 82*b* to increase mobilization of the outermost portions of the film diaphragm 14. This effect can be seen illustrated in FIG. 2B.

FIG. 1A further illustrates that the conductive trace 34*a* formed on the diaphragm 14 comprises first and second primary trace portions 80*a* and 80*b*, and first and second secondary trace portions 82*a* and 82*b*. The trace 34*a* is formed in a pattern such that current flowing through the trace 34*a* flows in the same direction within each of the three traces within each of the trace portions 80*a*, 80*b*, 82*a*, and 82*b* (also illustrated by arrow groups 94*a* in FIG. 24).

An electrical signal flowing through the trace 34*a* will thus interact with the magnetic fields 70-72 formed by the primary and secondary magnet structures and thus move relative to the magnet array 40. Because the diaphragm 14 is flexible and suspended from the frame 12, and because the trace 34*a* is formed on (secured to) the diaphragm 14, the diaphragm 14 also moves relative to magnet array 40 when the trace 34*a* moves relative to the magnet array 40. Movement of the diaphragm 14 caused by the interaction of the trace portions 80*a*, 80*b* and 82*a*, 82*b* with the magnetic fields 70*a* & *b*, and 72 *a, b, c*, and *d*, produces an acoustic output that corresponds to the electrical signal flowing through the trace 34*a*.

The primary magnets 40 forming the example first, second, and third primary rows 40*a*, 40*b*, and 40*c* preferably comprise high-energy magnets. While magnetic energy of the invention may be scaled and adapted to work with most any magnet energy density or type, the Applicant has determined that magnets having an energy product of in a first example range of at least 20 MGOe (Mega Gauss Oersteds) or in a second example range of greater than 32 MGOe are preferable for use in the primary magnet array 40. High-energy Neodymium magnets may be used in the primary magnet array 40.

The example secondary magnets 42*a* and 42*b* forming the secondary magnetic rows 41*a* and 41*b* are preferably formed of magnets having a high energy product or low energy product rating relative to that of the primary magnets 40. In particular, the secondary magnets 42*a* and 42*b* may have an MGOe energy product in a first example range at least 5 to 50 times less or in a second example range of approximately the same the MGOe energy product rating of the primary magnets 40. The example secondary magnets 42*a* and 42*b* may be magnets made of ferrite-based material for the lower energy product. The Applicant has determined that ceramic ferrite such as Ceramic 5 and Ceramic 8 and/or ferrite-impregnated rubber may be used to form the example secondary magnets 42*a* and 42*b*. Using lower energy magnets in the secondary magnet structures may increase the stability of the outer portions of the diaphragm while keeping costs lower. The secondary magnets may alternatively be made of a magnet material the same as that of the primary magnet array 40, with similar energy density, or somewhat lower or greater energy density. In all cases, the inventive arrangement of the secondary magnets may provide a greater magnetic force or may provide a better positioning of the lines of magnetic force, as a novel double sided drive, while keeping a primary acoustic path direction 8, into an external environment, unimpeded by magnets adjacent the second surface side 32 of diaphragm 14, as compared to prior art double sided drive devices shown in FIG. 3A. The term "environment external to the transducer" or "external environment" may be a listening room, or an entrance into an acoustic horn or waveguide, or any other environment into which the device may be used to transmit acoustic energy based on an electrical input signal.

The secondary magnetically conductive plates 44*a* and 44*b* and flanges 26*a* and 26*b* may operate as enhanced return poles forming part of the magnetic return path through the back plate portion 22 from the primary magnet rows 40*b* and 40*c*. Secondary magnets 42*a* and 42*b* provide increased magnetic energy into the magnetic magnetically conductive poles 44*a* and 44*b* and return flange poles 26*a* and 26*b*. Both of these magnetic energy paths, from primary magnets and secondary magnets, converging in the same magnetic polarity to magnetically energize magnetic poles 44*a* and 44*b* and return flange poles 26*a* and 26*b*, increase the focused magnetic energy in magnetic fields 72*a* and 72*b* and therefore maximizing magnetic flux in conductive traces 82*a* and 82*b*. This arrangement also elevates field 72*a* and 72*b* to optimize positioning of magnetic energy and to maximize energy in the plane of the traces 82*a* and 82*b*.

Figure 2A:
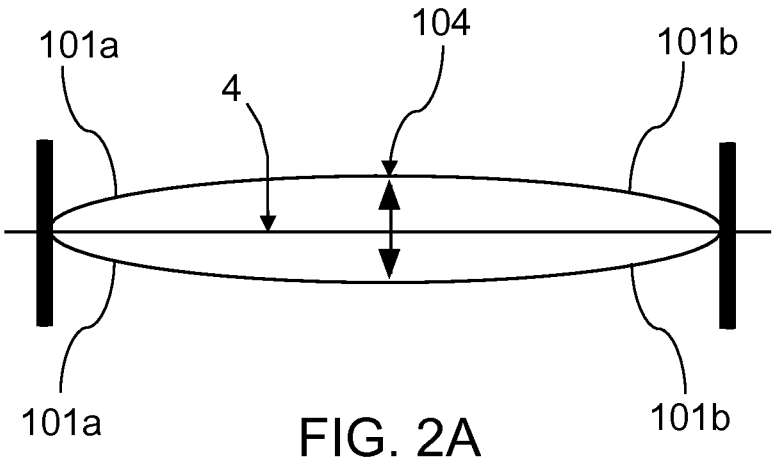
FIG. 2A Prior Art
FIG. 2A shows the non-planar diaphragm motion resulting from the distribution force of a prior art device.
Figure 2B:
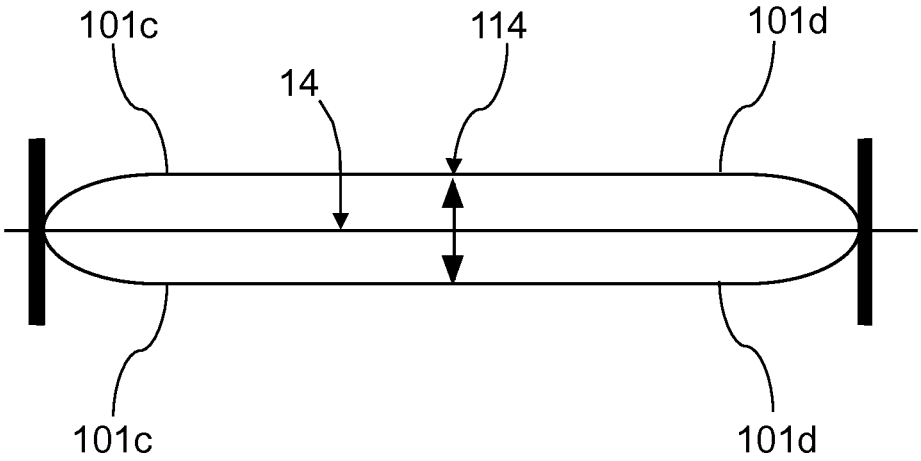
FIG. 2B shows an increase in outer diaphragm motion resulting from the distribution force of an example of the invention.

The improved vertical positioning of, and increased energy delivered to, magnetic fields 72*a* and 72*b* by the inventive magnetic structure can provide a number of advantages, such as increased control and reduced distortion in the outermost mobile diaphragm portions near the attachment area of flange surface 26*a* and 26*b*. This can be achieved with high-energy secondary magnets 42*a* and 42*b* or low cost, lower-energy secondary magnets 42*a* and 42*b* with MGO ratings as specified above, reducing total magnetic cost for a given transducer output and reduced distortion. Alternatively, with high-energy secondary magnets in positions 42*a* and 42*b*, the transducer 10*a* of FIG. 1A may achieve greater planar drive across the diaphragm 14 increasing output at the outer portions 101*c* and 101*d* of the diaphragm 14 as shown in the comparison of the deflection of the diaphragm of prior art devices represented in FIG. 2A and that of the invention represented in FIG. 2B. FIG. 2A shows diaphragm 4 of a prior art planar magnetic device with prior art drive applied to diaphragm 4. It can be seen that this causes the diaphragm to have tympanic displacement of greater mobility in the center of total diaphragm mobility 104 than at the outer edges 101*a* and 101*b* of the diaphragm 4. With the invention shown in FIG. 1A diaphragm displacements can be formed more like that shown in FIG. 2B, with a more planar shape with the displacements at outer portions 101*c* and 101*d* of diaphragm 14 more effectively approaching the magnitude of the center of total mobility 114 of diaphragm 14. This effect may be increased by increasing the ratio of the magnetic force applied to outer conductive traces 82*a* and 82*b*, as compared to the magnetic force applied to central conductive traces 80*a* and 80*b*. This increase may be realized by using magnets 42*a*, 42*b* of greater magnetic force in the secondary magnet structures 41*a* and 41*b* or optimizing the shape and positioning of focusing poles 44*a* and 44*b* for maximum magnetic energy in the plane of outer conductive trace groups 82*a* and 82*b*. Increasing the diaphragm deflection at the outer edges to create a more planar formation can increase the cubic volume displacement and therefore increase the acoustical output with the application of secondary magnetic structures 41*a* and 41*b* of the planar magnetic transducer of FIG. 1A for a given electrical power input. Alternatively, reducing magnetic energy in central magnet row 40*a* or all of the primary magnet rows 40 may increase the effect.

Referring to FIGS. 1A and 1B, acoustic openings 90 may optionally be formed in the back plate portion 22 of the frame 12 to reduce air-load stiffness on the diaphragm 14 that would otherwise restrict movement of the diaphragm 14 at lower frequencies. These openings may not be required for 'tweeter' versions of the invention, with higher range operating frequencies, but for wider range devices operating to lower frequencies, the openings may be preferred. Also, they can allow the device to be operated as an acoustic dipole, with sound emanating from the front and back of the device, in opposite acoustic polarity. Acoustic resistance material 91, shown in FIG. 1B, may also be optionally arranged within the frame chamber 18 to at least partly cover the openings 90 and thereby damp high "Q" resonances of the diaphragm. If used, the acoustic resonance material 91 can be placed anywhere from inside the frame chamber 18 to being placed external to transducer 10*a*, behind back-plate 22 of frame 12. The acoustical resistance material 91 can be any acoustically resistive material such as porous acoustical open or closed cell foam, felt, woven materials, cloth, fiberglass, or other materials known for resistive damping of acoustical energy.

At the fundamental resonant frequency of the diaphragm 14 of transducer 10*a* in many of the embodiments, the 'Q' of the resonance can be quite high, with values greater than two and an associated amplitude peak of greater than 6 dB at the resonant frequency. The damping material 91 can be used to damp the peak down to a 'Q' of one or less and create a substantially flat amplitude response through the resonant frequency range. The damping can also be used to smooth and damp upper frequency resonances that may be generated in the diaphragm 14. This material can be deployed with greater or lesser density or in greater or lesser amounts or deleted, depending on the desired amount of damping for a particular device.

Figure 18:
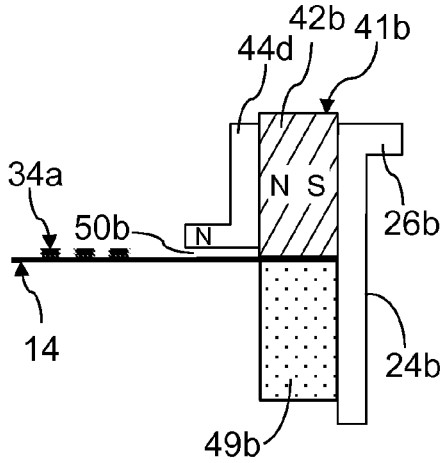
FIG. 18 shows a cross-sectional view of another example of the secondary magnet structure of the invention.

Turning now more specifically to FIG. 1B of the drawing, that figure shows a top plan view of the first example transducer device 10*a* with film diaphragm 14 removed for clarity. In FIG. 1B, the acoustic resistance material 91 is shown, for clarity, as only partially covering thru-hole the openings 90 in magnetically conductive back plate portion 22. The acoustic material may be placed in the frame chamber 18, against back-plate 22, or moved forward closer to the diaphragm 14, or may fill the majority of the frame chamber 18. Alternatively, the acoustic material may be placed outside of frame chamber 18, on the outside of back-plate 22, as shown in FIG. 18. Further shown is support frame 12, including primary magnetic structure 16, supporting primary magnet array 40, consisting of elongated primary magnet rows 40*a*, 40*b*, and 40*c*. Flanges 26*a*, 26*b*, 26*c*, and 26*d* are part of support frame 12, with flanges 26*a* and 26*b* supporting secondary magnetic structures 41*a* and 41*b*, each including magnetic focusing poles 44*a* and 44*b*, and secondary magnets 42*a* and 42*b*, respectively.

Figure 3A:
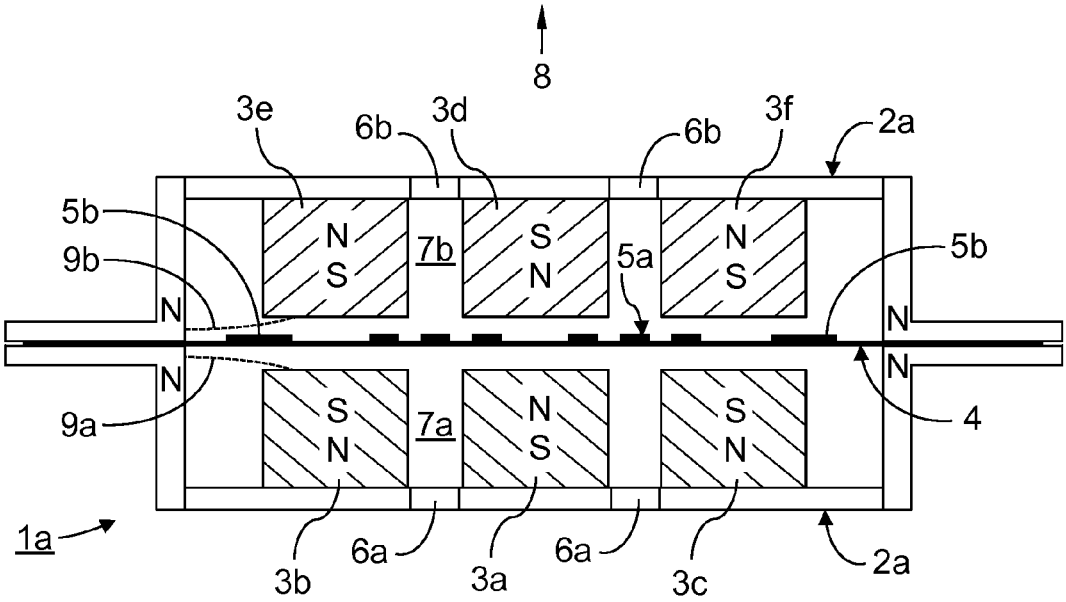
FIG. 3A Prior Art
FIG. 3A shows a cross-sectional view of a prior art double-sided planar magnetic transducer.
Figure 3B:
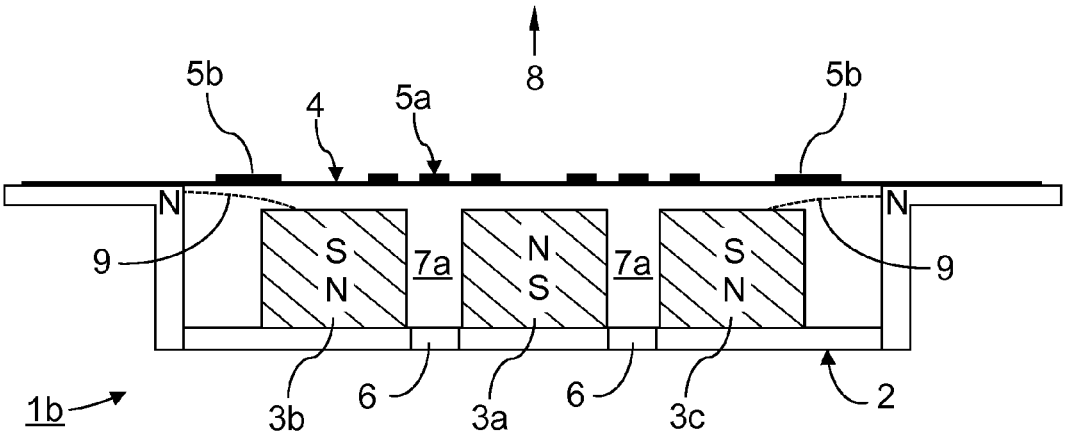
FIG. 3B Prior Art
FIG. 3B shows a cross-sectional view of a prior art single-sided planar magnetic transducer.
Figure 3C:
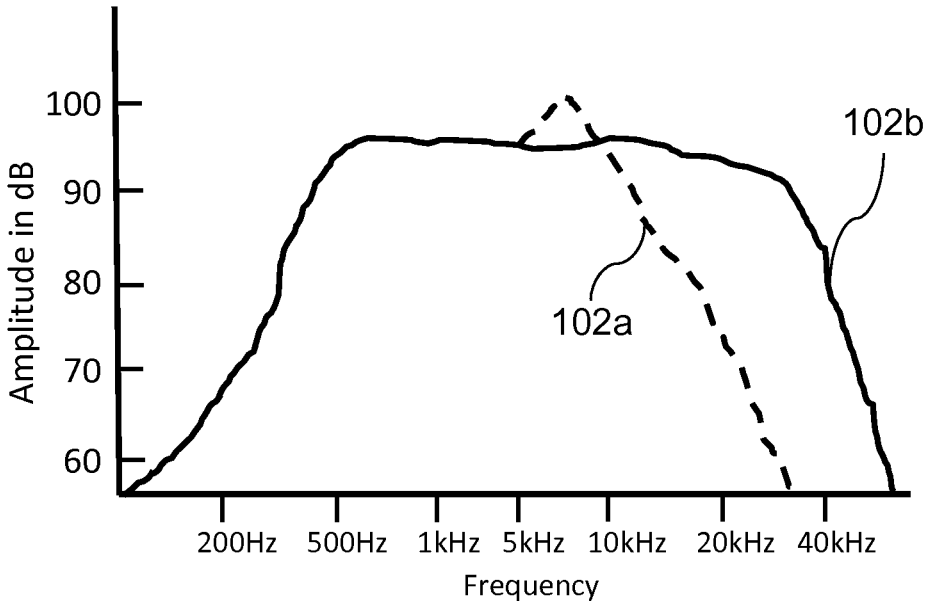
FIG. 3C shows the frequency response comparison of a prior art double-side driven device and an example of the invention.

The inventive double-sided drive planar magnetic transducer with acoustically transparent main output side of FIGS. 1A and 1B provides a number of advantages over the prior art, including acoustic transparency in primary acoustic output direction 8*a* that is superior to prior art double sided planar magnetic transducers 1*a* of FIG. 3A that have solid magnets 3*d*, 3*e*, and 3*f* and cavities 7*b* adjacent both sides of the diaphragm 4 which disrupt the primary acoustical output 8, as illustrated graphically by curve 102*a* in FIG. 3C. Additionally, the double-sided drive inventive transducer of FIG. 1A and FIG. 1B provides greater output than the singled-end drive prior art device of FIG. 3B while maintaining the uninterrupted output in primary acoustic output direction 8 of prior art device of FIG. 3B as shown graphically in curve 108*b* of FIG. 3C. Besides offering the above stated improvements over the prior art doubled ended drive and single-ended drive transducers, implementations of the first example 10*a* of the invention may also provide further advantage over prior art planar magnetic transducers with superior planar formation of the diaphragm 14, as shown by increased diaphragm edge mobility 101*c* and 101*d* and total diaphragm mobility 114, in FIG. 2B due to increased magnetic field force on outer conductive trace groups 82*a* and 82*b*, of FIG. 1A.

FIG. 3A illustrates a prior art double-sided (or sometimes referred to as double-ended) drive, planar magnetic transducer 1*a* comprising; a back plate 2*a* and front plate 2*b* supporting the three back rows of magnets 3*a*, 3*b*, and 3*c* and three front rows of magnets 3*d*, 3*e*, and 3*f*, thin film diaphragm 4 and conductive traces 5 attached to diaphragm 4. Upon the movement of diaphragm 4, acoustic output is produced and projected into cavities 7*a*, and 7*b*, and through openings 6*a* in back plate 2*a* and openings 6*c* in front plate 2*b* and in a primary acoustic path direction 8 into an external environment. Also, shown are the maximum magnetic energy magnetic field lines 9*a* and 9*b* at one lateral side of the transducer (equivalent fields would exist at the opposite lateral side of the transducer). It can be seen that they fall below the outer conductive trace 5*b* and therefore make less contribution to driving the outer edges of the diaphragm 4.

FIG. 3B illustrates a prior art single-sided drive (or sometimes referred to as single-ended), planar magnetic transducer 1*b* comprising; a back plate 2*a* supporting the back rows of magnets 3*a*, 3*b*, and 3*c*, thin film diaphragm 4 and conductive traces 5 attached to diaphragm 4. Upon the movement of diaphragm 4, acoustic energy is produced and projected into cavities 7*a*, and through openings 6 in back plate 2 and 'directly' out in a primary acoustic path direction 8 into an external environment.

While the single-ended transducer 1*b* of FIG. 3B has less magnetic energy and efficiency than the double-ended device 1*a* of FIG. 3A, the single ended device of FIG. 3B emits acoustic energy 'directly' off the diaphragm in a primary acoustic path direction 8 into an external environment, unimpeded by physical magnets, whereas the primary acoustic path direction output 8 of double-ended device of FIG. 3B is impeded by magnets 3*a*, 3*b*, 3*c* and cavities 7*b*, which can cause resonances and amplitude distortions to the acoustic output (shown in frequency response curve 102*a* of FIG. 3C).

Both of the prior art devices of FIGS. 3A and 3B also exhibit low magnetic energy and poor positioning of the strongest lines of force 9 (9*a*, 9*b* in FIG. 3A) near the edge of the diaphragm 4, causing inefficient drive force to the outer conductive traces 5*b* on diaphragm 4.

In FIG. 3C illustrates an advantage of the invention as compared to the prior art. Frequency response curve 102*a* shows the resulting response anomalies of the prior art, such as FIG. 3A double sided, (or double-ended), planar magnetic transducer 1*a* with magnet rows 3*a*, 3*b*, 3*c* and 3*d*, 3*e*, 3*f*, adjacent both surface sides of a planar magnetic transducer diaphragm 4 including conductive trace pattern 5*a*. Referring to FIG. 3A, any magnets such as 3*d*, 3*e* and 3*f*, located over the central or mobile portion of the primary listening side 8, of the diaphragm 4 can disrupt the high frequency response of the transducer, as illustrated in curve 102*a* of FIG. 3C. Frequency response curve 102*b* of FIG. 3C shows the present invention having smoother and more extended high frequency response, due to not having any magnets in front of the listening side of the diaphragm. The invention is able to achieve this improvement in response, compared to double-sided devices, with increased output capability comparable to double ended devices, due to the secondary magnets 42*a* and 42*b* (in FIG. 1A) being positioned outside of the vibratable portion 28*b* of diaphragm 14 while magnetically energizing the diaphragm also from the second surface side 32 of diaphragm 14 without having any blockage or interference from magnets in front of the second surface side 32 of diaphragm 14.

Figure 4:
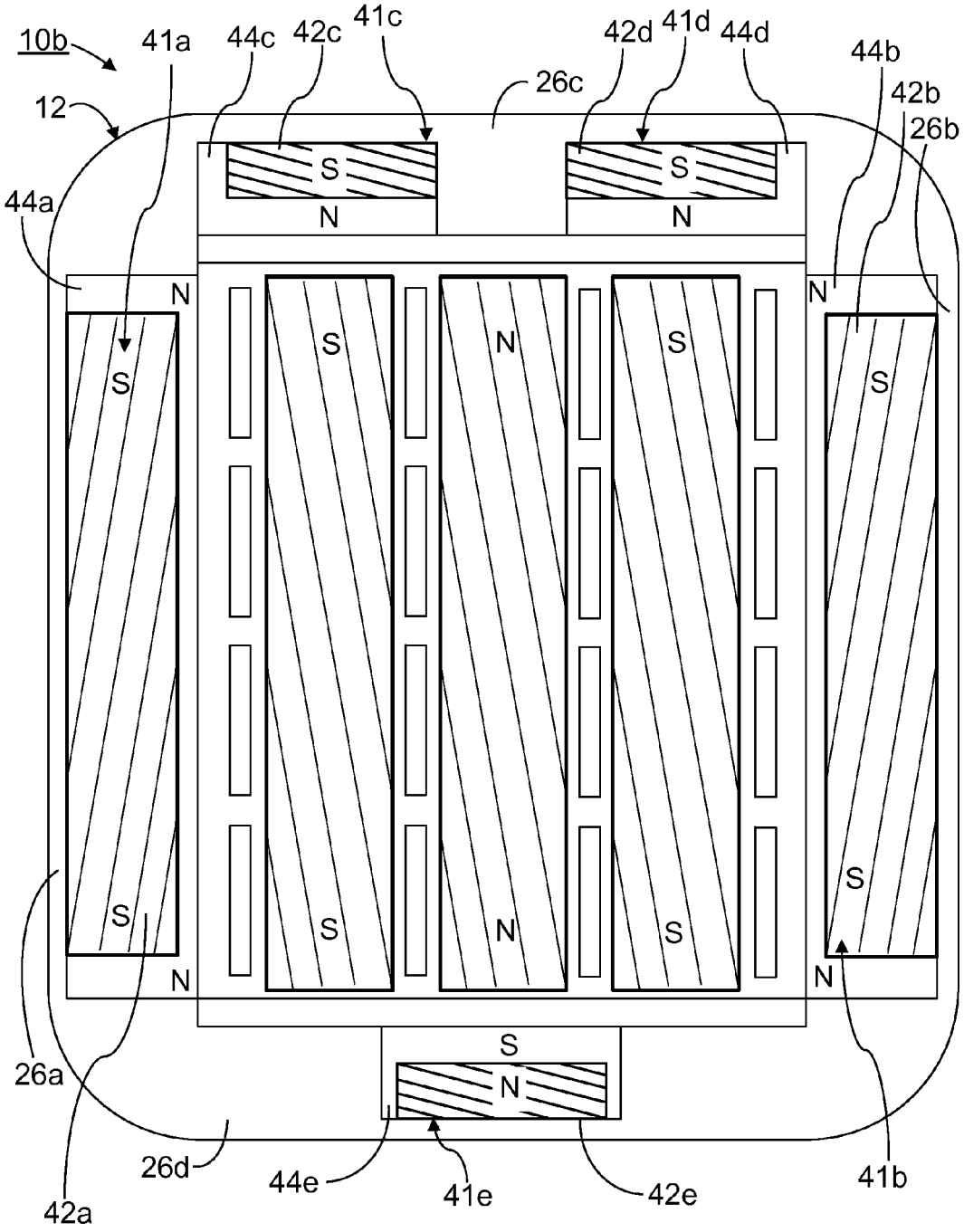
FIG. 4 shows a top plan view of a second example of the invention with a diaphragm removed.

FIG. 4 shows a second example of the invention with a top plan view of the transducer device 10*b* with film diaphragm 14 removed for clarity. FIG. 4 is similar to the example 10*a* of FIG. 1B, but in addition to first and second secondary magnetic structures 41*a* and 41*b*, with secondary magnet rows 42*a* and 42*b* and magnetically conductive pole plates 44*a* and 44*b* of FIG. 1B, additional secondary magnetic structure 41*c*, 41*d*, and 41*e* including magnets 42*c*, 42*d*, and 42*e*, mounted to and magnetically energizing passive magnetically conductive focusing poles 44*c*, 44*d*, and 44*e* mounted to each longitudinal end of frame 12 on flanges 26*c* and 26*d*. These additional secondary magnetic structures provide increased output at each end of the transducer in substantially the same manner as first and second secondary magnetic structures of FIG. 1B the additional magnetics at each end provide additional enhancements to transducer 10*b* output, improving diaphragm control, planar diaphragm drive and increased total output and efficiency by energizing normally undriven end run trace groups, 96*a* and 96*b*, shown on example diaphragm 14 of FIG. 24.

Figure 5A:
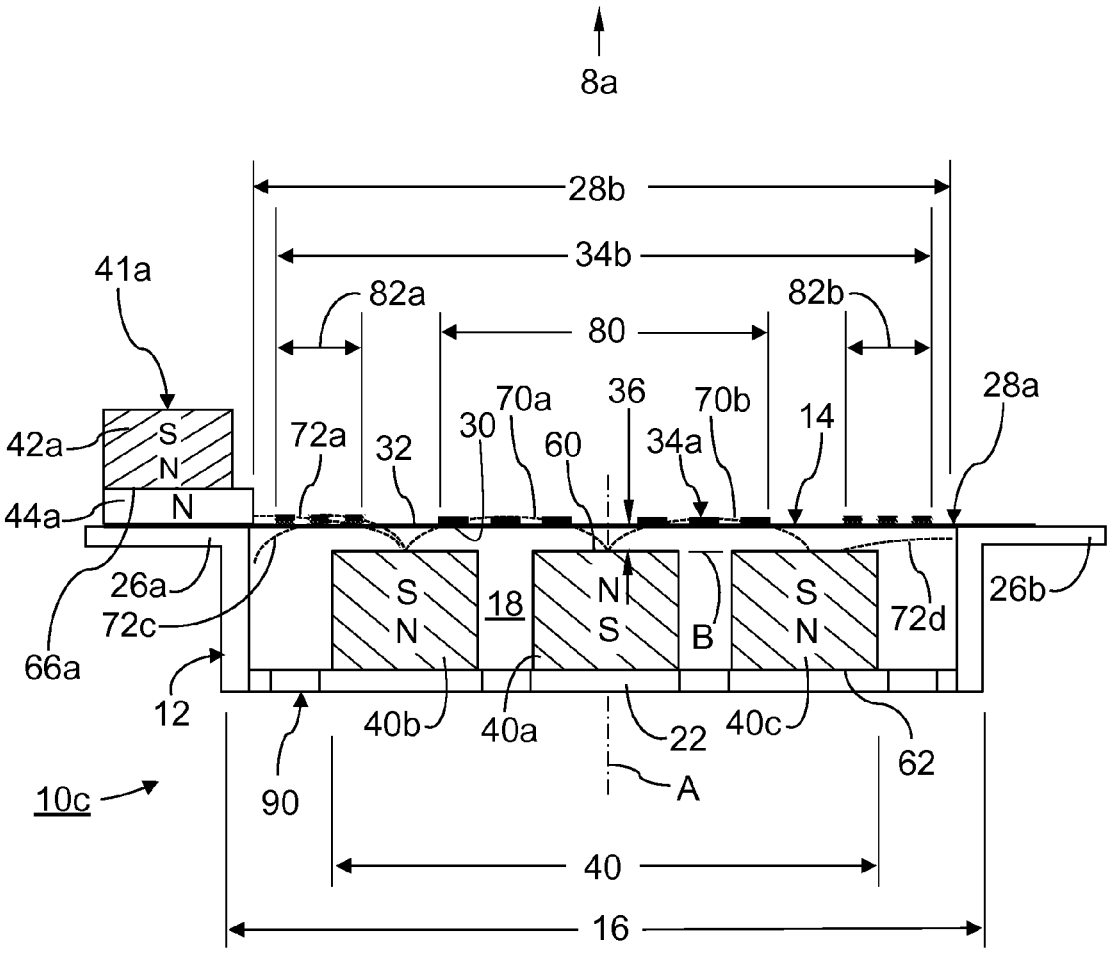
FIG. 5A shows a cross-sectional view of a third example of the invention.
Figure 5B:
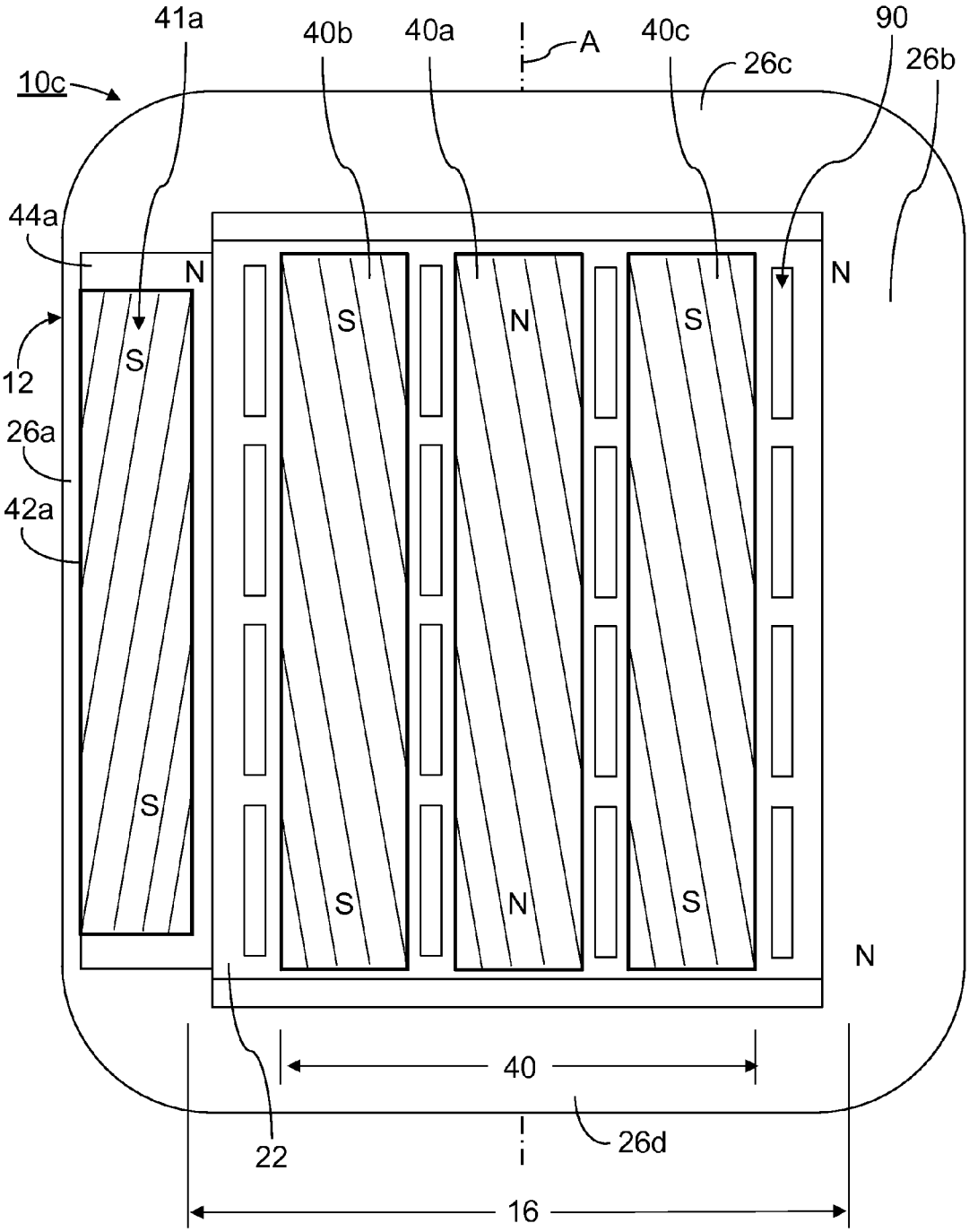
FIG. 5B shows a top plan view of the third example of the invention in FIG. 5A with a diaphragm thereof removed.

Referring to FIG. 5A and FIG. 5B, shown is a third example of the planar-magnetic transducer invention 10*c* for generating an acoustic output based on an electrical signal. FIG. 5B shows the third example 10*c* of the invention with a top plan view of the transducer device 10*c* with film diaphragm 14 removed for clarity. Transducer 10*c* is comprised of support frame 12, and diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* has first and second outermost lateral edges defining a driven portion 34*b* of the diaphragm 14. Primary magnetic structure 16 includes the group of three elongated primary magnet rows 40 coupled to back-plate 22 of the support frame 12.

The elongated primary magnet rows 40*a*, 40*b*, and 40*c* are primarily operable as sources of magnetic fringe fields, 70*a*, 70*b*, interacting with the conductive trace pattern 34*a*, including conductive trace sections 80 and 82*a* and 82*b*. The primary magnet rows 40 are positioned adjacent to, and spaced a predetermined gap distance 36 from, the first surface side 30 of the diaphragm 14.

A secondary magnetic structure 41*a* is positioned on the same lateral side of center plane "A" of transducer 10*c* as flange 26*a* and is mounted on flange 25*a*. The secondary magnetic structure 41*a* includes a magnetically conductive focusing pole 44*a*, which is attached to a North-pole magnetic polarity surface 66*a* of the secondary magnet 42*a*. The secondary magnetic structure 41*a* is mounted to flange 26 of support frame 12 and positioned above a plane of the second surface side 32 of the diaphragm 14 with the secondary magnet 42*a* positioned laterally outside the lateral boundary of the driven portion 34*b* of diaphragm 14 and in this example of the invention, outside of the vibratable portion 28*b* of the diaphragm 14. The magnetic field lines represented by 72*c* are strengthened and elevated closer to the plane of the diaphragm by the secondary magnetic structure 41*a*. The magnetic field line 72*d* is not augmented by a secondary magnetic structure and therefore the stronger lines of magnetic force tend to form below the plane of the diaphragm 14 and outer conductive trace group 82*b*, with conductive trace group 82*b* being driven less than conductive trace group 82*a*. The secondary magnetic structure 41*a* is primarily operable as a focused magnetic source of field 72*a* which interacts with at least a portion of the outer conductive trace group 82*a* of the elongated conductive trace pattern 34*a*, wherein the electrical signal is applied to the conductive trace pattern 34*a* such that the primary magnet rows 40 generating fringe fields 70*a*, 70*b*, and the secondary magnetic structure 41*a* generating focused field 72*a*, cause movement of the conductive trace pattern 34*a* and the diaphragm 14, thereby generating the acoustic output.

The mobility of the diaphragm 14, and the acoustic output, of transducer 10*c*, is skewed to one side as compared to the example of FIGS. 1A and 1B, due to secondary magnet structure, 41*b* of FIG. 1A being removed, leaving only secondary magnetic structure 41*a* in the device of FIG. 5A. This example of the invention provides similar performance advantages as the example in FIG. 1A, but with the additional attribute of increased drive to trace group portion 82*a* relative to that of trace group 82*b* of conductive trace pattern 34*a* on diaphragm 14, biasing the drive force more so in one lateral direction. This offers an additional benefit for applications where asymmetrical dispersion in one direction may be advantageous, such as left and right stereo pairs of loudspeakers or other applications where asymmetrical directivity is useful.

Figure 6:
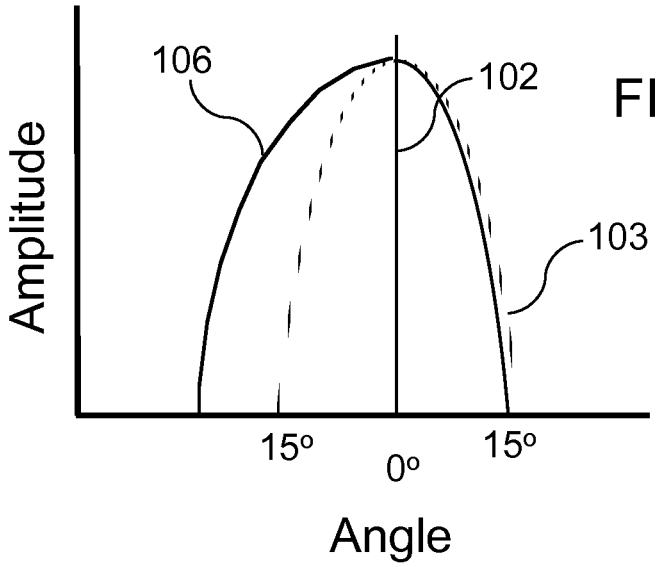
FIG. 6 shows a polar plot of the dispersion of an example of the invention in FIG. 5A.

The dispersion graph of FIG. 6 shows the (dotted line) dispersion 103 of the symmetrical device of FIG. 1A and an example of increased asymmetrical lateral (solid line) dispersion 106 of the asymmetrical transducer 10*c* of FIGS. 5A and 5B.

Figure 7A:
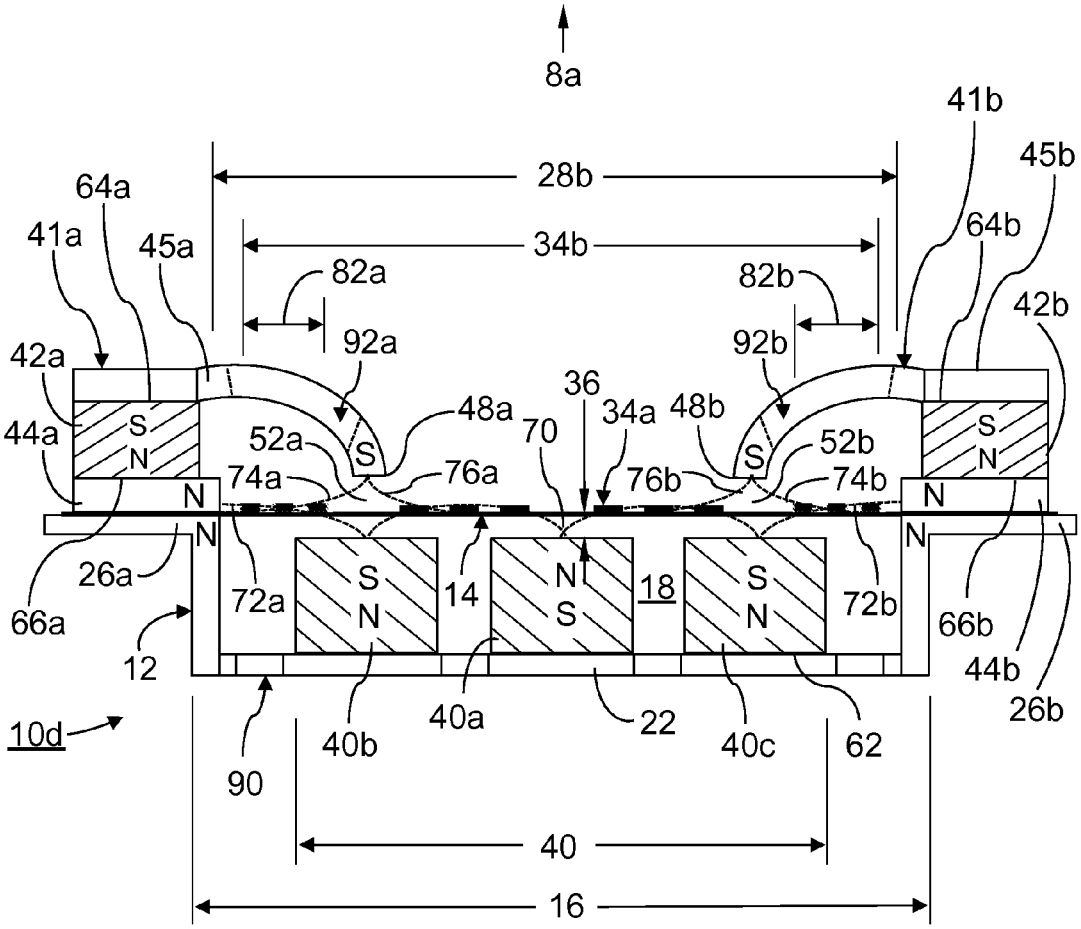
FIG. 7A shows a cross-sectional view of a fourth example of the invention.
Figure 7B:
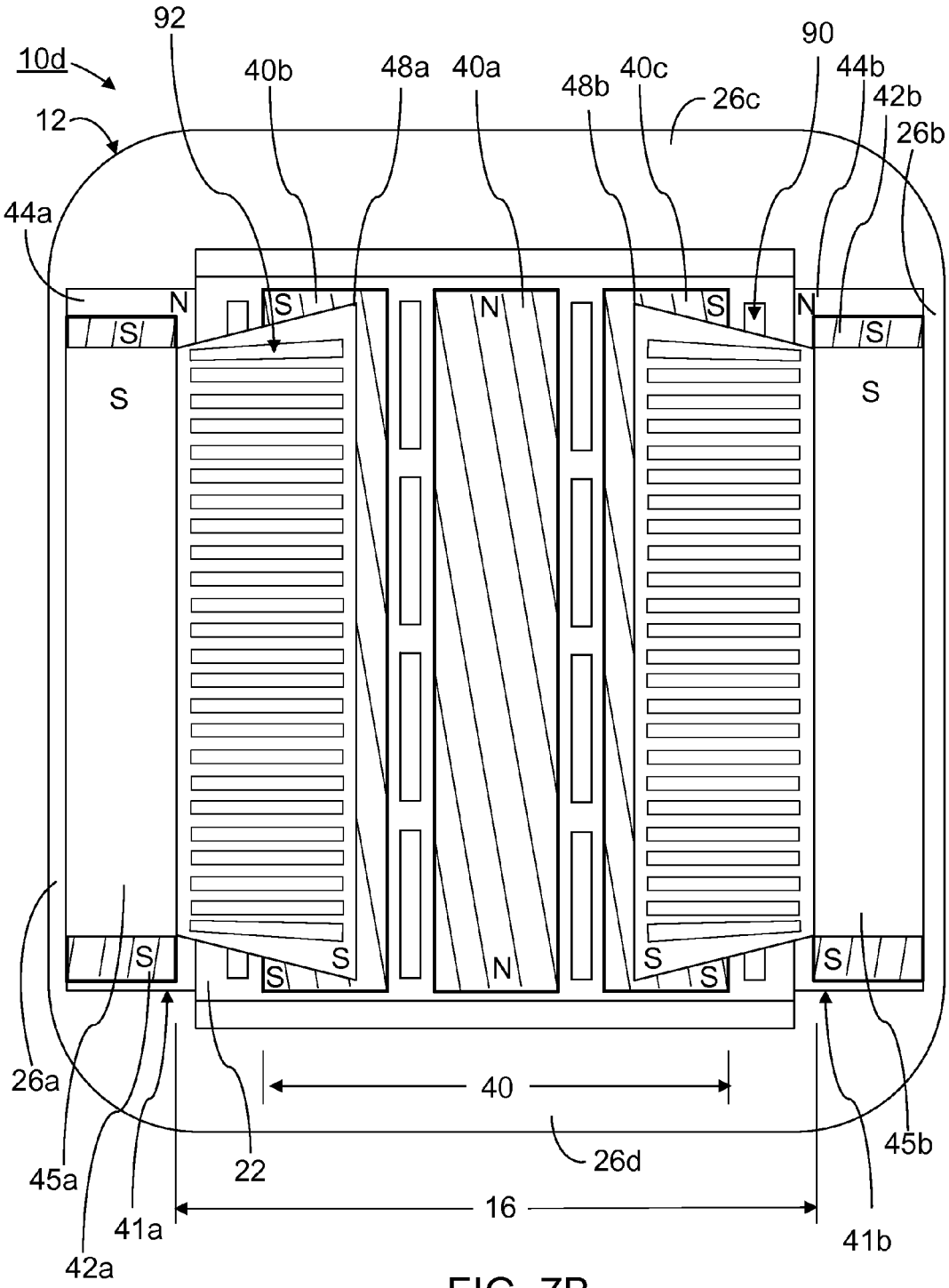
FIG. 7B shows a plan view of the example of the invention of FIG. 7A.

FIG. 7A and FIG. 7B show a fourth example 10*d* of the invention, similar to that of FIG. 1A, 1B, but with secondary extended magnetically conductive focusing pole pieces 45*a* and 45*b* connected to magnetic polarity surfaces 64*a* and 64*b* of secondary magnets 42*a* and 42*b* of secondary magnetic structures 41*a* and 41*b* and extending over diaphragm 14. FIG. 7B shows the fourth example 10*d* of the invention with a top plan view of the transducer device 10*d* with film diaphragm 14 removed for clarity. For the purposes of description clarity, some component numbering will be referred to the drawings in FIGS. 1A and 1B. The fourth example of the planar-magnetic transducer invention 10*d* for generating an acoustic output based on an electrical signal, is comprised of a support frame 12, diaphragm 14, including first surface side 30 (as shown numbered in FIG. 1A), second surface side 32 (as shown numbered in FIG. 1A), and perimeter of attachment 28*a* (as shown numbered in FIG. 1A) attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm has first and second outermost lateral edges of trace group 82*a* and 82*b* defining a driven portion 34*b* of the diaphragm 14. Primary magnetic structure 16 includes the group of three elongated primary magnet rows 40 coupled to back-plate 22 of the support frame 12.

The elongated primary magnet rows 40*a*, 40*b*, and 40*c* are primarily operable as sources of magnetic fringe fields 70*a*, 70*b* interacting with the conductive trace pattern 34*a*. The primary magnet rows are positioned adjacent to, and spaced a predetermined gap distance 36 from, the first surface side 30 of the diaphragm 14. First and second secondary magnetic structures 41*a* and 41*b* are coupled to flanges 26*a* and 26*b* respectively. The secondary magnetic structures 41*a* and 41*b*, include magnetically conductive focusing poles 44*a* and 44*b*, to which the North-pole magnetic polarity surface 66*a* of the secondary magnet 42*a* and the North-pole magnetic polarity surface 66*b* of the secondary magnet 42*b* are respectively attached. The secondary magnetic structures 41*a* and 41*b* are coupled to flanges 26*a* and 26*b* of support frame 12 and are positioned above a plane of the second surface side 32 of the diaphragm 14 with the secondary magnets 42*a* and 42*b* positioned laterally outside of the vibratable portion 28*b* of the diaphragm 14. The focusing poles 44*a* and 44*b*, of secondary magnetic structures 41*a* and 41*b*, are primarily operable as focused magnetic sources which combine with the magnetic fringe fields from primary magnet rows 40*b* and 40*c* to generate maximum field lines 72*a* and 72*b* respectively, which interact with at least portions of the elongated trace groups 82*a* and 82*b* of the conductive trace pattern 34*a*, wherein an electrical audio signal is applied to the conductive trace pattern 34*a* such that the primary magnet row group 40 create fringe field lines 70 and the focusing poles 44*a* and 44*b* of the secondary magnetic structure 41*a* and 41*b* create combine with primary magnet rows 40*b* and 40*c* to create focused field lines 72*a* and 72*b* to cause movement of the conductive trace pattern 34*a* and the diaphragm 14, thereby generating an acoustic output.

The secondary magnetic structure 41*a* includes a secondary extended magnetically conductive focusing pole 45*a* extending over a portion of the second surface side 32 (as numbered in FIG. 1A) of the diaphragm 14, with a magnetically focused termination face 48*a* spaced away from the second surface side 32 of the diaphragm 14 by secondary extended focusing pole gap distance 52*a* which is a similar or equal distance as primary magnet row 40*b* is spaced away from the first surface side 30 (as numbered in FIG. 1A) by distance gap 36 of diaphragm 14 and secondary magnetic structure 41*a* magnetically focused termination face 48*a* is positioned directly across from primary magnet row 40*b*.

Also, the secondary magnetic structure 41*b* includes a second secondary extended magnetically conductive focusing pole 45*b* extending over a portion of the second surface side 32 (as numbered in FIG. 1A) of the diaphragm 14, with a magnetically focused termination face 48*b* spaced away from the second surface side 32 of the diaphragm 14 by a similar or equal distance as primary magnet row 40*c* is spaced away from the first surface side 30 (as numbered in FIG. 1A) of diaphragm 14 and secondary magnetic structure 41*b* magnetically focused termination face 48*b* is positioned directly across from primary magnet row 40*b*.

The magnetically conductive focusing pole termination face 48*a* extending over a portion of the second surface side 32 of the diaphragm 14 and spaced by secondary extended focusing pole gap distance 52*b* has a South polarity and the focusing pole termination face 48*a* is positioned adjacent primary magnet row 40*b* that has a same South magnetic polarity as the focusing pole termination face 48*a*.

The magnetically conductive focusing pole termination face 48*b* extending over a portion of the second surface side 32 of the diaphragm 14 has a South polarity and the focusing pole termination face 48*b* is positioned adjacent primary magnet row 40*c* that has a same South magnetic polarity as the focusing pole termination face 48*b*. The secondary extended magnetically conductive focusing pole 45*a* is attached to a secondary magnetic polarity surface 64*a* farthest from a plane of the diaphragm 14, and the secondary magnetic structure 41*a* secondary extended magnetically conductive focusing pole 45*a* includes openings 92*a* to increase the acoustical transparency of the secondary extended magnetically conductive focusing pole 45*a*.

The second secondary extended magnetically conductive focusing pole 45*b* is attached to a secondary magnetic polarity surface 64*b* farthest from a plane of the diaphragm 14, and the secondary magnetic structure 41*b* second secondary extended magnetically conductive focusing pole 45*b* includes openings 92*b* to increase the acoustical transparency of the second secondary extended magnetically conductive focusing pole 45*b*.

The FIG. 7A, fourth example 10*d* of the invention, is similar to that of FIG. 1A, 1B, with secondary extended magnetically conductive focusing pole pieces 45*a* and 45*b* connected to magnetic polarity surfaces 64*a* and 64*b* of secondary magnets 42*a* and 42*b* of secondary magnetic structures 41*a* and 41*b*. In this example transducer 10*d*, the magnetic polarity surfaces 64*a* and 64*b* are both "South" polarity surfaces. Theses magnetic pole focusing structures are configured with openings 92*a* and 92*b* to maintain acoustical transparency. These openings provide acoustic transparency in primary acoustic output direction 8*a* that is superior to prior art double sided planar magnetic transducers 1*a* of FIG. 3A that have solid magnets 3*d*, 3*e*, and 3*f* and cavities 7*b* adjacent both sides of the diaphragm 4 which disrupt the primary acoustical output 8, as illustrated graphically by curve 102*a* in FIG. 3C. In this example 10*d*, the additional secondary magnetic poles arch over the outermost primary magnet rows 40*b* and 40*c* to create the same polarity adjacent both surface sides of diaphragm 14, increasing the efficiency of transducer 10*d* while maintaining substantial acoustical transparency through secondary extended magnetically conductive focusing pole 45*a* and 45*b* which allows the high frequencies to be smooth and extended, as shown in response 102*b* of the graph of FIG. 3C. The example of FIGS. 7A and 7B can provide even more magnetic efficiency than the example transducer of FIGS. 1A and 1B, while maintaining smooth high frequency response in primary acoustical direction 8.

Figure 8:
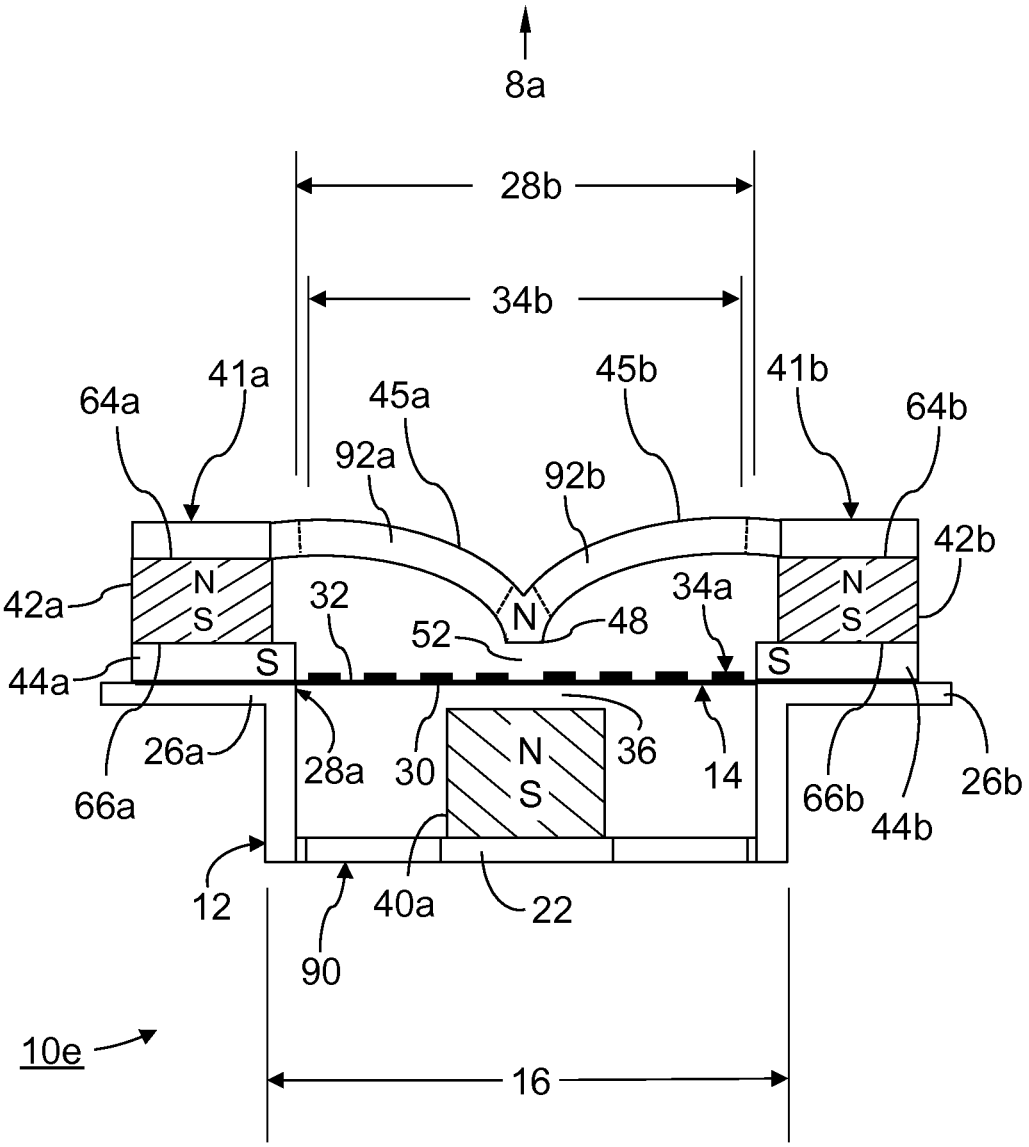
FIG. 8 shows a cross-sectional view of a fifth example of the invention.

FIG. 8 shows a fifth example 10*e* of the invention, similar to that of FIG. 7A, but with the primary magnetic structure 16 comprising one magnet row 40*a*. The fifth example of the planar-magnetic transducer invention 10*e* for generating an acoustic output based on an electrical signal, is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm has first and second outermost lateral edges defining a driven portion 34*b* of the diaphragm 14. Primary magnetic structure 16 includes the primary magnet row 40*a* coupled to backplate 22 of the support frame 12. The elongated primary magnet row 40*a* is primarily operable as a source of magnetic fringe fields interacting with the conductive trace pattern 34*a*. The magnet row 40*a* is positioned adjacent to, and spaced a predetermined gap distance 36 from, the first surface side 30 of the diaphragm 14.

First and second secondary magnetic structures 41*a* and 41*b* are coupled to flanges 26*a* and 26*b* respectively. The secondary magnetic structures 41*a* and 41*b*, include magnetically conductive focusing poles 44*a* and 44*b*, to which the South-pole magnetic polarity surface 66*a* of the secondary magnet 42*a* and the South-pole magnetic polarity surface 66*b* of the secondary magnet 42*b* are respectively attached. The secondary magnetic structures 41*a* and 41*b* are coupled to flanges 26*a* and 26*b* of support frame 12 and are positioned above a plane of the second surface side 32 of the diaphragm 14 with the secondary magnets 42*a* and 42*b* positioned, laterally outside the lateral boundary of the driven portion 34*b* of diaphragm 14 and in this example of the invention, laterally outside of the vibratable portion 28*b* of the diaphragm 14. The focusing poles 44*a* and 44*b*, of secondary magnetic structures 41*a* and 41*b*, are primarily operable as focused magnetic sources which combine with the magnetic fringe fields from primary magnet row 40*a* to maximum magnetic energy which interacting with at least portions of the conductive trace pattern 34*a*.

The secondary magnetic structure 41*a* includes a secondary extended magnetically conductive focusing pole 45*a* extending over a portion of the second surface side 32 of the diaphragm 14, with a magnetically focused termination face 48 spaced away from the second surface side 32 of the diaphragm 14 with a secondary extended focusing pole gap distance 52 by a similar or equal distance as primary magnet row 40*b* is spaced away by gap 36 from the first surface side 30 of diaphragm 14 and secondary magnetic structure 41*a* magnetically focused termination face 48 is positioned directly across from primary magnet row 40*a*.

Also, the secondary magnetic structure 41*b* includes a second secondary extended magnetically conductive focusing pole 45*b* extending over a portion of the second surface side 32 of the diaphragm 14, with a magnetically focused termination face 48 spaced away from the second surface side 32 of the diaphragm 14 by a similar or equal distance as primary magnet row 40*a* is spaced away from the first surface side 30 of diaphragm 14 and secondary magnetic structure 41*b* magnetically focused termination face 48 is positioned directly across from primary magnet row 40*a*. In this example of the inventive transducer secondary extended magnetically conductive focusing poles 45*a* and 45*b* merge into a single magnetically focused termination face 48.

The magnetically conductive focusing pole termination face 48 extending over the central portion of the second surface side 32 of the diaphragm 14 has a North polarity and the focusing pole termination face 48 is positioned adjacent primary magnet row 40*a* that has a same North magnetic polarity as the focusing pole termination face 48.

The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The second secondary extended magnetically conductive focusing pole 45*b* is attached to a secondary magnetic polarity surface 64*b* farthest from a plane of the second surface side 32 of diaphragm 14, and the secondary magnetic structure 41*b* secondary extended magnetically conductive focusing pole 45*b* includes openings 92*b* to increase the acoustical transparency of the second secondary extended magnetically conductive focusing pole 45*b*.

The FIG. 8 fifth example the invention with transducer 10*e* with secondary magnetic structures 41*a* and 41*b* including secondary extended magnetically conductive focusing poles 45*a* and 45*b* either closely spaced or summed as one piece to form a magnetic polarity face 48 adjacent diaphragm 14 that matches the magnetic polarity of magnet row 40*a* that is also adjacent diaphragm 14 on the opposite surface side, in this example, both having a polarity of 'N' or North. In this example of the invention, the magnetic energy can be configured with substantial symmetrical on both sides of the diaphragm, providing a double ended, push-pull planar magnetic transducer, but due to no actual magnets blocking the acoustical output of the diaphragm adjacent the surface side that secondary extended magnetically conductive focusing poles 45*a* and 45*b* reside, secondary extended magnetically conductive focusing poles 45*a* and 45*b* can be made substantially acoustically transparent with openings 92*a* and 92*b* such that the acoustic output in the primary acoustic output direction 8*a* is substantially unimpeded by the secondary extended magnetically conductive focusing pole pieces 45*a* and 45*b*.

Figure 9:
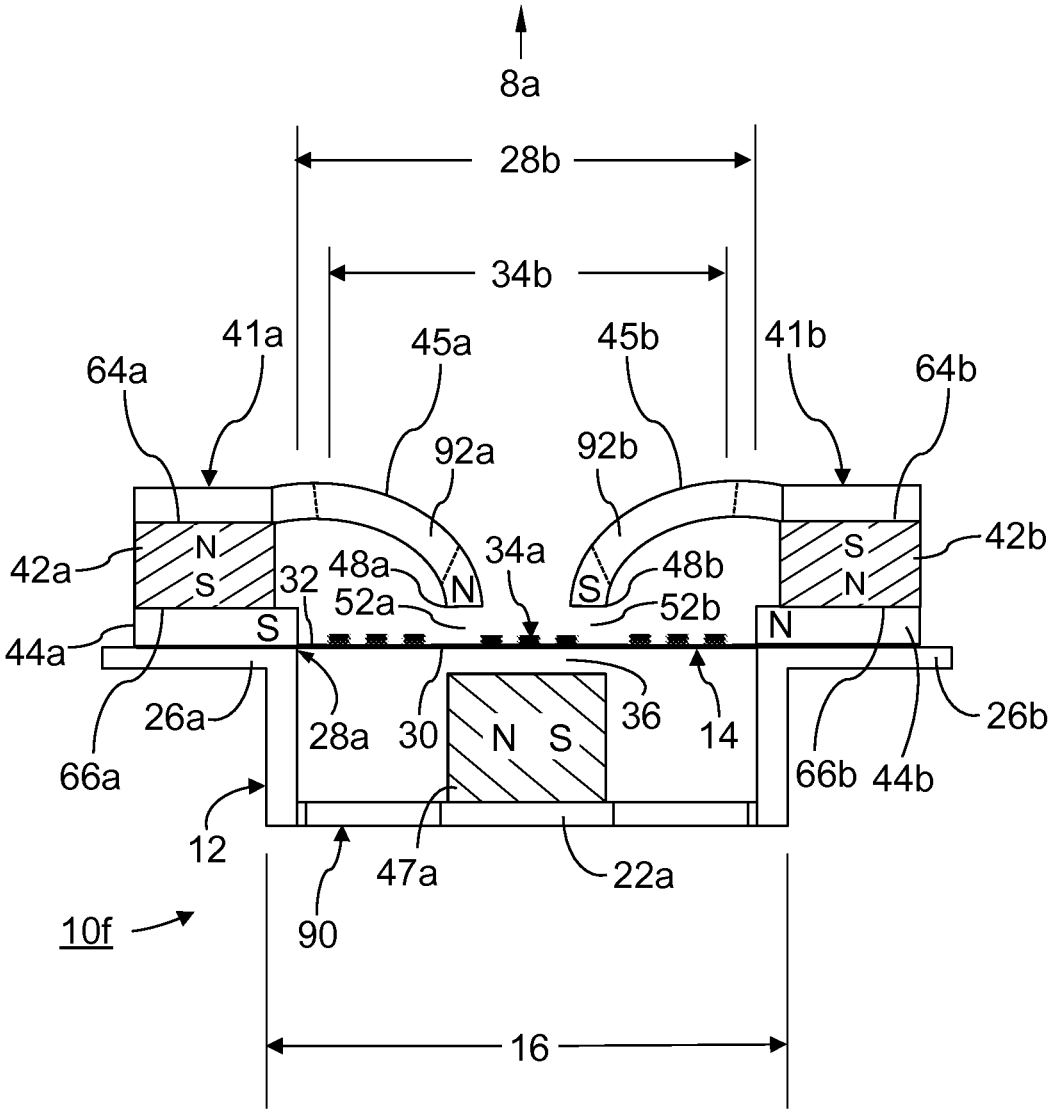
FIG. 9 shows a cross-sectional view of a sixth example of the invention.

FIG. 9 shows a sixth example of the invention with transducer 10*f* that is similar in architecture to the example of FIG. 8, but with the primary magnet row 40*a* of FIG. 8 rotated 90-degrees such that the magnet row 47*a* of FIG. 9 polarities are arranged laterally, parallel to the back plate 22*a*. Because both polarities are in contact with back plate 22*a* it is essential that back plate portion coupled to magnet row 47*a* is made from non-magnetically-conductive material, so as not to short out the magnetic energy of primary magnet 47*a*. This arrangement, with the lateral polarities operates similar to having two primary magnets of North and South poles oriented to be adjacent to the diaphragm. Due to the primary magnet having opposite lateral polarities, the secondary magnet structures 41*a* and 41*b* are also of opposite polarities in relation to each other so that the secondary extended magnetically conductive focusing pole 45*a* with a 'North' polarity termination surface 48*a* positioned adjacent the North polarity portion of the primary magnet 47*a* and second secondary extended magnetically conductive focusing pole 45*b*, with a 'South' polarity termination surface 48*b*, positioned adjacent the 'South' polarity portion of primary magnet 47*a*.

The FIG. 9, sixth example of the planar-magnetic transducer invention 10*f* for generating an acoustic output based on an electrical signal, is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm has first and second outermost lateral edges defining a driven portion 34*b* of the diaphragm 14. Primary magnetic structure 16 includes the primary magnet row 47*a* coupled to non-magnetically conductive back-plate 22*a* of the support frame 12.

The elongated primary magnet row 47*a* is primarily operable as a source of a magnetic fringe field interacting with the conductive trace pattern 34*a*. The magnet row 47*a* is positioned adjacent to, and spaced a predetermined gap distance 36 from, the first surface side 30 of the diaphragm 14.

The first secondary magnetic structure 41*a* is coupled to flange 26*a*. The secondary magnetic structure 41*a* includes magnetically conductive focusing pole 44*a*, to which the South-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the North-pole magnetic polarity surface 66*b* of the secondary magnet 42*b* is attached. The secondary magnetic structures 41*a* and 41*b* that are coupled to flanges 26*a* and 26*b* of support frame 12 are positioned above a plane of the second surface side 32 of the diaphragm 14 with the secondary magnets 42*a* and 42*b* positioned, laterally outside of the vibratable portion 28*b* of the diaphragm 14. The focusing poles 44*a* and 44*b*, of secondary magnetic structures 41*a* and 41*b*, are primarily operable as focused magnetic sources interacting with at least portions of the conductive trace pattern 34*a*.

The secondary magnetic structure 41*a* includes a secondary extended magnetically conductive focusing pole 45*a* extending over a portion of the second surface side 32 of the diaphragm 14 and over a portion of conductive trace pattern 34*a*, with a magnetically focused North polarity termination surface 48*a* spaced away from the second surface side 32 of the diaphragm 14 by secondary extended focusing pole gap distance 52*a* which is a similar or equal distance as primary magnet row 47*a* is spaced away from the first surface side 30 of diaphragm 14 by distance gap 36, and secondary magnetic structure 41*a* magnetically focused termination surface 48*a* with a North magnetic polarity is positioned directly across from the North polarity portion of primary magnet row 47*a*.

Similarly, the secondary magnetic structure 41*b* includes a second secondary extended magnetically conductive focusing pole 45*b* extending over a portion of the second surface side 32 of the diaphragm 14 and over a portion of conductive trace pattern 34*a*, with a magnetically focused South polarity termination surface 48*b* spaced away from the second surface side 32 of the diaphragm 14 by secondary extended focusing pole gap distance 52*b* which is a similar or equal distance as primary magnet row 47*a* is spaced away from the first surface side 30 of diaphragm 14 by distance gap 36 and secondary magnetic structure 41*b* magnetically focused South polarity termination surface 48*b* is positioned directly across from the South polarity portion of primary magnet row 47*a*. The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The second secondary extended magnetically conductive focusing pole 45*b* is attached to a secondary magnetic polarity surface 64*b* farthest from a plane of the second surface side 32 of diaphragm 14, and the secondary magnetic structure 41*b* second secondary extended magnetically conductive focusing pole 45*b* includes openings 92*b* to increase the acoustical transparency of the second secondary extended magnetically conductive focusing pole 45*b* to increase the acoustical transparency of the secondary extended magnetically conductive focusing pole 45*b* in the primary acoustic output direction 8*a*.

In this example of the invention, the magnetic energy can achieve increased symmetry on both sides of the diaphragm, producing increased efficiency of a double ended, push-pull planar magnetic transducer, but due to no actual magnets blocking the acoustical output of the diaphragm adjacent the surface side that secondary extended magnetically conductive focusing poles 45*a* and 45*b* reside, secondary extended magnetically conductive focusing pole 45*a* and 45*b* can be made substantially acoustically transparent with openings 92*a* and 92*b* such that the acoustic output in the primary acoustic output direction 8*a* is substantially unimpeded by the secondary extended magnetically conductive focusing poles 45*a* and 45*b*.

Figure 10:
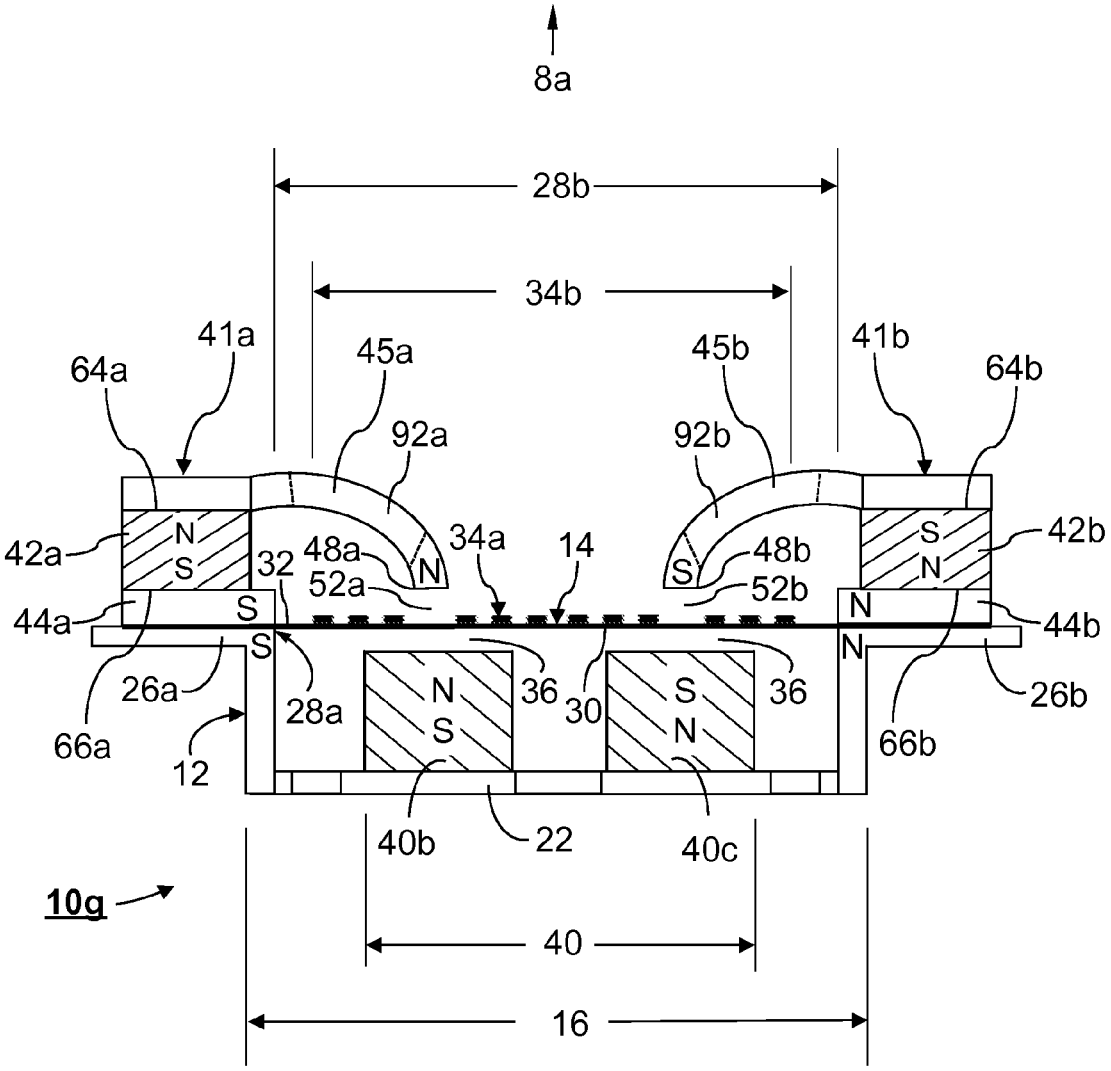
FIG. 10 shows a cross-sectional view of a seventh example of the invention.

FIG. 10 shows a seventh example 10*g* of the invention, similar to that of FIG. 9, but with the primary magnetic structure 16 comprising two magnet rows 40*b* and 40*c*. The Seventh example of the planar-magnetic transducer invention 10*g* for generating an acoustic output based on an electrical signal, is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm has first and second outermost lateral edges defining a driven portion 34*b* of the diaphragm 14. Primary magnetic structure 16 includes primary magnet array 40, including the primary magnet rows 40*b* and 40*c* coupled to, preferably magnetically conductive, back-plate 22 of the support frame 12. The elongated primary magnet rows 40*b* and 40*c* are primarily operable as a source of magnetic fringe fields interacting with the conductive trace pattern 34*a*. The magnet rows 40*b* and 40*c* are positioned adjacent to, and spaced a predetermined gap distance 36 from, the first surface side 30 of the diaphragm 14.

The first secondary magnetic structure 41*a* is coupled to flange 26*a*. The secondary magnetic structure 41*a* includes magnetically conductive focusing pole 44*a*, to which the South-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the North-pole magnetic polarity surface 66*b* of the secondary magnet 42*b* is attached. The secondary magnetic structures 41*a* and 41*b* are coupled to flanges 26*a* and 26*b* of support frame 12 and are positioned above a plane of the second surface side 32 of the diaphragm 14 with the secondary magnets 42*a* and 42*b* positioned, laterally outside the lateral boundary of the driven portion 34*b* of diaphragm 14 and in this example of the invention, laterally outside of the vibratable portion 28*b* of the diaphragm 14. The focusing poles 44*a* and 44*b*, of secondary magnetic structures 41*a* and 41 *b*, are primarily operable as focused magnetic sources which combine with the magnetic fringe fields from primary magnet rows 40*b* and 40*c* to maximum magnetic energy which interacting with at least portions of the conductive trace pattern 34*a*.

The secondary magnetic structure 41*a* includes a secondary extended magnetically conductive focusing pole 45*a* extending over a portion of the second surface side 32 of the diaphragm 14, with a polarity termination surface 48*a* spaced away from the second surface side 32 of the diaphragm 14 by secondary extended focusing pole gap distance 52*a*, which is a similar or equal distance as primary magnet row 40*b* is spaced away from the first surface side 30 of diaphragm 14 by distance gap 36 and secondary magnetic structure 41*a* magnetically focused termination surface 48*a* is positioned directly across from primary magnet row 40*b*.

Also, the secondary magnetic structure 41*b* includes a second secondary extended magnetically conductive focusing pole 45*b* extending over a portion of the second surface side 32 of the diaphragm 14, with a polarity termination surface 48*b* spaced away from the second surface side 32 of the diaphragm 14 by a secondary extended focusing pole gap distance 52*b*, a similar or equal distance as primary magnet row 40*c* is spaced away from the first surface side 30 of diaphragm 14 by distance gap 36, and secondary magnetic structure 41*b* polarity termination surface 48*b* is positioned directly across from primary magnet row 40*c*.

The polarity termination surface 48*a* extending over the second surface side 32 of the diaphragm 14 has a "North" magnetic polarity and the polarity termination surface 48*a* is positioned across from primary magnet row 40*b* that has a same "North" magnetic polarity as the polarity termination surface 48*a*.

The polarity termination surface 48*b* extending over the second surface side 32 of the diaphragm 14 has a "South" magnetic polarity and the polarity termination surface 48*b* is positioned across from primary magnet row 40*c* that has a same "South" magnetic polarity as the polarity termination surface 48*b*.

The secondary extended magnetically conductive focusing pole 45*a* is attached to a secondary magnetic polarity surface

64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The second secondary extended magnetically conductive focusing pole 45*b* is attached to a secondary magnetic polarity surface 64*b* farthest from a plane of the second surface side 32 of diaphragm 14, and the secondary magnetic structure 41*b* secondary extended magnetically conductive focusing pole 45*b* includes openings 92*b* to increase the acoustical transparency of the second secondary extended magnetically conductive focusing pole 45*b* in the primary acoustic output direction 8*a*.

The transducer 10*g* with secondary magnetic structure 41*a* including secondary extended magnetically conductive focusing pole 45*a* form a polarity termination surface 48*a* adjacent the second surface side 32 of diaphragm 14 that matches the magnetic polarity of magnet row 40*b* that is also adjacent diaphragm 14 on the opposite surface side, in this example, both having a polarity of 'N' or "North". Transducer 10*g* also includes secondary magnetic structure 41*b* including a second secondary extended magnetically conductive focusing pole 45*b* form a polarity termination surface 48*b* adjacent the second surface side 32 of diaphragm 14 that matches the magnetic polarity of magnet row 40*c* that is also adjacent diaphragm 14 on the opposite surface side, in this example, both having a polarity of 'S' or "South".

In this example of the invention, the magnetic energy can be configured with increased symmetrically adjacent both sides 30 and 32 of the diaphragm 14, having increased double sided drive efficiency while exhibiting substantial acoustical transparency with openings 92*a* and 92*b* such that the acoustic output in the primary acoustic output direction 8*a* is substantially unimpeded by the secondary extended magnetically conductive focusing poles 45*a* and 45*b*.

Figure 11:
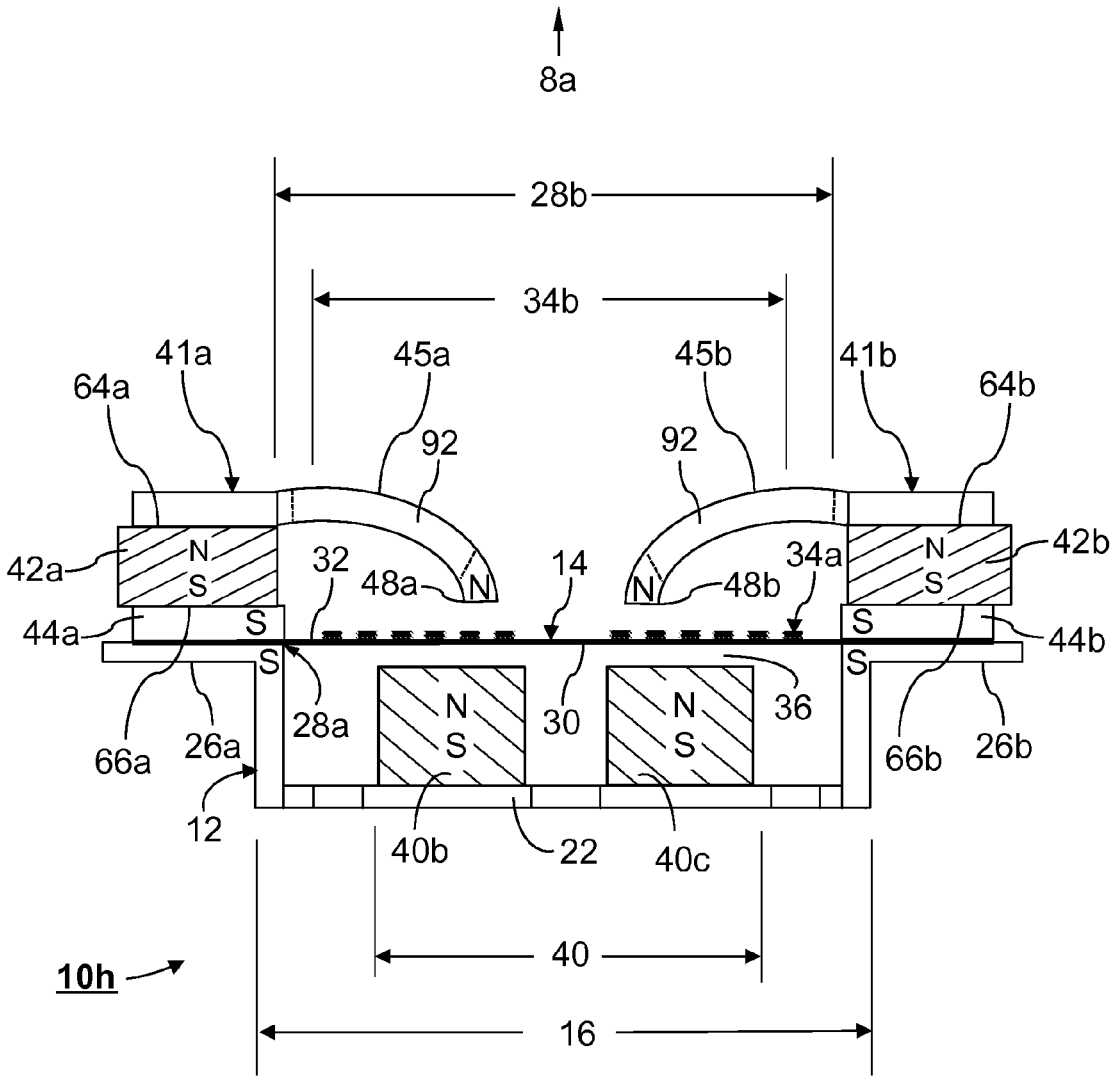
FIG. 11 shows a cross-sectional view of an eighth example of the invention.

FIG. 11 shows an eighth example of the invention with transducer 10*h*, similar to the transducer 10*g* of FIG. 10 but instead opposite magnet polarities on the left and right lateral sides of the transducer 10*g*, the transducer 10*h* of FIG. 11 uses two primary magnet rows, 40*b* and 40*c* of common polarity orientation and the same polarity orientation laterally across the transducer for magnets and focusing pole pieces. The arrangement of the primary magnet rows 40*b* and 40*c* being of the same magnetic polarity orientation can strengthen and broaden the fringe fields of magnet rows 40*b* and 40*c* in their relationship to conductive trace pattern 34*a* further enhancing drive force and acoustical output efficiency of the transducer.

The FIG. 11, eighth example of the planar-magnetic transducer invention 10*h* is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 40*b* and 40*c* of a common polarity orientation, coupled to, back-plate 22 of the support frame 12. The elongated primary magnet rows 40*b* and 40*c* are primarily operable as a source of magnetic fringe fields interacting with the conductive trace pattern 34*a*. The magnet rows 40*b* and 40*c* are positioned adjacent to, and spaced a predetermined gap distance 36 from, the first surface side 30 of the diaphragm 14.

The first secondary magnetic structure 41*a* is coupled to flange 26*a*. The secondary magnetic structure 41*a* includes magnetically conductive focusing pole 44*a*, to which the South-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the South-pole magnetic polarity surface 66*b* of the secondary magnet 42*b* is attached.

The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14.

The focusing poles 44*a* and 44*b*, of secondary magnetic structures 41*a* and 41*b*, are primarily operable as focused magnetic sources which combine with the magnetic fringe fields from primary magnet rows 40*b* and 40*c* to maximum magnetic energy which interacting with at least portions of the conductive trace pattern 34*a*. The secondary magnetic structure 41*a* includes a secondary extended magnetically conductive focusing pole 45*a* extending over a portion of the second surface side 32 of the diaphragm 14, with a polarity termination surface 48*a* spaced away from the second surface side 32 of the diaphragm 14 by a similar or equal distance as primary magnet row 40*b* is spaced away from the first surface side 30 of diaphragm 14 by gap 36 and secondary magnetic structure 41*a* polarity termination surface 48*a* is positioned directly across from primary magnet row 40*b*.

Also, the secondary magnetic structure 41*b* includes a second secondary extended magnetically conductive focusing pole 45*b* extending over a portion of the second surface side 32 of the diaphragm 14, with a polarity termination surface 48*b* spaced away from the second surface side 32 of the diaphragm 14 by a similar or equal distance as primary magnet row 40*c* is spaced away from the first surface side 30 of diaphragm 14 by distance gap 36, and secondary magnetic structure 41*b* polarity termination surface 48*b* is positioned directly across from primary magnet row 40*c*.

The polarity termination surface 48*a* extending over the vibratable portion 28*b* of second surface side 32 of the diaphragm 14 has a 'North' magnetic polarity and the polarity termination surface 48*a* is positioned across from primary magnet row 40*b* that has a same 'North' magnetic polarity as the polarity termination surface 48*a*. The polarity termination surface 48*b* extending over the second surface side 32 of the diaphragm 14 has a 'North' magnetic polarity and the polarity termination surface 48*b* is positioned across from primary magnet row 40*c* that has a same 'North' magnetic polarity as the polarity termination surface 48*b*. The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*.

The second secondary extended magnetically conductive focusing pole 45*b* is attached to a secondary magnetic polarity surface 64*b* farthest from a plane of the second surface side 32 of diaphragm 14, and the secondary magnetic structure 41*b* second secondary extended magnetically conductive focusing pole 45*b* includes openings 92*b* to increase the acoustical transparency of the second secondary extended magnetically conductive focusing pole 45*b* in the primary acoustic output direction 8*a*.

The transducer 10*h* with secondary magnetic structure 41*a* including secondary extended magnetically conductive focusing pole 45*a* form a polarity termination surface 48*a* adjacent the second surface side 32 of diaphragm 14 that matches the magnetic polarity of magnet row 40*b* that is also adjacent diaphragm 14 on the opposite, first surface side 30, in this example, both having a polarity of 'N' or North. Transducer 10*h* also includes secondary magnetic structure 41*b* including second secondary extended magnetically conductive focusing pole 45*b* form a polarity termination surface 48*b* adjacent the second surface side 32 of diaphragm 14 that matches the magnetic polarity of magnet row 40*c* that is also adjacent diaphragm 14 on the opposite surface side 30, in this example both having a polarity of 'N' or North.

In this example 10*h* of the invention, the magnetic energy can be configured with increased symmetry adjacent both sides 30 and 32 of the diaphragm 14, having increased double sided drive efficiency while exhibiting acoustical transparency through openings 92*a* and 92*b* such that the acoustic output in the primary acoustic output direction 8*a* is substantially unimpeded by the secondary extended magnetically conductive focusing poles 45*a* and 45*b*.

Figure 12:
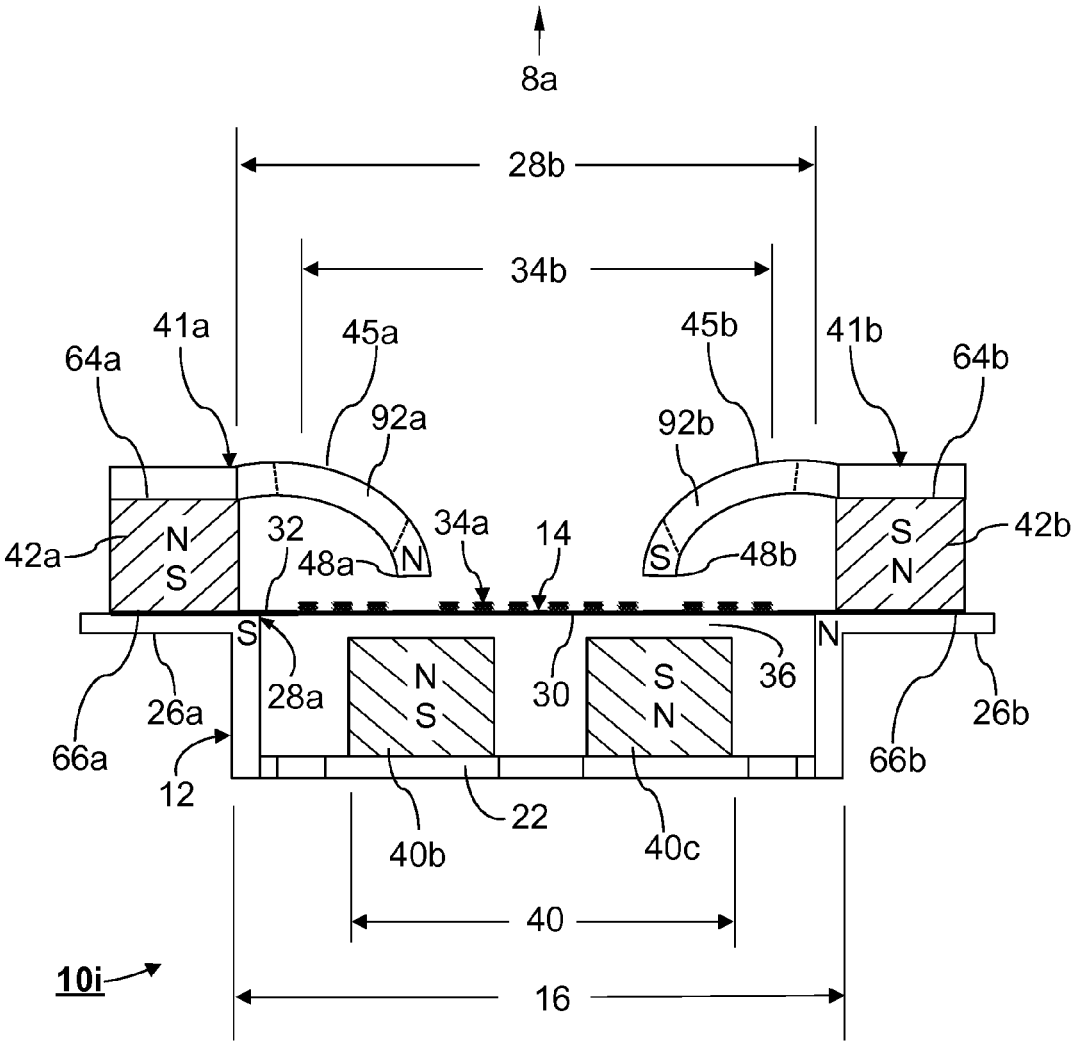
FIG. 12 shows a cross-sectional view of a ninth example of the invention.

FIG. 12 shows a ninth example of the invention with transducer 10*i* that is substantially the same as that shown in FIG. 10, but without the magnetically conductive pole pieces 44*a* and 44*b* of secondary magnetic structures 41*a* and 41*b* of FIG. 10, now having the coupling secondary magnets 42*a* and 42*b* more directly with flanges 26*a* and 26*b*. The FIG. 12, ninth example of the planar-magnetic transducer invention 10*i* is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 40*b* and 40*c* coupled to, back-plate 22 of the support frame 12. The elongated primary magnet rows 40*b* and 40*c* are primarily operable as a source of magnetic fringe fields interacting with the conductive trace pattern 34*a*. The magnet rows 40*b* and 40*c* are positioned adjacent to, and spaced a predetermined gap distance 36 from, the first surface side 30 of the diaphragm 14.

The first secondary magnetic structure 41*a* is coupled to flange 26*a*. The secondary magnetic structure 41*a* includes the secondary magnet row 42*a* of which the South-pole magnetic polarity surface 66*a* of the secondary magnet 42*a* is coupled to flange 26*a*. The second secondary magnetic structure 41*b* is coupled to flange 26*b*. The secondary magnetic structure 41*b* includes the secondary magnet row 42*b* of which the North-pole magnetic polarity surface 66*b* of the secondary magnet 42*b* is coupled to flange 26*b*. The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14. The secondary magnetic structure 41*a* includes a secondary extended magnetically conductive focusing pole 45*a* extending over a portion of the second surface side 32 of the diaphragm 14, with a polarity termination surface 48*a* spaced away from the second surface side 32 of the diaphragm 14 by a similar or equal distance as primary magnet row 40*b* is spaced away from the first surface side 30 of diaphragm 14 by gap distance 36, and secondary magnetic structure 41*a* polarity termination surface 48*a* is positioned directly across from primary magnet row 40*b*.

Also, the secondary magnetic structure 41*b* includes a second secondary extended magnetically conductive focusing pole 45*b* extending over a portion of the second surface side 32 of the diaphragm 14, with a polarity termination surface 48*b* spaced away from the second surface side 32 of the diaphragm 14 by a similar or equal distance as primary magnet row 40*c* is spaced away from the first surface side 30 of diaphragm 14 by gap distance 36, and secondary magnetic structure 41*b* polarity termination surface 48*b* is positioned directly across from primary magnet row 40*c*.

The polarity termination surface 48*a* extending over the second surface side 32 of the diaphragm 14 has a 'North' magnetic polarity and the polarity termination surface 48*a* is positioned across from primary magnet row 40*b* that has a same 'North' magnetic polarity as the polarity termination surface 48*a*. The polarity termination surface 48*b* extending over the second surface side 32 of the diaphragm 14 has a 'South' magnetic polarity and the polarity termination surface 48*b* is positioned across from primary magnet row 40*c* that has a same 'South' magnetic polarity as the polarity termination surface 48*b*. The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The second secondary extended magnetically conductive focusing pole 45*b* is attached to a secondary magnetic polarity surface 64*b* farthest from a plane of the second surface side 32 of diaphragm 14, and the secondary magnetic structure 41*b* second secondary extended magnetically conductive focusing pole 45*b* includes openings 92*b* to increase the acoustical transparency of the secondary extended magnetically conductive focusing pole 45*b* in the primary acoustic output direction 8*a*.

The transducer 10*i* with secondary magnetic structure 41*a* including secondary extended magnetically conductive focusing pole 45*a* form polarity termination surface 48*a* adjacent the second surface side 32 of diaphragm 14 that matches the magnetic polarity of magnet row 40*b* that is also adjacent diaphragm 14 on the opposite surface side, in this example, both having a polarity of 'N' or 'North'. Transducer 10*i* also includes secondary magnetic structure 41*b* including second secondary extended magnetically conductive focusing pole 45*b* form a polarity termination surface 48*b* adjacent the second surface side 32 of diaphragm 14 that matches the magnetic polarity of magnet row 40*c* that is also adjacent diaphragm 14 on the opposite surface side, in this example, both having a polarity of 'S or 'South'. In this example of the invention, the magnetic energy can be configured with increased symmetry adjacent both sides 30 and 32 of the diaphragm 14, having increased double sided drive efficiency while exhibiting substantial acoustical transparency with openings 92*a* and 92*b* such that the acoustic output in the primary acoustic output direction 8*a* is substantially unimpeded by the secondary extended magnetically conductive focusing poles 45*a* and 45*b*.

Figure 13:
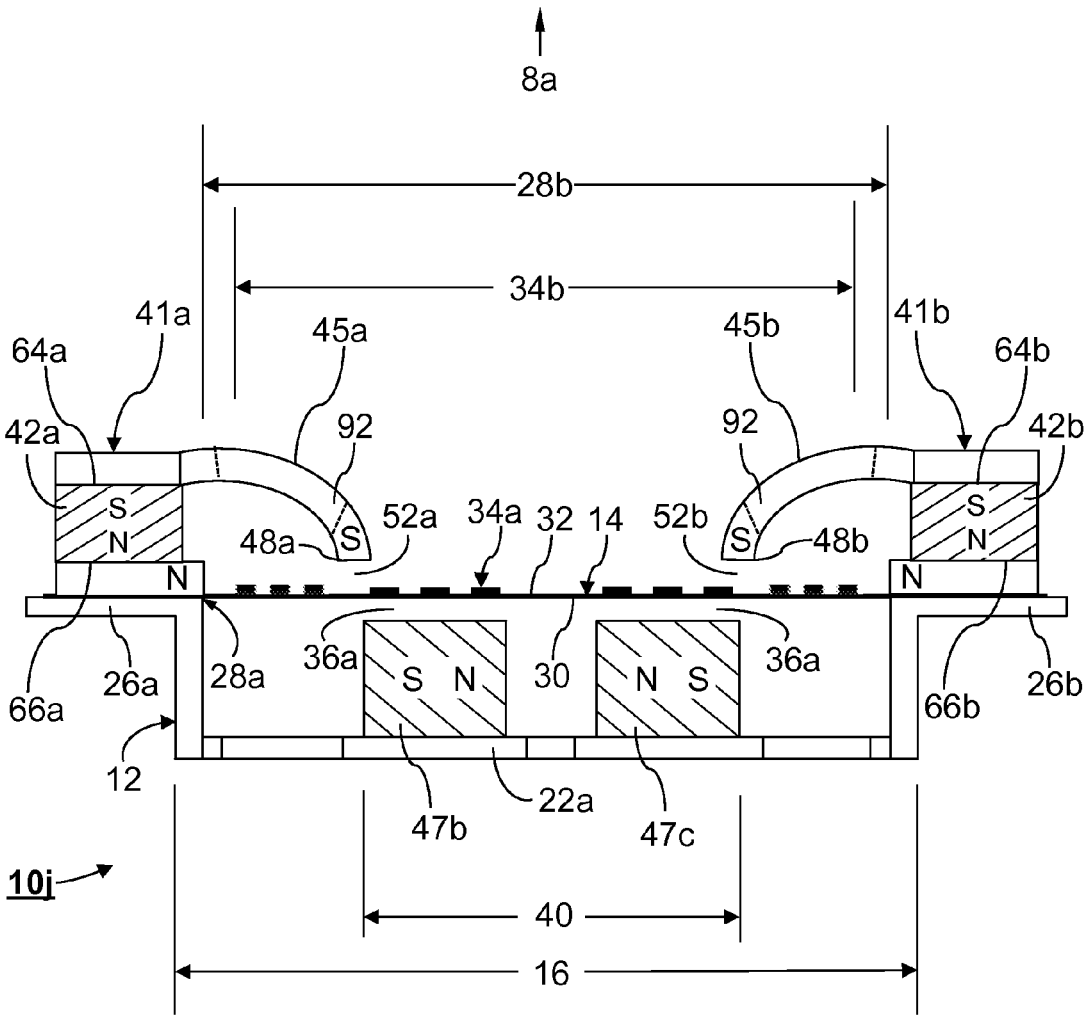
FIG. 13 shows a cross-sectional view of a tenth example of the invention.

FIG. 13 shows a tenth example of the invention with transducer 10*j* including primary magnets 47*b* and 47*c* oriented with a 90-degree rotation and laterally oriented polarities similar to the transducer of FIG. 9, but with two primary magnet rows instead of one. As with the device of FIG. 9 it is important that the back plate 22*a* is not a magnetically conductive material. Also, with the lateral orientation of the magnets it is important that the like polarities face each other, as in this case the "north" poles of magnet rows 47*b* and 47*c* face each other. This makes for a symmetrical magnetic layout laterally with secondary magnetic structures 41*a* and 41*b* being of the same polarity.

The tenth example of the planar-magnetic transducer invention 10*j* is comprised of a support frame 12, diaphragm 14, including first surface side 30, second surface side 32, and perimeter portion of the diaphragm 28*a* is supported by, and attached to, the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 47*b* and 47*c* of a common polarity orientation, coupled to non-magnetically conductive back-plate 22*a* of the support frame 12.

The elongated primary magnet rows 47*b* and 47*c* are primarily operable as a source of magnetic fringe fields interacting with the conductive trace pattern 34*a*. The magnet rows 47*b* and 47*c* are positioned adjacent to, and spaced a predetermined gap distance 36*a* from, the first surface side 30 of the diaphragm 14.

A first secondary magnetic structure 41*a* is coupled to flange 26*a*. The secondary magnetic structure 41*a* includes magnetically conductive focusing pole 44*a*, to which the North-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the North-pole magnetic polarity surface 66*b* of the secondary magnet 42*b* is attached. The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14.

The focusing poles 44*a* and 44*b*, of secondary magnetic structures 41*a* and 41*b*, are primarily operable as focused magnetic sources which combine with the magnetic fringe fields from primary magnet rows 47*b* and 47*c* to maximum magnetic energy which interacting with at least portions of the conductive trace pattern 34*a*. The secondary magnetic structure 41*a* includes a secondary extended magnetically conductive focusing pole 45*a* extending over a portion of the second surface side 32 of the diaphragm 14, with a magnetically focused polarity termination surface 48*a* spaced away from the second surface side 32 of the diaphragm 14 by secondary extended focusing pole gap distance 52*a* which is a similar or equal distance as primary magnet row 47*b* is spaced away from the first surface side 30 of diaphragm 14 by distance gap 36*a* and secondary magnetic structure 41*a* magnetically focused polarity termination surface 48*a* is positioned directly across from the 'South' polarity portion of primary magnet row 40*b*.

Also, the secondary magnetic structure 41*b* includes a second secondary extended magnetically conductive focusing pole 45*b* extending over a portion of the second surface side 32 of the diaphragm 14, with a magnetically focused polarity termination surface 48*b* spaced away from the second surface side 32 of the diaphragm 14 by secondary extended focusing pole gap distance 52*b*, a similar or equal distance as primary magnet row 47*c* is spaced away from the first surface side 30 of diaphragm 14 by gap distance 36*a*, and secondary magnetic structure 41*b* magnetically focused polarity termination surface 48*b* is positioned directly across from a 'South' polarity portion of primary magnet row 47*c*.

The polarity termination surface 48*a* extending over the second surface side 32 of the diaphragm 14 has a 'South' magnetic polarity and the polarity termination surface 48*a* is positioned across from the portion of primary magnet row 47*b* that has a same 'South' magnetic polarity as the polarity termination surface 48*a*. The polarity termination surface 48*b* extending over the second surface side 32 of the diaphragm 14 has a 'South' magnetic polarity and the polarity termination surface 48*b* is positioned across from the portion of the primary magnet row 47*c* that has a same 'South' magnetic polarity as the polarity termination surface 48*b*. The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The second secondary extended magnetically conductive focusing pole 45*b* is attached to a secondary magnetic polarity surface 64*b* farthest from a plane of the second surface side 32 of diaphragm 14, and the secondary magnetic structure 41*b* second secondary extended magnetically conductive focusing pole 45*b* includes openings 92*b* to increase the acoustical transparency of the second secondary extended magnetically conductive focusing pole 45*b* in the primary acoustic output direction 8*a*.

The transducer 10*j* with secondary magnetic structure 41*a* including secondary extended magnetically conductive focusing pole 45*a* form a polarity termination surface 48*a* adjacent the second surface side 32 of diaphragm 14 that matches the magnetic polarity of a portion of the magnet row 47*b* that is also adjacent diaphragm 14 on the opposite surface side, in this example, both having a polarity of 'S" or 'South'. Transducer 10*j* also includes secondary magnetic structure 41*b*, including secondary extended magnetically conductive focusing pole 45*b*, forming a polarity termination surface 48*b* adjacent the second surface side 32 of diaphragm 14 that matches the magnetic polarity of magnet row 47*c* that is also adjacent diaphragm 14 on the opposite surface side, in this example, both having a polarity of 'S' or South.

In this example of the invention, the magnetic energy can be configured with increased symmetry adjacent both sides 30 and 32 of the diaphragm 14, having increased double sided drive efficiency while exhibiting substantial acoustical transparency with openings 92*a* and 92*b* such that the acoustic output in the primary acoustic output direction 8*a* is substantially unimpeded by the secondary extended magnetically conductive focusing poles 45*a* and 45*b*.

Figure 14:
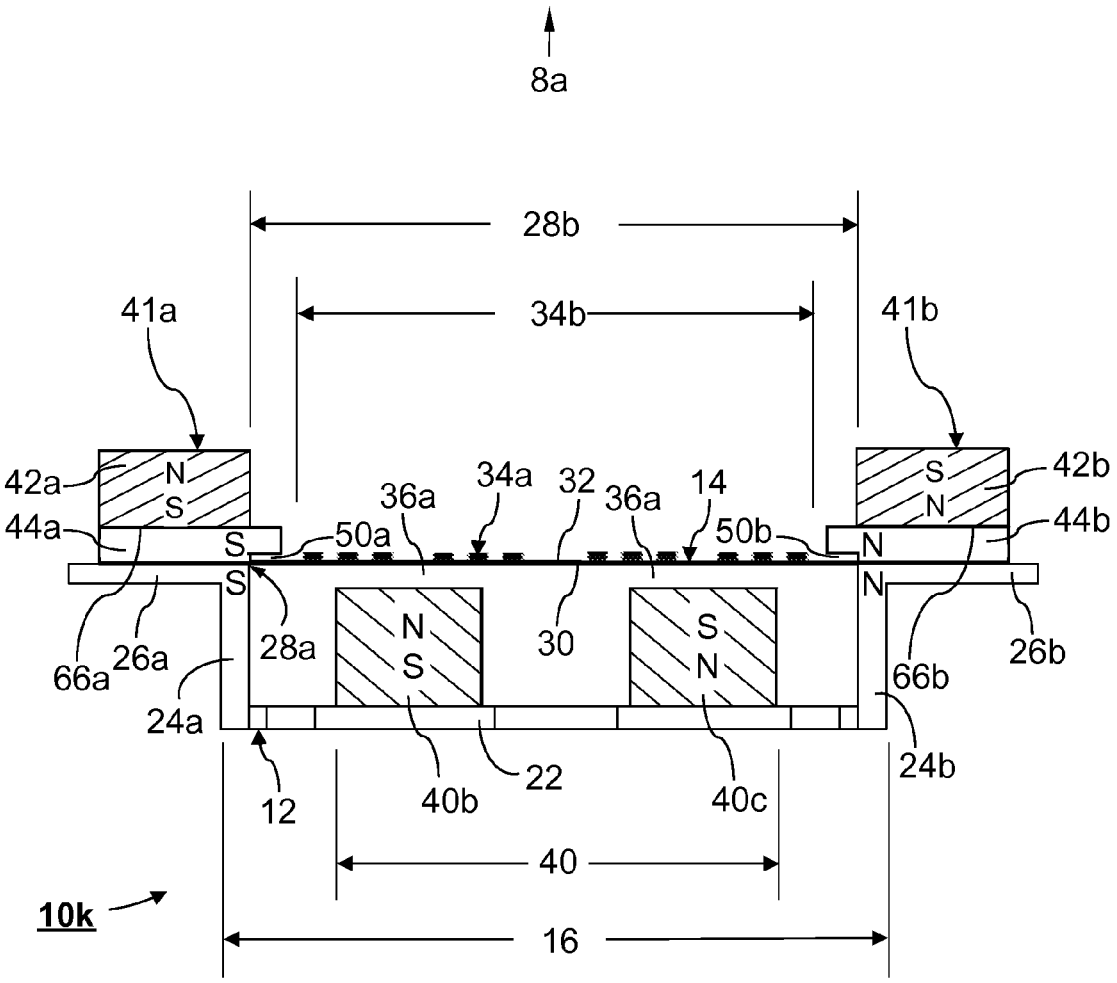
FIG. 14 shows a cross-sectional view of an eleventh example of the invention.

An eleventh example of the invention 10*k* shown in FIG. 14, is similar to the device of FIG. 10 with two main differences. First, the secondary extended magnetically conductive focusing pole pieces 45*a* and 45*b* have been removed from the secondary magnetic structures 41*a* and 41*b*, and secondly, the secondary focusing poles 44*a* and 44*b* of transducer 10*a* of FIG. 14 have been shaped to be extended slightly over diaphragm 14 without touching diaphragm 14 due to elevation the formation of clearance cavity gaps 50*a* and 50*b*. This allows the focusing plates 44*a* and 44*b* to get closer to, and more precisely focus their magnetic fields through, the conductive traces 34 on diaphragm 14 while providing increased mobility of diaphragm 14 near the perimeter of attachment 28*a*. This approach to focusing plates 44*a* and 44*b* could be incorporated in most of the disclosed examples of the invention. Additionally, as an option to promote acoustic transparency, acoustic energy emitted from diaphragm 14 in an a primary acoustic direction 8*a* can be enhanced by creating selective openings in the focusing plates 44*a* and 44*b*, as illustrated in a cut-away plan view of this eleventh example of the inventive transducer openings 93 in FIG. 23.

The eleventh example 10*k* of the planar-magnetic transducer invention is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 40*b* and 40*c* of a common polarity orientation, coupled to, back-plate 22 of the support frame 12. The elongated primary magnet rows 40*b* and 40*c* are primarily operable as a source of magnetic fringe fields interacting with the conductive trace pattern 34*a*. The magnet rows 40*b* and 40*c* are positioned adjacent to, and spaced a predetermined gap distance 36*a* from, the first surface side 30 of the diaphragm 14.

The first secondary magnetic structure 41*a* is coupled to flange 26*a*. The secondary magnetic structure 41*a* includes magnetically conductive focusing pole 44*a*, to which the South-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the North-pole magnetic polarity surface 66*b* of the secondary magnet 42*b* is attached.

The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14. The focusing poles 44*a* and 44*b*, of secondary magnetic structures 41*a* and 41*b*, are primarily operable as focused magnetic sources which combine with the magnetic fringe fields from primary magnet rows 40*b* and 40*c* to maximum magnetic energy which interacting with at least portions of the conductive trace pattern 34*a*.

As another aspect of the planar magnetic transducer 10*k* of FIG. 14, the secondary magnetic structure 41*a* is positioned at a first lateral sidewall 24*a* of the transducer device, the secondary magnetic structure 41*a* includes the secondary magnet 42*a* with the secondary magnet 42*a* having a first magnetic polarity surface 66*a*, where a magnetically conductive focusing pole 44*a* is attached to the first magnetic polarity surface 66*a* of the at least one secondary magnet 42*a*. The primary magnet row 40*b* closest to the first lateral sidewall 24*a* of the support frame 12 has a primary magnetic polarity surface coupled to the magnetically conductive back-plate 22 and the primary magnetic polarity surface has an 'S' or 'South' primary magnetic polarity. The magnetically conductive backplate 22 is magnetically coupled through the magnetically conductive sidewall 24*a* to the magnetically conductive secondary focusing pole 44*a* of the secondary magnet structure 41*a*. The first magnetic polarity surface 66*a* of the secondary magnet 42*a* has a secondary magnetic polarity 'S' or 'South' such that the primary magnetic polarity and the first secondary magnetic polarity are the same 'S' or 'South' magnetic polarity.

The secondary magnetic structure 41*b* is positioned at a second lateral sidewall 24*b* of the transducer device, the secondary magnetic structure 41*b* includes the secondary magnet 42*b* with the secondary magnet 42*b* having a first magnetic polarity surface 66*b*, where a magnetically conductive focusing pole 44*b* is attached to the first magnetic polarity surface 66*b* of the at least one secondary magnet 42*b*. The primary magnet row 40*c* closest to the second lateral sidewall 24*b* of the support frame 12 has a primary magnetic polarity surface coupled to the magnetically conductive back-plate 22 and the primary magnetic polarity surface has an 'N' or 'North' primary magnetic polarity. The magnetically conductive backplate 22 is magnetically coupled through the magnetically conductive sidewall 24*b* to the magnetically conductive secondary focusing pole 44*b* of the secondary magnet structure 41*b*. The first magnetic polarity surface 66*b* of the secondary magnet 42*b* has a secondary magnetic polarity 'N' or 'North' such that the primary magnetic polarity and the first secondary magnetic polarity are the same 'N' or 'North' magnetic polarity.

This example of the invention 10*k* has increased double sided drive efficiency while exhibiting substantial acoustic transparency such that the acoustic output in the primary acoustic output direction 8*a* is unimpeded.

Figure 15:
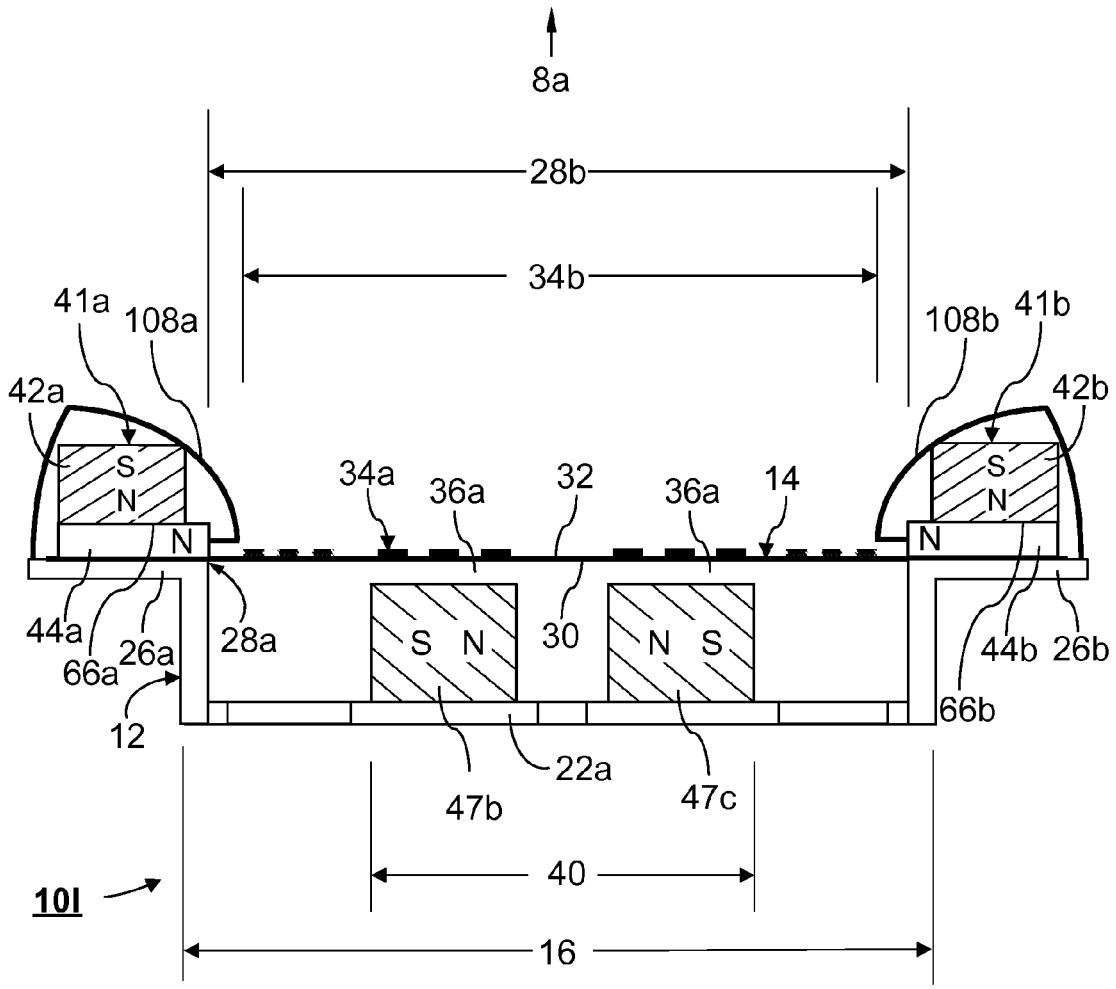
FIG. 15 shows a cross-sectional view of a twelfth example of the invention.

Transducer 10*l*, a twelfth example of the invention shown in FIG. 15, is similar to the device of FIG. 13 except for two main differences. First, the secondary extended magnetically conductive focusing pole pieces 45*a* and 45*b* have been removed from the secondary magnetic structures 41*a* and 41*b*, and acoustic waveguides 108*a* and 108*b* have been added. The acoustic waveguides can create a smoother surface for acoustic wave fronts to form against as they are generated by transducer 10*l* to minimize diffraction and tailor the acoustic output in the primary acoustic propagation direction 8*a*. The waveguides can take on a number of forms and sizes depending on the bandwidth of the transducer and the desired acoustical effect. In most cases, the waveguides are preferably constructed of non-magnetically-conductive materials.

The twelfth example of the planar-magnetic transducer invention 10*l* is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 47*b* and 47*c* which are polarity rotated 90-degrees and are of an opposing polarity orientation, having North and South polarity portions coupled to non-magnetically conductive back-plate 22*a* of the support frame 12. The elongated primary magnet rows 47*b* and 47*c* are primarily operable as a source of magnetic fringe fields interacting with the conductive trace pattern 34*a*. The magnet rows 47*b* and 47*c* are positioned adjacent to, and spaced a predetermined gap distance 36*a* from, the first surface side 30 of the diaphragm 14.

A first secondary magnetic structure 41*a* is coupled to flange 26*a*. The secondary magnetic structure 41*a* includes magnetically conductive focusing pole 44*a*, to which the North-pole magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the 'North-pole' magnetic polarity surface 66*b* of the secondary magnet 42*b* is attached. The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14.

The focusing poles 44*a* and 44*b*, of secondary magnetic structures 41*a* and 41*b*, are primarily operable as focused magnetic sources which combine with the magnetic fringe fields from primary magnet rows 47*b* and 47*c* to maximum magnetic energy which interacting with at least portions of the conductive trace pattern 34*a*.

This example of the invention 10*l* has increased double sided drive efficiency while exhibiting substantial acoustic transparency such that the acoustic output in the primary acoustic output direction 8*a* is unimpeded.

Figure 16:
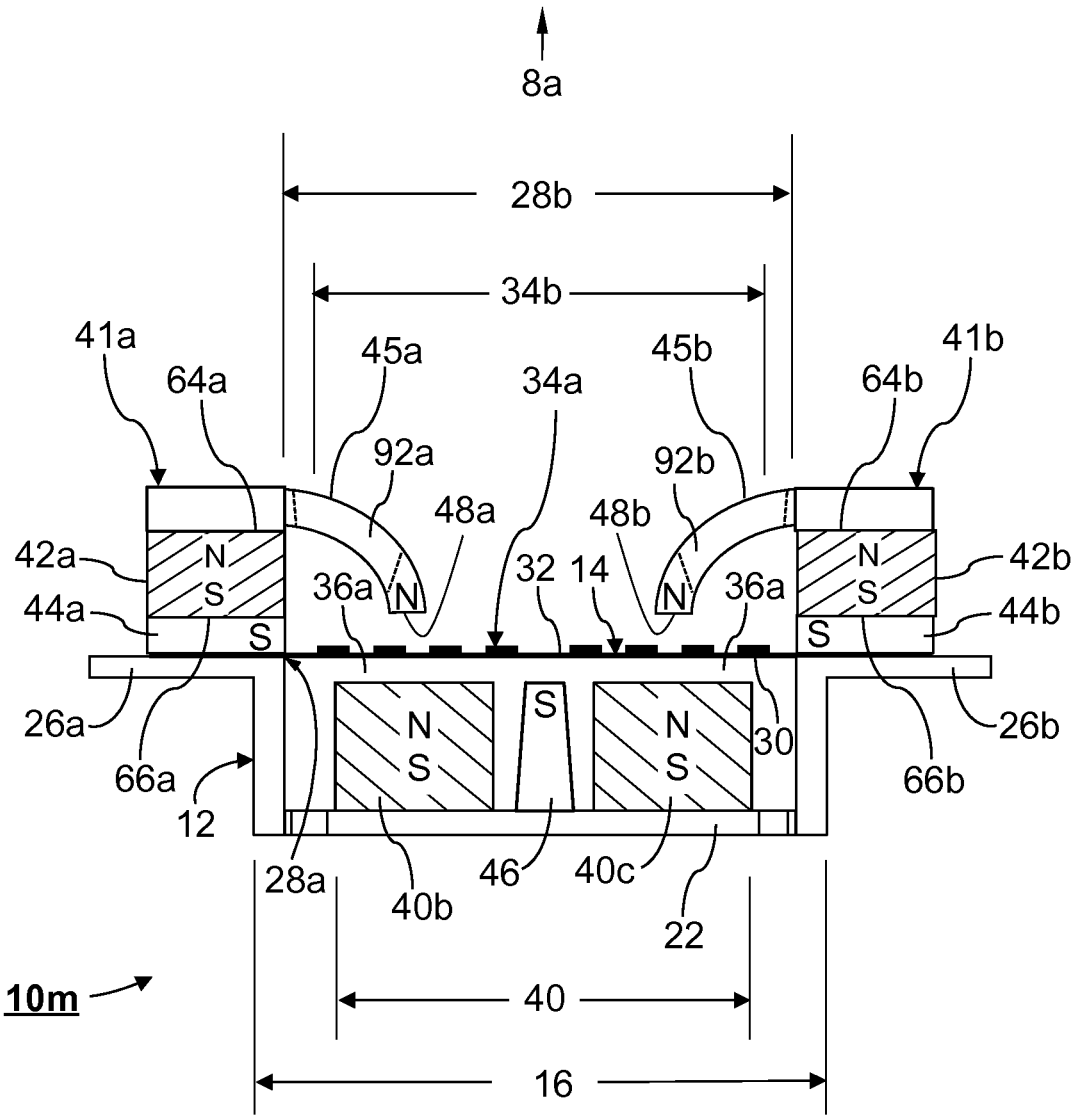
FIG. 16 shows a cross-sectional view of a thirteenth example of the invention.

Transducer 10*m* of a thirteenth example of the invention shown in FIG. 16 is structurally similar to the device of FIG. 11 except for the added magnetically conductive passive return pole 16, which derives its "S" South polarity magnetic energy from primary magnets 40*b* and 40*c* through magnetically conductive back plate 22 due to both primary magnets having the same "South" magnetic polarity orientation relative to back plate 22.

The FIG. 16, thirteenth example of the planar-magnetic transducer invention 10*m* is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 40*b* and 40*c* of a common polarity orientation, coupled to, back-plate 22 of the support frame 12 and further including passive magnetically conductive return pole row 46. The elongated primary magnet rows 40*b* and 40*c*, and passive magnetically conductive return pole row 46, are primarily operable as a source of magnetic fringe fields interacting with the conductive trace pattern 34*a*. The magnet rows 40*b* and 40*c* are positioned adjacent to, and spaced a predetermined gap distance 36*a* from, the first surface side 30 of the diaphragm 14. Passive magnetically conductive return pole row 46 preferably has the same gap distance 36*a* of magnet rows 40*b* and 40*c*, but in certain cases may be slightly more or slightly less.

The first secondary magnetic structure 41*a* is coupled to flange 26*a*. The secondary magnetic structure 41*a* includes magnetically conductive focusing pole 44*a*, to which the 'South-pole' magnetic polarity surface 66*a* of the secondary magnet 42*a* is attached. The second secondary magnetic structure 41*b* is coupled to flange 26*b*. The secondary magnetic structure 41*b* includes magnetically conductive focusing pole 44*b*, to which the South-pole magnetic polarity surface 66*b* of the secondary magnet 42*b* is attached. The secondary magnetic structures 41*a* and 41*b* are coupled to flanges 26*a* and 26*b* respectively of support frame 12 and are positioned above a plane of the second surface side 32 of the diaphragm 14 with the secondary magnets 42*a* and 42*b* positioned, laterally outside of the vibratable portion 28*b* of the diaphragm 14. The magnetically conductive focusing poles 44*a* and 44*b*, of secondary magnetic structures 41*a* and 41*b*, are primarily operable as focused magnetic sources which combine with the magnetic fringe fields from primary magnet rows 40*b* and 40*c* to maximum magnetic energy which interacting with at least portions of the conductive trace pattern 34*a*.

The secondary magnetic structure 41*a* includes a secondary extended magnetically conductive focusing pole 45*a* extending over a portion of the second surface side 32 of the diaphragm 14, with a magnetically focused polarity termination surface 48*a* spaced away from the second surface side 32 of the diaphragm 14 by a similar or equal gap distance as primary magnet row 40*b* gap distance 36*a* is spaced away from the first surface side 30 of diaphragm 14 and secondary magnetic structure 41*a* magnetically focused polarity termination surface 48*a* is positioned directly across from primary magnet row 40*b*. Also, the secondary magnetic structure 41*b* includes a second secondary extended magnetically conductive focusing pole 45*b* extending over a portion of the second surface side 32 of the diaphragm 14, with a magnetically focused polarity termination surface 48*b* spaced away from the second surface side 32 of the diaphragm 14 by a similar or equal distance as primary magnet row 40*c* is spaced away from the first surface side 30 of diaphragm 14 with distance gap 36*a* and secondary magnetic structure 41*b* magnetically focused polarity termination surface 48*b* is positioned directly across from primary magnet row 40*c*.

The polarity termination surface 48*a* extending over the second surface side 32 of the diaphragm 14 has a 'North' N' magnetic polarity and the polarity termination surface 48*a* is positioned across from primary magnet row 40*b* that has a same 'North' 'N' magnetic polarity as the polarity termination surface 48*a*. The polarity termination surface 48*b* extending over the second surface side 32 of the diaphragm 14 has a 'North' N' magnetic polarity and the polarity termination surface 48*b* is positioned across from primary magnet row 40*c* that has a same 'North' N' magnetic polarity as the polarity termination surface 48*b*. The secondary extended magnetically conductive focusing pole 45*a* is attached to a secondary magnetic polarity surface 64*a* farthest from a plane of the second surface side 32 of diaphragm 14, and the secondary magnetic structure 41*a* secondary extended magnetically conductive focusing pole 45*a* includes openings 92*a* to increase the acoustical transparency of the secondary extended magnetically conductive focusing pole 45*a* in the primary acoustic output direction 8*a*. The secondary extended magnetically conductive focusing pole 45*b* is attached to a secondary magnetic polarity surface 64*b* farthest from a plane of the second surface side 32 of diaphragm 14, and the secondary magnetic structure 41*b* secondary extended magnetically conductive focusing pole 45*b* includes openings 92*b* to increase the acoustical transparency of the secondary extended magnetically conductive focusing pole 45*b* in the primary acoustic output direction 8*a*.

The transducer 10*m* with secondary magnetic structure 41*a* including secondary extended magnetically conductive focusing pole 45*a* form a polarity termination surface 48*a* adjacent the second surface side 32 of diaphragm 14 that matches the magnetic polarity of magnet row 40*b* that is also adjacent diaphragm 14 on the opposite surface side 30, in this example, both having a polarity of 'N' or North.

Transducer 10*m* also includes secondary magnetic structure 41*b* including second secondary extended magnetically conductive focusing pole 45*b* form a polarity termination surface 48*b* adjacent the second surface side 32 of diaphragm 14 that matches the magnetic polarity of magnet row 40*c* that is also adjacent diaphragm 14 on the opposite surface side 30, in this example, both having a polarity of 'N' or North.

As another aspect of planar magnetic transducer 10*m* of FIG. 16, the primary magnetic structure 16 includes at least two primary magnet rows 40*b* and 40*c*, and at least one passive magnetically conductive return pole row 46 coupled to the backplate 22 of the support frame 12. The passive magnetically conductive return pole row 46 is positioned between, and in parallel with, the two primary magnet rows 40*b* and 40*c*, and spaced a predetermined distance 36*a* from, the first surface side 30 of the vibratable portion 28*b* of diaphragm 12.

In this example of the invention, the magnetic energy can be configured with increased symmetry adjacent both sides 30 and 32 of the diaphragm 14, having increased double sided drive efficiency while exhibiting acoustical transparency with openings 92*a* and 92*b* such that the acoustic output in the primary acoustic output direction 8*a* is substantially unimpeded by the secondary extended magnetically conductive focusing poles 45*a* and 45*b*.

Figure 17:
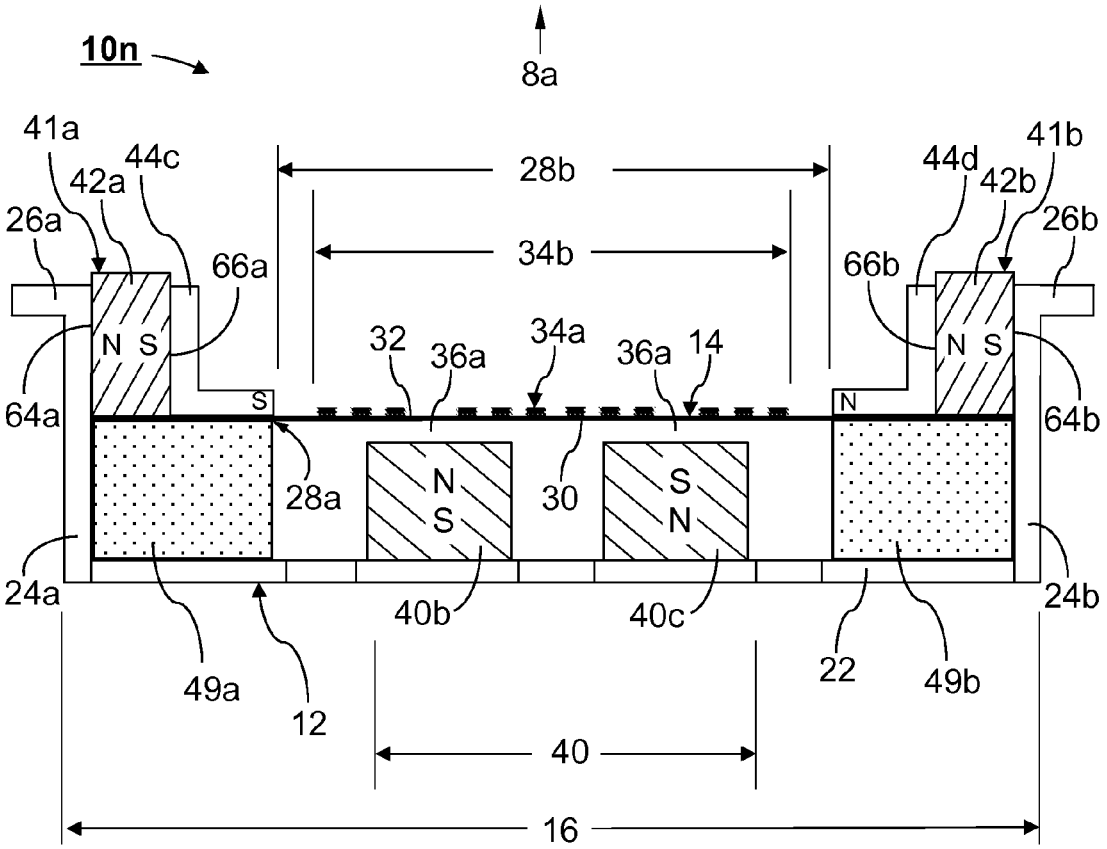
FIG. 17 shows a cross-sectional view of a fourteenth example of the invention.

FIG. 17 shows the fourteenth example 10*n* of the planar-magnetic transducer invention which is comprised of a support frame 12, diaphragm 14, including first surface side 30, second surface side 32, and perimeter of attachment 28*a* attached to the support frame 12. The perimeter of attachment 28*a* encompasses the vibratable portion 28*b* of the diaphragm 14 and the vibratable portion 28*b* of the diaphragm 14 is held in a predetermined state of tension. In other words, a perimeter portion of diaphragm 14 is supported by support frame 12 such that a vibratable portion 28*b* of the diaphragm is held in a predetermined state of tension.

A conductive trace pattern 34*a* is formed on the diaphragm 14 and arranged to receive an electrical input signal. Conductive trace pattern 34*a* distributed across the diaphragm 14 has first and second outermost lateral edges defining a driven portion 34*b* of the diaphragm 14. Primary magnetic structure 16 includes primary magnet array 40, including the primary magnet rows 40*b* and 40*c* coupled to back-plate 22 of the support frame 12. The elongated primary magnet rows 40*b* and 40*c* are primarily operable as a source of magnetic fringe fields interacting with the conductive trace pattern 34*a*. The magnet rows 40*b* and 40*c* are positioned adjacent to, and spaced a predetermined gap distance 36*a* from, the first surface side 30 of the diaphragm 14.

The first secondary magnetic structure 41*a* is coupled to flange 26*a* and sidewall 24*a* of support frame 12. The secondary magnetic structure 41*a* includes magnetically conductive focusing pole 44*c*, to which the 'South-pole' magnetic polarity surface 66*a* of the secondary magnet 42*a* is attached. The second secondary magnetic structure 41*b* is coupled to flange 26*b* and sidewall 24*b* of support frame 12. The secondary magnetic structure 41*b* includes magnetically conductive focusing pole 44*d*, to which the 'North-pole' magnetic polarity surface 66*b* of the secondary magnet 42*b* is attached. The secondary magnetic structures 41*a* and 41*b* coupled to flanges 26*a* and 26*b* and sidewalls 24*a* and 24*b* respectively of support frame 12, are positioned above a plane of the second surface side 32 of the diaphragm 14 with the secondary magnets 42*a* and 42*b* positioned, laterally outside of the vibratable portion 28*b* of the diaphragm 14. The focusing poles 44*c* and 44*d*, of secondary magnetic structures 41*a* and 41*b*, are primarily operable as focused magnetic sources which combine with the magnetic fringe fields from primary magnet rows 40*b* and 40*c* to maximum magnetic energy which interacting with at least portions of the conductive trace pattern 34*a*. This example of the invention 10*n* further includes support blocks 49*a* and 49*b* to add further structural support to secondary magnet structures 41*a* and 41*b*, and to also provide a more extended surface to effectively capture and support the attachment of diaphragm 14.

In this example the passive magnetic return path from primary magnet row 40*b* has a South 'S' magnetic polarity coupled through magnetically conductive back plate 22, up magnetically conductive sidewall 24*a* and further magnetically coupled to North 'N' polarity magnetic polarity surface 64*a* of secondary magnet 42*a*, which completes a magnetic path loop by having South 'S' polarity magnetic polarity surface 66*a* magnetically coupled to magnetically conductive focusing pole 44*c*. Also, in this example transducer 10*n*, the passive magnetic return path from primary magnet row 40*c* has a North 'N' magnetic polarity coupled through magnetically conductive back plate 22, up magnetically conductive sidewall 24*b* and further magnetically coupled to South 'S' polarity magnetic polarity surface 64*b* of secondary magnet 42*b*, which completes a magnetic path loop by having North 'N' polarity magnetic polarity surface 66*b* magnetically coupled to magnetically conductive focusing pole 44*d*. The 'South' polarity of magnet row 40*b* is magnetically coupled through back plate 22 and through sidewall 24*a* to magnetically conductive focusing pole 44*c*. The 'North' polarity of magnet row 40*c* is magnetically coupled through back plate 22 and through sidewall 24*b* to magnetically conductive focusing pole 44*d*.

As another aspect of the planar magnetic transducer 10*n* of FIG. 17, the secondary magnetic structure 41*a* is positioned at a first lateral sidewall 24*a* of the transducer device, the secondary magnetic structure 41*a* includes the secondary magnet 42*a* with the secondary magnet 42*a* having a first magnetic polarity surface 66*a*, where a magnetically conductive focusing pole 44*c* is attached to the first magnetic polarity surface 66*a* of the at least one secondary magnet 42*a*. The primary magnet row 40*b* closest to the first lateral sidewall 24*a* of the support frame 12 has a primary magnetic polarity surface coupled to the magnetically conductive back-plate 22 and the primary magnetic polarity surface has an 'S' or 'South' primary magnetic polarity. The magnetically conductive backplate 22 is magnetically coupled through the magnetically conductive sidewall 24*a* to the magnetically conductive secondary focusing pole 44*c* of the secondary magnet structure 41*a*. The first magnetic polarity surface 66*a* of the secondary magnet 42*a* has a secondary magnetic polarity 'S' or 'South' such that the primary magnetic polarity and the first secondary magnetic polarity are the same 'S' or 'South' magnetic polarity.

The secondary magnetic structure 41*b* is positioned at a second lateral sidewall 24*b* of the transducer device, the secondary magnetic structure 41*b* includes the secondary magnet 42*b* with the secondary magnet 42*b* having a first magnetic polarity surface 66*b*, where a magnetically conductive focusing pole 44*d* is attached to the first magnetic polarity surface 66*b* of the at least one secondary magnet 42*b*. The primary magnet row 40*c* closest to the second lateral sidewall 24*b* of the support frame 12 has a primary magnetic polarity surface coupled to the magnetically conductive back-plate 22 and the primary magnetic polarity surface has an 'N' or 'North' primary magnetic polarity. The magnetically conductive backplate 22 is magnetically coupled through the magnetically conductive sidewall 24*b* to the magnetically conductive secondary focusing pole 44*d* of the secondary magnet structure 41*b*. The first magnetic polarity surface 66*b* of the secondary magnet 42*b* has a secondary magnetic polarity 'N' or 'North' such that the primary magnetic polarity and the first secondary magnetic polarity are the same 'N' or 'North' magnetic polarity.

The planar magnetic transducer example 10*n* has increased, double sided drive efficiency while exhibiting substantial acoustic transparency such that the acoustic output in the primary acoustic output direction 8*a* is unimpeded.

Referring now to FIG. 14 and FIG. 17, FIG. 14 shows a first lateral x-axis primary magnet row 40*b*, closest to sidewall 24*a*, has a polarity orientation with a 'N' or 'North' polarity "up" relative to y-axis or towards the first surface side 30 of diaphragm 14, and an 'S' or 'South' polarity "down" relative to y-axis, towards the backplate 22, and a first lateral x-axis secondary magnet 42*a* has the same 'N' or 'North' polarity "up" and 'S' or 'South' polarity "down" orientation as primary magnet row (shown in these figures as 40*b*), closest to sidewall 24*a*. FIG. 17 shows the same relationships but with first secondary magnet 42*a* rotated counter clockwise by 90-degrees. It is desirable in all preferred embodiments that in the inventive planar magnetic transducer that the maximum rotation of secondary magnet be positioned from zero to 90-degrees, but no more than a 90-degree rotation relative to the nearest primary magnet row, shown in these FIGS. 14 and 17 as 40*b*.

FIG. 14 shows a second lateral x-axis primary magnet row 40*c* closest to sidewall 24*b*, has a polarity orientation with an 'S' or 'South' polarity "up" relative to y-axis or towards the first surface side 30 of diaphragm 14, and an 'N' or 'North' polarity "down" relative to y-axis, towards the backplate 22, and a first lateral x-axis secondary magnet 42*a* has the same 'S' or 'South' polarity "up" and 'N' or 'North' polarity "down" orientation as second primary magnet row closest to sidewall 24*b*, which is primary magnet row 40*c* in this illustration. FIG. 17 shows the same relationships but with first secondary magnet 42*a* rotated clockwise by 90-degrees. It is desirable in all preferred embodiments that in the inventive planar magnetic transducer that the maximum rotation of the secondary magnet be positioned from zero to 90-degrees, but no more than a 90-degree rotation relative to the nearest primary magnet row, shown in these FIGS. 14 and 17 as 40*b*.

FIG. 18 shows a cross sectional view of an alternate version of secondary magnetic structure 41*b* which could be substituted in place of the secondary magnetic structure 41*b* of FIG. 17. This cut-away view of secondary magnet structure 41*b*, shows partial diaphragm 14 and conductive pattern 34*a*, sidewall 24*b*, flange 26*b*, magnet 42*b* and focus pole 44*d*. In this example, the focus pole 44*d* is slightly elevated off of diaphragm 14 with separation space 50*b*, allowing the diaphragm to be wider and have movement under the focus pole 44*d*, which may increase total diaphragm area and the output capability of the inventive transducer. The focus pole 44*d* may have openings to increase acoustic transparency, similar to the ones illustrated in openings 93 of the cut-away plan view of FIG. 23.

Figure 19:
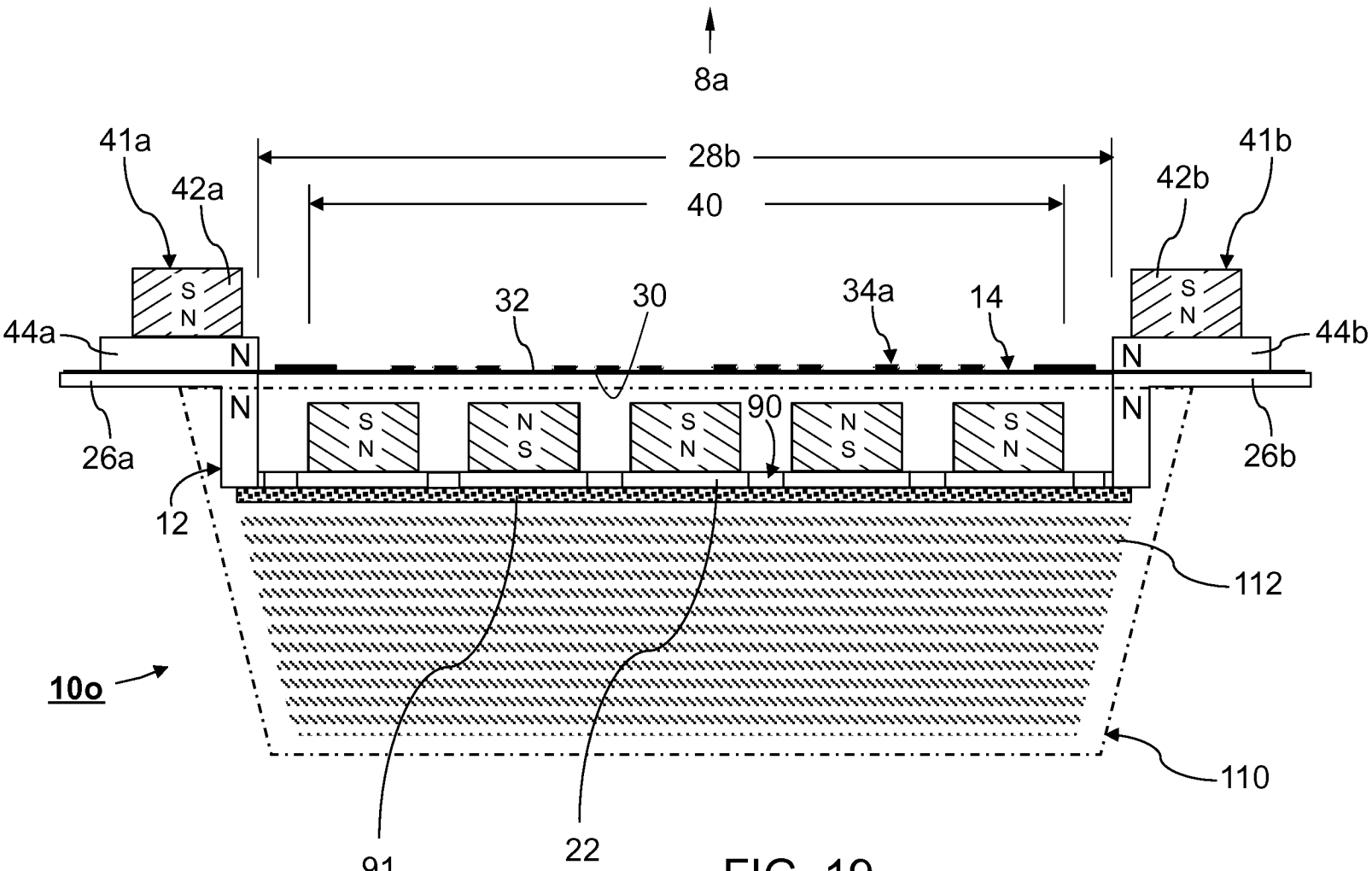
FIG. 19 shows a cross-sectional view of a fifteenth example of the invention.

FIG. 19 shows a fifteenth example of the invention with transducer 10*o* which is based on the same general structure of the invention as shown in FIG. 1A, while increasing the number of primary magnet rows 40 to a total of five magnet rows. Added is an enclosure 110 attached in a substantially sealed relationship to support frame 12 of transducer 10*o*. The enclosure may be filled with acoustically absorbent material 112, such as acoustic foam, fiberglass, Dacron or some other acoustically lossy material. The support frame 12 supports primary magnetic magnet array 40 on magnetically conductive backplate 22. The transducer 10*o* includes secondary magnet structures 41*a* and 41*b*, coupled to flanges 26*a* and 26*b* respectively, and including magnets 42*a* and 42*b* and focusing poles 44*a* and 44*b* respectively. Diaphragm 14 has a first surface side 30 and second surface side 32 with conductive pattern 34*a* formed on the second surface side 32 of diaphragm 14. A perimeter portion of diaphragm 14 is supported by support frame 12 such that a vibratable portion 28*b* of the diaphragm 14 is held in a predetermined state of tension.

Openings 90, in back plate 22, allow acoustic energy from first surface side 30 to radiate through acoustic damping material 91 and on into enclosure 110. Acoustic energy radiating from second surface side 32 of transducer 10*o* radiates freely without interference in primary acoustic path direction 8*a*.

Figure 20:
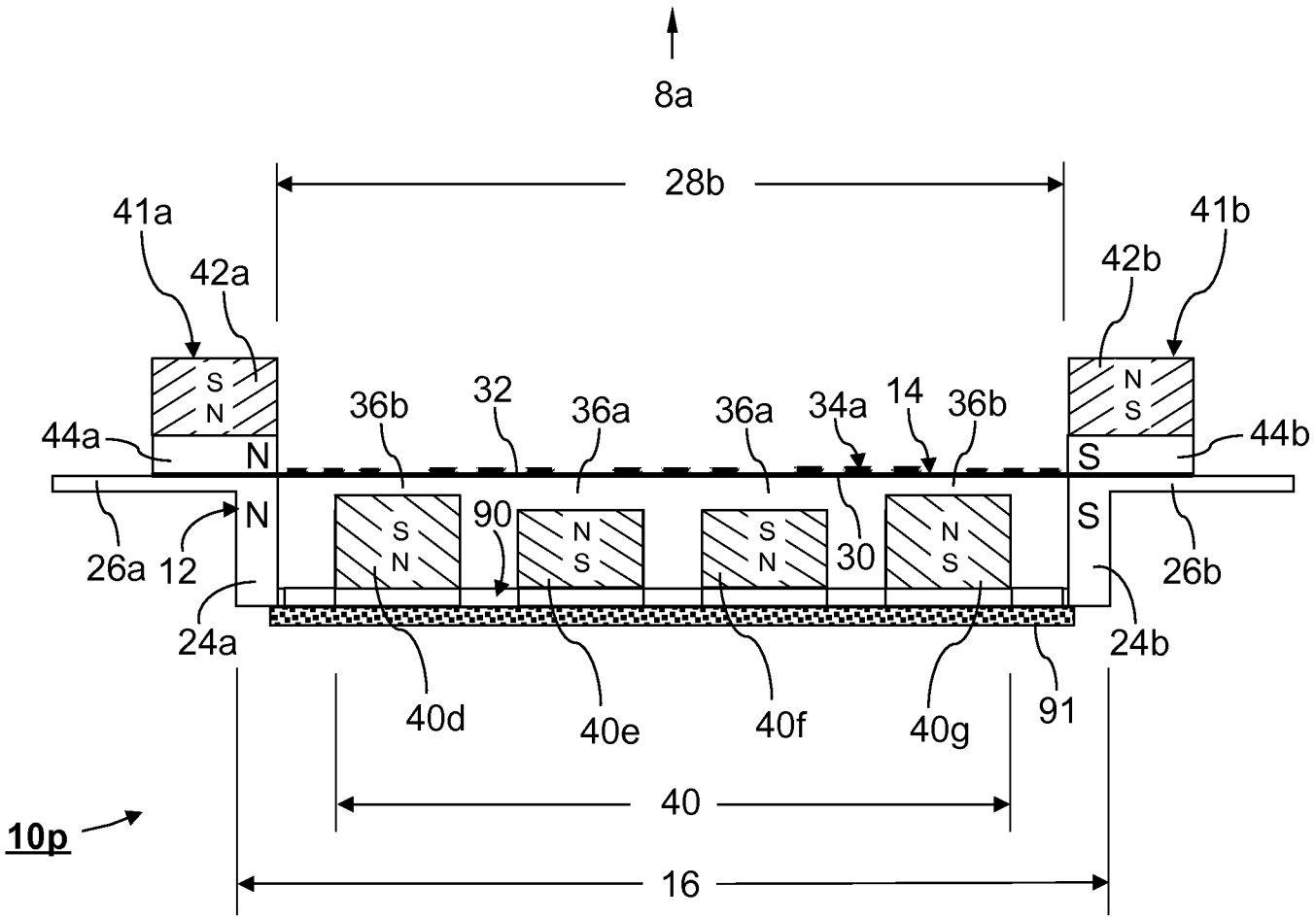
FIG. 20 shows a cross-sectional view of a sixteenth example of the invention with a rear chamber.

FIG. 20 shows a sixteenth example of the invention with transducer 10*p*. The support frame 12 supports primary magnetic structure 16 with primary magnetic magnet array 40 attached to, preferably magnetically conductive, backplate 22, which is mechanically and magnetically coupled to sidewalls 24*a* and 24*b*. Primary magnet array 40 includes four rows of primary magnets, 40*d*, 40*e*, 40*f*, and 40*g*. The transducer 10*p* further includes secondary magnet structures 41*a* and 41*b*, coupled to flanges 26*a* and 26*b* respectively, and including magnets 42*a* and 42*b* and focusing poles 44*a* and 44*b* respectively. Diaphragm 14 has a first surface side 30 and second surface side 32 with conductive pattern 34*a* formed on the second surface side 32 of diaphragm 14. A perimeter portion of diaphragm 14 is supported by support frame 12 such that a vibratable portion 28*b* of the diaphragm 14 is held in a predetermined state of tension.

Openings 90, in back plate 22, allow acoustic energy from first surface side 30 to radiate through acoustic damping material 91. Central primary magnet rows 40*e* and 40*f* have a gap spacing distance 36*a* from first surface side 30 of diaphragm 14. Outer primary magnet rows 40*d* and 40*g* have a smaller gap spacing distance 36*b* from first surface side 30 of diaphragm 14 than that of gap spacing distance 36*a*, which may increase magnetic energy to portions of conductive trace pattern 34*a*. Acoustic energy radiating from second surface side 32 of transducer 10*p* radiates freely without interference in primary acoustic path direction 8*a*.

Figure 21:
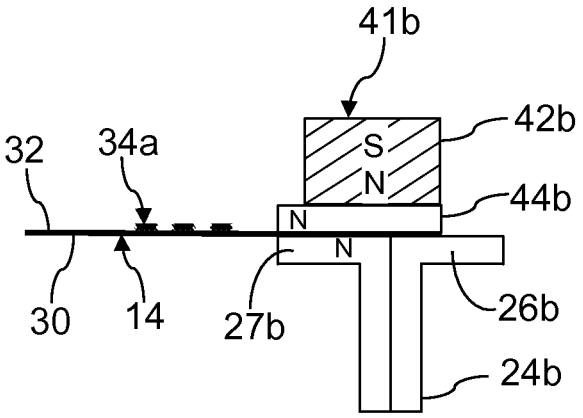
FIG. 21 shows a cross-sectional view of still another example of the secondary magnet structure of the invention.

FIG. 21 shows a cross sectional view of an alternate format of secondary magnetic structure 41*b* which could be substituted in place of the secondary magnetic structure 41*b* of previously disclosed examples of the invention. This cutaway view of secondary magnet structure 41*b*, shows partial diaphragm 14 with first surface side 30 and second surface side 32 and conductive pattern 34*a*, sidewall 24*b*, flange 26*b*, magnet 42*b* and focus pole 44*d*. In this example, a primary focus return pole 27*b* is shown coupled to the flange 26*b* and sidewall 24*b* and also connected against a first surface side 30 of diaphragm 14, while secondary focus plate 44*b* is connected against a second surface 32 of diaphragm 14 and coupled to primary focus return pole 27*b* and secondary magnet 42*b*. This approach can provide greater magnetic field focus from primary focus pole 27*b* and secondary focus pole 44*b* to conductive trace pattern 34*a* and may increase diaphragm mobility and acoustic output capability of the invention.

Figure 22:
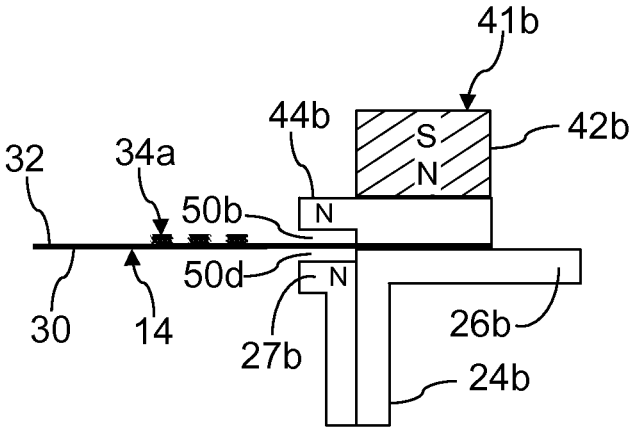
FIG. 22 shows an cross-sectional view of an another example of the secondary magnet structure of the invention.

FIG. 22 shows another cross sectional view of an alternate format of secondary magnetic structure 41*b*, which could be substituted in place of the secondary magnetic structure 41*b* of previously disclosed examples of the invention. This cutaway view of secondary magnet structure 41*b*, shows partial diaphragm 14 with first surface side 30 and second surface side 32 and conductive pattern 34*a*, sidewall 24*b*, flange 26*b*, magnet 42*b* and focus pole 44*b*. In this example, a primary focus return pole 27*b* is shown coupled to the flange 26*b* and sidewall 24*b* and spaced away from a first surface side 30 of diaphragm 14, with gap opening 50*d* while secondary focus plate 44*b* has a portion elevated off of the second surface side 32 of diaphragm 14, with gap opening 50*b*, and focus plate 44*b* is coupled to flange 26*b* and connected to secondary magnet 42*b*.

Figure 23:
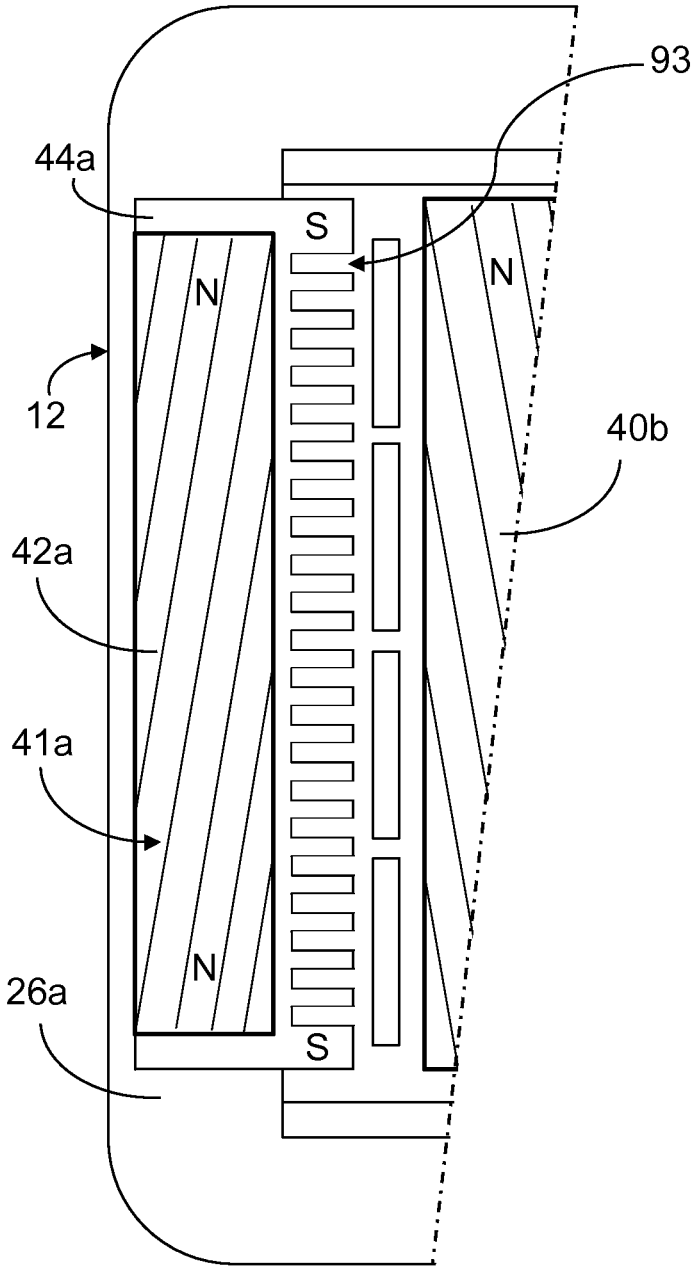
FIG. 23 shows a cut-away partial plan view of another example of an acoustical openings feature of the secondary magnet structure of the invention.

The focus pole 44*b* may have openings to increase acoustic transparency, similar to the ones illustrated in openings 93 of secondary focusing pole 44*a* of the cut-away plan view of FIG. 23. The use of gap openings 50*b* and 50*d* allow a projection of focusing poles 44*b* and 27*b* to be closer to conductive traces 34*a* and also allow a wider diaphragm 14 which may provide greater diaphragm mobility and greater acoustic output capability in the inventive transducer.

FIG. 23 shows a partial plan view of the invention, diaphragm 14 (not shown) removed for clarity. Shown is support frame 12, primary magnet row 40*b*, and flange 26*a*, supporting secondary magnet structure 41*a*, with secondary magnet row 42*a* and secondary focus pole plate 44*a*. This view shows focus pole plate 44*a* extending laterally towards the center of the transducer (as shown in FIG. 14) with focus pole plate 44*a* having slot openings 93 which may provide greater acoustic transparency and reduced acoustical loading of the diaphragm.

Figure 24:
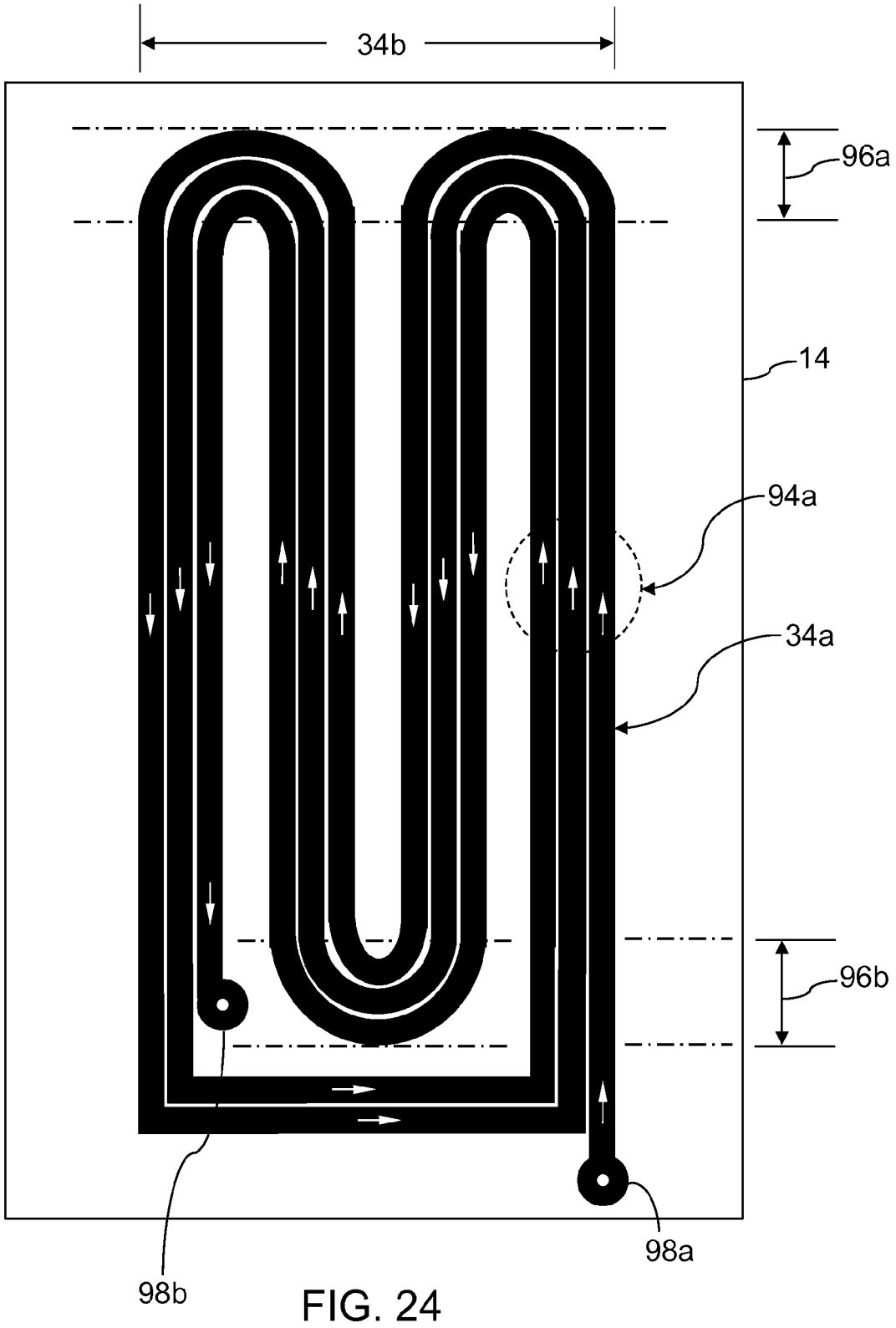
FIG. 24 shows a plan view of a first example of a conductive trace pattern on a diaphragm of the invention.

FIG. 24 shows a plan view of a first example of a conductive trace pattern 34*a* on an example diaphragm 14 of the invention, with bounded lateral width 34*b* of the conductive traces 34*a*. Electrical end run return traces 96*a* and 96*b* show what may be lossy return trace paths, normally undriven, but activated with use of example of the invention 10*b* of FIG. 4, with secondary magnetic structures 41*c*, 41*d*, and 41*e*. Shown in 94*a* is the current path direction for one electrical polarity of an electrical input signal connected to input connections 98*a* and 98*b*. The particular trace pattern 34*a* of FIG. 24 is compatible with the invention examples of figures; 1A, 1B, 4, 5A, 5B 7A, 7B, 13, 14, and 15. The conductive trace pattern 34*a* may be formed on (referring to FIG. 1A) a first surface side 30 or the second surface side 32 or conductive trace patterns may be formed on both surface sides of the diaphragm 14. The trace pattern 34*a* may be conductively seamless or may be broken into different conductive sections not electrically connected to each other.

Figure 25:
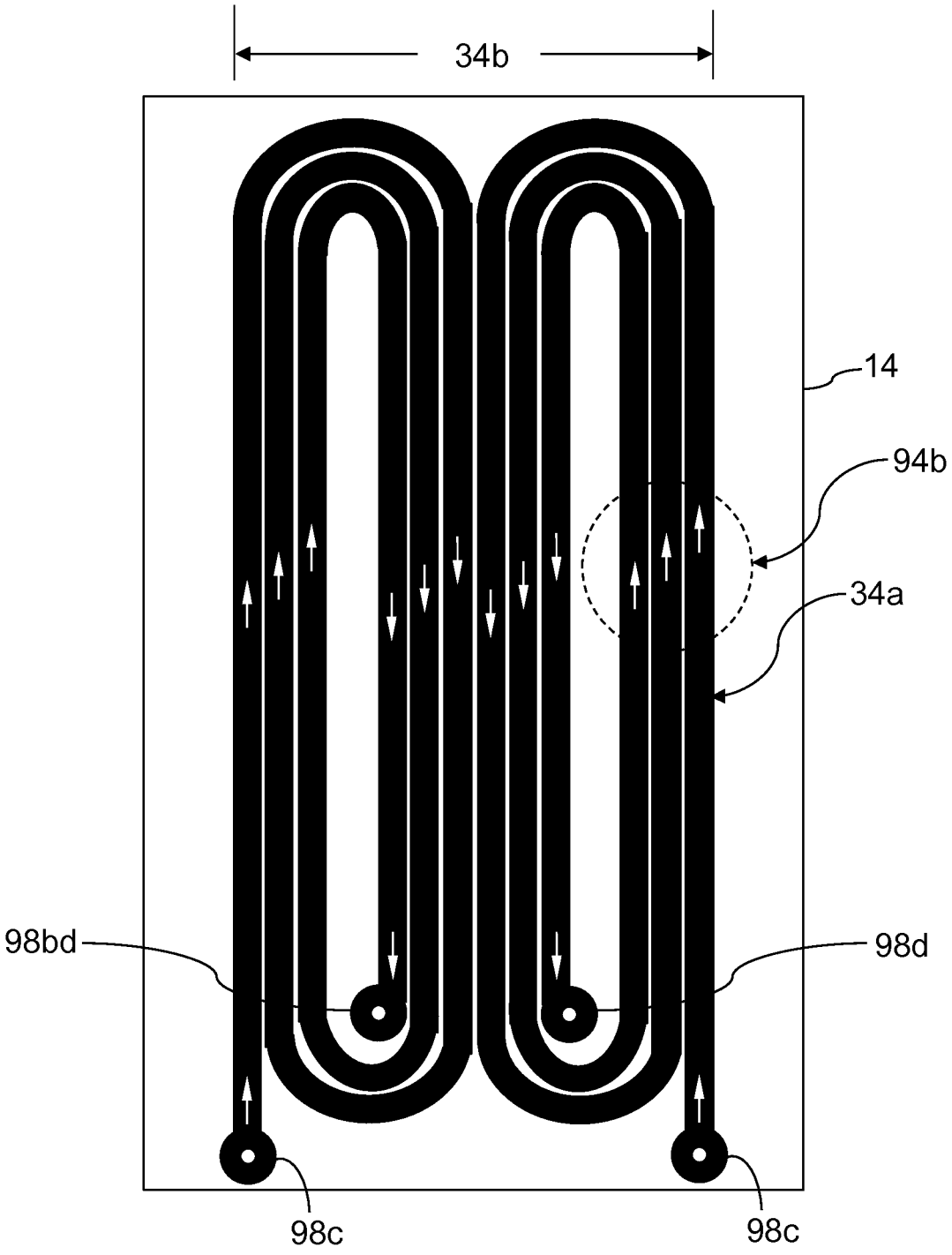
FIG. 25 shows a plan view of a second example of a conductive trace pattern on a diaphragm of the invention.

FIG. 25 shows a plan view of a second example of a conductive trace pattern 34*a* on an example diaphragm 14 of the invention, with bounded lateral width 34*b* of the conductive traces 34*a*. Shown in 94*b* is the current path direction for one electrical polarity of an electrical input signal connected to input connections 98*c* and 98*d*. The particular trace pattern 34*a* of FIG. 25 is compatible with the invention examples of figures; 10, 12, and 17.

Referring to FIG. 24 and FIG. 1A, the conductive trace pattern 34*a* may be composed of a of a single layer of conductive foil with a plane of the conductive foil in parallel with a plane of the vibratable portion 28*b* of the diaphragm 14 and attached to the second surface side 32 of the vibratable portion 28 of the diaphragm 14, as shown, and an additional, second conductive trace pattern (not shown) with a of a single layer of conductive foil with a plane of the conductive foil in parallel with the plane of the vibratable portion 28*b* of the diaphragm may be attached to the first surface side of the diaphragm 30.

Various materials and processes known in the art of planar magnetic transducers may be applied to the invention. Thin film diaphragms may consist of polyester, polyamide, PEEK, PEN™ or Mylar™, or any other suitable thin flexible film as a substrate may be applied. The thin film is preferably less than 2 mil in thickness, and more preferably less than 1 mil in thickness. Any material functionally similar to the examples described above may be appropriate for use as a thin film diaphragm as described in this application.

Conductive traces may be derived from many conductive materials, such as aluminum, copper or other conductors. Many conductor forms may work well, with thin metal films or tape, or strips being preferable. The conductive trace pattern may be of fairly wide range of thicknesses about 1 mil depending on the desired resistance, trace length, and mass that is optimal for a specific application. The diaphragm and conductor can be constructed with a variety of techniques known in the art of planar magnetic transducers. A polymer film substrate may be applied with a thin adhesive with a metal conductive sheet adhered to the polymer diaphragm material, and then the conductor can be etched to form the desired conductive trace pattern.

Other methods can be used, such as laying up conductive tape on a polymer diaphragm, vapor deposition, or other deposition means for applying a conductor to a film diaphragm. Also methods can be used where the polymer is poured or cast onto the conductive metal foil and formed to the desired thickness, with or without an adhesive layer. This can work well with polyamide/Kapton™ materials.

The diaphragm 14, including the conductive traces 34*a* applied thereto, may be held flat or alternatively, deformed to create lines of flexion such as by knurling, pressing, embossing, corrugating or the like, prior to being placed under tension within a support frame so as to achieve advantages, including, but not limited to, reducing loss of diaphragm tension, reducing distortion or resonance modes along active surface areas of the diaphragm when electrical energy is applied through the conductor trace pattern. A plurality of generally parallel lines of flexion may be created across the at least a portion of the diaphragm including the conductive trace pattern mounted thereto, with the lines being made transversely and, more preferably, generally perpendicularly with respect to the length of the conductive traces extending along at least one surface side of the diaphragm.

The diaphragm 14 may be placed under tension in width direction, in a length direction or both, or some differentiation of tension depending on other design parameters. For example if the diaphragm is corrugated in one direction, the diaphragm may be more or less to allow the corrugations to maintain integrity of form, or tension may be only in a length or width direction, or tension may be adequately created by the deformation or corrugation itself.

Magnets incorporated in the invention can be of high energy types such as Neodymium or Samarium-cobalt, or medium energy product magnets such as ferrite magnets, Ceramic 5 and Ceramic 8, or lower energy magnets such as impregnated rubber or plastic magnets, or any quality magnet type may be utilized as can be formed and applied to a planar magnetic transducer.

All the disclosed examples provide different forms of the invention of which each embody the fundamental advantages of the invention relative to the prior art.

It is evident that those skilled in the art may now understand how various configurations can be realized by way of mixing and matching combinations of the novel structures disclosed in the figures, and also make numerous uses of and departures from the specific apparatus and techniques disclosed herein without departing from the inventive concepts. Consequently, the invention is to be construed as embracing each and every novel feature and novel combination of features disclosed herein.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention.

What is claimed is:

1. A planar-magnetic transducer device for generating an acoustic output based on an electrical signal, comprising;

a support frame, a diaphragm including a first surface side and a second surface side, where a perimeter portion of the diaphragm is supported by the support frame such that a vibratable portion of the diaphragm is held in a predetermined state of tension, a conductive trace pattern formed on the diaphragm and arranged to receive an electrical input signal, a primary magnetic structure including at least one primary magnet row coupled to the support frame, where each primary magnet row is positioned adjacent to, and spaced a predetermined distance from, the first surface side of the vibratable portion of the diaphragm and is operable as a fringe field source interacting with at least a portion of the conductive trace pattern, at least one secondary magnetic structure positioned at a first lateral side of the transducer device, the secondary magnetic structure including at least one secondary magnet with the secondary magnet having a first magnetic polarity surface and a second magnetic polarity surface, where a magnetically conductive focusing pole is attached to the first magnetic polarity surface of the at least one secondary magnet, the at least one secondary magnetic structure is mounted to the support frame and positioned above a plane of the second surface side of the diaphragm with the at least one secondary magnet positioned laterally outside of the vibratable portion of the diaphragm, the magnetically conductive focusing pole of the secondary magnetic structure operable as a focused field magnetic source interacting with at least a portion of the conductive trace pattern, and the electrical signal is applied to the conductive trace pattern such that the primary magnet row fringe field and the secondary magnetic structure focused field cause movement of the conductive trace pattern and the vibratable portion of the diaphragm, thereby generating the acoustic output.

2. The planar-magnetic transducer of claim 1, including;

a first outermost lateral edge of the conductive trace pattern and a second outermost lateral edge of the conductive trace pattern bounding a driven portion of the vibratable portion of the diaphragm, wherein the secondary magnet structure magnetically conductive focusing pole is positioned laterally outside of the driven portion of the vibratable portion of the diaphragm.

3. The planar-magnetic transducer of claim 1, wherein;

the secondary magnet structure magnetically conductive focusing pole extends over a portion of the second surface side of the vibratable portion of the diaphragm and is spaced a predetermined focusing pole gap distance away from the second surface side of the diaphragm.

4. The planar-magnetic transducer of claim 1, wherein;

the secondary magnet structure magnetically conductive focusing pole extends over a portion of the second surface side of the vibratable portion of the diaphragm and is spaced a predetermined focusing pole gap distance away from the second surface side of the diaphragm, the magnetically conductive focusing pole includes openings for increasing an acoustical transparency of the magnetically conductive focusing pole.

5. The planar-magnetic transducer of claim 1, wherein;

the secondary magnet structure magnetically conductive focusing pole is attached laterally outside of the vibratable portion of the diaphragm.

6. The planar-magnetic transducer of claim 1, wherein;

the secondary magnetic structure is positioned laterally outside of the vibratable portion of the diaphragm.

7. The planar-magnetic transducer of claim 1, wherein;

a first secondary magnetic structure is positioned on a first lateral side of the transducer and a second secondary magnetic structure is positioned on a second lateral side of the transducer.

8. The planar-magnetic transducer of claim 1, wherein;

the secondary magnetic structure includes an extended magnetically conductive focusing pole attached to the second polarity surface of the secondary magnet, the extended magnetically conductive focusing pole extends over a portion of the second surface side of the vibratable portion of the diaphragm and over a portion of the conductive trace pattern, the extended magnetically conductive focusing pole includes a polarity termination surface which is spaced a predetermined extended focusing pole gap distance away from the second surface side of the vibratable portion of the diaphragm.

9. The planar-magnetic transducer of claim 1, wherein;

the secondary magnetic structure includes an extended magnetically conductive focusing pole attached to the second polarity surface of the secondary magnet, the extended magnetically conductive focusing pole includes a polarity termination surface and the polarity termination surface extends over a portion of the second surface side of the vibratable portion of the diaphragm and over a portion of the conductive trace pattern, the polarity termination surface of the extended magnetically conductive focusing pole is spaced a predetermined extended focusing pole gap distance away from the second surface side of the vibratable portion of the diaphragm, the polarity termination surface is positioned adjacent a polarity portion of a primary magnet row that has a same polarity as the extended magnetically conductive focusing pole, the extended magnetically conductive focusing pole includes openings for increasing an acoustical transparency of the extended magnetically conductive focusing pole.

10. The planar-magnetic transducer of claim 1, wherein; at least one secondary magnetic structure is positioned at an end of the transducer.

11. The planar-magnetic transducer of claim 1, wherein; at least one magnetic structure is positioned at a first end of the transducer, and at least one secondary magnetic structure is positioned at a second end of the transducer.

12. The planar-magnetic transducer of claim 1, wherein; the primary magnetic structure has a magnetically conductive back-plate.

13. The planar-magnetic transducer of claim 1, wherein; the primary magnetic structure has a non-magnetically conductive back-plate.

14. The planar-magnetic transducer of claim 1, wherein; each primary magnet row of the primary magnetic circuit are magnetized through each magnet row in an orthogonal direction relative to a plane of the vibratable portion of the diaphragm.

15. The planar-magnetic transducer of claim 1, wherein; each primary magnet row of the primary magnetic circuit are magnetized through each magnet row in a parallel direction relative to a plane of the vibratable portion of the diaphragm and the primary magnetic structure has a non-magnetically conductive back-plate.

16. The planar-magnetic transducer of claim 1, wherein; the primary magnetic structure includes exactly of one magnet row.

17. The planar-magnetic transducer of claim 1, wherein; the primary magnetic structure includes exactly two magnet rows.

18. The planar-magnetic transducer of claim 1, wherein; the primary magnetic structure includes exactly three magnet rows.

19. The planar-magnetic transducer of claim 1, wherein; the primary magnetic structure includes exactly four magnet rows.

20. The planar-magnetic transducer of claim 1, wherein; the primary magnetic structure includes exactly five magnet rows.

21. The planar-magnetic transducer of claim 1, wherein; the primary magnetic structure includes more than five magnet rows.

22. The planar-magnetic transducer of claim 1, wherein; the primary and secondary magnetic structures include high-energy magnets with an energy product of at least 20 Mega Gauss Oersteds.

23. The planar-magnetic transducer of claim 1, wherein; the primary magnetic structure includes a high-energy magnet with an energy product of at least 20 Mega Gauss Oersteds and the secondary magnet structure includes a magnet with an energy product of less than 6 Mega Gauss Oersteds.

24. The planar magnetic transducer of claim 1, wherein;

the secondary magnetic structure includes at least one elongated magnet row with a length between 33% and 80% of a length of a longest magnet row of the at least one magnet row of the primary magnet structure.

25. The planar magnetic transducer of claim 1, wherein;

the primary magnetic structure comprises five magnet rows, the five magnet rows consist of high-energy neodymium magnets with an energy product of greater than 30 Mega Gauss Oersteds, the transducer includes two secondary magnet structures including magnets with an energy product of less than 6 Mega Gauss Oersteds, the planar magnetic transducer including an enclosure to contain an acoustic energy emission from the vibratable portion of the first surface side of the diaphragm.

26. The planar-magnetic transducer of claim 1, wherein;

the secondary magnetic structure is magnetized through the magnet in an orthogonal direction relative to a plane of the vibratable portion of the diaphragm.

27. The planar-magnetic transducer of claim 1, wherein;

the secondary magnetic structure is magnetized through the secondary magnet in an parallel direction relative to a plane of the vibratable portion of the diaphragm.

28. The planar-magnetic transducer of claim 1, wherein; the conductive trace pattern consists of a single layer of conductive foil with a plane of the conductive foil in parallel with a plane of the vibratable portion of the diaphragm.

29. The planar-magnetic transducer of claim 1, comprising a first conductive trace pattern with a of a single layer of conductive foil with a plane of the conductive foil in parallel with a plane of the vibratable portion of the diaphragm and attached to the first surface side of the vibratable portion of the diaphragm, and a second conductive trace pattern with a of a single layer of conductive foil with a plane of the conductive foil in parallel with the plane of the vibratable portion of the diaphragm and attached to the second surface side of the diaphragm.

30. The planar-magnetic transducer of claim 1, further including;

a waveguide covering at least a portion of the secondary magnetic structure.

31. The planar-magnetic transducer of claim 1, wherein;

a primary magnet row closest to a lateral sidewall of the support frame has a primary magnetic polarity surface coupled to a magnetically conductive back-plate, the primary magnetic polarity surface has a primary magnetic polarity, the magnetically conductive back-plate is magnetically coupled through a magnetically conductive sidewall to the magnetically conductive focusing pole of the secondary magnet structure, the first magnetic polarity surface of the secondary magnet has a secondary magnetic polarity such that the primary magnetic polarity and the secondary magnetic polarity are the same magnetic polarity.

32. The planar-magnetic transducer of claim 1, wherein the diaphragm is a thin film diaphragm.

33. The planar-magnetic transducer of claim 1, wherein;

the primary magnetic structure includes at least three primary magnet rows, a first lateral outermost primary magnet row closest to a first sidewall of the support frame and a second lateral outermost primary magnet row closest to a second sidewall of the support frame each have a spacing gap between the first surface side of the vibratable portion of the diaphragm and a closest adjacent surface of the first and second outermost magnet rows that is less than a spacing gap between the first surface side of the vibratable portion of the diaphragm and a closest adjacent surface of at least one magnet row between the outermost magnet rows.

34. The planar-magnetic transducer of claim 1, wherein;

the primary magnetic structure includes at least two primary magnet rows and at least one passive magnetically conductive return pole row coupled to a backplate of the support frame, the passive magnetically conductive return pole row positioned between, and in parallel with, the two primary magnet rows and spaced a predetermined distance from, the first surface side of the vibratable portion of the diaphragm.

35. A method of forming a double side magnetic field, planar magnetic transducer with increased acoustic transparency in a primary direction acoustic output, the method including the steps of;

mounting a perimeter portion of a diaphragm to a support frame such that the support frame holds a vibratable portion of the diaphragm in a predetermined state of tension;

forming a conductive trace pattern on at least one of a first surface side and a second surface side of the vibratable portion of the diaphragm;

coupling a primary magnetic structure to the support frame, where the magnetic structure includes at least one primary magnet row;

positioning the at least one primary magnet row spaced a predetermined gap distance from, and adjacent to, the vibratable portion of first surface side of the diaphragm; coupling at least one secondary magnetic structure to the support frame, where the at least one secondary magnetic structure includes at least one secondary magnet and one magnetically conductive focusing pole;

positioning the secondary magnetic structure above a plane of the second surface side of the diaphragm;

positioning the secondary magnet laterally outside of the vibratable portion of diaphragm;

attaching the magnetically conductive focusing pole to a first polarity surface of the secondary magnet;

configuring each primary magnet row to be operable as a fringe field source interacting with at least a portion of the conductive trace pattern;

configuring the magnetically conductive focusing pole of the secondary magnet structure to be operable as a focused field source interacting with at least a portion of the conductive trace pattern; and adapting the conductive trace pattern to receive an electrical input signal.

36. The method of claim 35 further including the further steps of;

attaching an extended magnetically conductive focusing pole to a second polarity surface of the secondary magnet, where the extended magnetically conductive focusing pole includes a polarity termination surface;

positioning the polarity termination surface of the extended magnetically conductive focusing pole to extend over at least a portion of the second surface side of the vibratable portion of the diaphragm and to be spaced a predetermined extended focusing pole gap distance away from the second surface side of the diaphragm; and configuring the extended magnetically conductive focusing pole to include openings to increase an acoustical transparency of the extended magnetically conductive focusing pole.

37. The method of claim 35 further including the further steps of;

attaching an extended magnetically conductive focusing pole, including a polarity termination surface, to a second polarity surface of the secondary magnet;

positioning the polarity termination surface of the extended magnetically conductive focusing pole to extend over at least a portion of a portion of the conductive trace pattern spaced a predetermined extended focusing pole gap distance away from the second surface side of the vibratable portion of the diaphragm;

positioning the polarity termination surface to be adjacent a polarity portion of a primary magnet row that has a same polarity as the polarity termination surface of the extended magnetically conductive focusing pole; and configuring the extended magnetically conductive focusing pole to include openings to increase an acoustical transparency of the extended magnetically conductive focusing pole.

* * * * *